US011523632B2

(12) United States Patent
Giddings et al.

(10) Patent No.: US 11,523,632 B2
(45) Date of Patent: Dec. 13, 2022

(54) APPARATUS AND METHOD FOR PACKAGING CONES

(71) Applicant: Cascade Manufacturing Solutions, LLC, Portland, OR (US)

(72) Inventors: Christopher Giddings, Gresham, OR (US); Roger Sunday, Portland, OR (US)

(73) Assignee: Cascade Manufacturing Solutions, LLC

( * ) Notice: Subject to any disclaimer, the term of this patent is extended or adjusted under 35 U.S.C. 154(b) by 0 days.

(21) Appl. No.: 17/510,488

(22) Filed: Oct. 26, 2021

(65) Prior Publication Data

US 2022/0110359 A1 Apr. 14, 2022

Related U.S. Application Data

(63) Continuation-in-part of application No. 16/937,186, filed on Jul. 23, 2020, now Pat. No. 11,178,900.
(Continued)

(51) Int. Cl.

| | |
|---|---|
| ***A24C 5/54*** | (2006.01) |
| ***B65B 1/06*** | (2006.01) |
| ***B65B 57/10*** | (2006.01) |
| ***B65B 43/60*** | (2006.01) |
| ***A24C 5/34*** | (2006.01) |
| ***B65B 1/24*** | (2006.01) |
| ***A24C 5/06*** | (2006.01) |

(Continued)

(52) U.S. Cl.
CPC ..... *A24C 5/54* (2013.01); *A24C 5/002* (2013.01); *A24C 5/06* (2013.01); *A24C 5/34* (2013.01); *B65B 1/06* (2013.01); *B65B 1/24* (2013.01); *B65B 7/08* (2013.01); *B65B 43/60* (2013.01); *B65B 57/10* (2013.01)

(58) Field of Classification Search
CPC .. A24C 5/54; A24C 5/002; A24C 5/06; A24C 5/34; B65B 1/06; B65B 1/24; B65B 7/08; B65B 43/60; B65B 57/10
See application file for complete search history.

(56) References Cited

U.S. PATENT DOCUMENTS

| | | | | |
|---|---|---|---|---|
| 4,572,216 A * | 2/1986 | Josuttis | ..... | A24C 5/42 131/70 |
| 7,905,235 B2 * | 3/2011 | Patel | ..... | A24C 5/40 131/57 |

(Continued)

*Primary Examiner* — Nicolas A Arnett
(74) *Attorney, Agent, or Firm* — Greenspoon Marder LLP; Justin F. McNaughton

(57) ABSTRACT

A system and method for closing and sealing a cone filled with a smokable material provides a cone filler control system, a plurality of cone inserts each including a tapered inner wall defining a taper lock area for holding a cone filled with smokable material, and an insert ring provided at a lower end of each cone insert, each of the plurality of cone inserts removably inserted in corresponding cone receptacles residing in a cone carousel, a cone tamper actuator for compacting smokable material in a filled cone, a cone closer system including a gripper actuator for closing the cone top of the filled cone, and a cone sealing drive system including a motor with a drive wheel operated to impart a rotational force on the insert ring of each cone insert to rotate both the cone insert and a filled cone to form a wick seal at the end of the filled cone.

31 Claims, 25 Drawing Sheets

Related U.S. Application Data

(60) Provisional application No. 62/878,109, filed on Jul. 24, 2019.

(51) Int. Cl.
*A24C 5/00* (2020.01)
*B65B 7/08* (2006.01)

(56) References Cited

U.S. PATENT DOCUMENTS 10,028,618 B1 * 7/2018 Benson ..... A47J 42/00
10,440,984 B1 * 10/2019 Richmond ..... A24C 5/392
10,751,722 B1 * 8/2020 Pearson ..... B02C 4/42
10,905,153 B1 * 2/2021 Sinclair, Jr. ..... A24D 1/008
11,058,144 B2 * 7/2021 Mullen ..... A24C 5/54
11,130,596 B2 * 9/2021 Holderman ..... B65B 43/56
11,148,835 B2 * 10/2021 Holderman ..... B31B 50/52
11,178,900 B2 * 11/2021 Giddings ..... A24C 5/002
11,246,336 B2 * 2/2022 Holderman ..... B65D 3/20
11,332,268 B2 * 5/2022 Giddings ..... B65B 1/24
2018/0279668 A1 * 10/2018 Chan ..... A24C 5/321
2019/0297936 A1 * 10/2019 Kang ..... A24C 3/00
2019/0320707 A1 * 10/2019 Boucher ..... A24C 5/02
2019/0320709 A1 * 10/2019 Kaufmann ..... A24C 5/06
2019/0320710 A1 * 10/2019 Sirois ..... A24C 5/44
2020/0068947 A1 * 3/2020 Leadbeater ..... A24C 5/34
2020/0367549 A1 * 11/2020 Kamer ..... A24C 5/002
2020/0399006 A1 * 12/2020 Cottone ..... B65B 29/00
2021/0022388 A1 * 1/2021 Sullivan ..... A24C 5/02
2021/0022389 A1 1/2021 Giddings
2021/0024233 A1 * 1/2021 Giddings ..... A24C 5/002
2021/0030054 A1 * 2/2021 Godwin ..... A24C 5/02
2021/0169133 A1 * 6/2021 Ahn ..... A24C 5/08
2021/0177045 A1 * 6/2021 Mullen ..... A24C 5/54
2021/0267264 A1 * 9/2021 Grigsby ..... A24D 1/18
2021/0392944 A1 * 12/2021 Kustal ..... A24C 5/02

* cited by examiner

APPARATUS AND METHOD FOR PACKAGING CONES

CROSS-REFERENCE PARAGRAPH

This application is a Continuation-In-Part (CIP) that claims priority to co-pending U.S. patent application Ser. No. 16/937,186, entitled, "Apparatus and Method for Packaging Cones", filed Jul. 23, 2020, which claims the benefit of U.S. Provisional Application No. 62/878,109 entitled, "Precision Cannabis Cone Loader and Filler," filed Jul. 24, 2019, the contents of which are incorporated herein by reference in its entirety as though set forth in full.

BACKGROUND OF THE INVENTION

Various systems have been developed to package cones with smokable materials. In the context of cannabis consumption, a cone is a type of "joint" that is more conical in shape than a conventional tubular shaped joint or cigarette. The cone preferably starts straight and relatively narrow on one end, and then widens as the cone get longer when moving to the top of the cone that is lit by the user. After the smokable material, here cannabis, is placed into the interior of the cone, the cone top may be pinched, twisted, folded, or otherwise sealed to retain the smokable material within the cone. A filter, stone, crutch, or the like may optionally be placed in the bottom of the cone (the narrow end) where the user draws the smoke from to prevent resin and/or particulates from exiting the bottom of the cone.

Cones are typically made of paper, or a paper-like sheet of burnable material, that are preformed prior to filling with the smokable material. Preferably, the cone material, when burned during consumption, does not add undesirable flavors, smells, or other harmful chemicals into the smoke that is inhaled by the user.

A variety of pre-formed cones are available on the commercial market. Because of the many different vendors of pre-formed cones, the available pre-formed cones come in a variety of different shapes and/or sizes that are designed to hold different amounts of smokable material. Thus, legacy cone filling devices or systems have difficulty handling cones of different shapes and/or sizes during the filling process. Further, legacy cone filling devices or systems have difficulty controlling precise predefined amounts of the smokable material that is added into the various different shapes and/or sizes of the pre-formed cones.

Accordingly, in the arts of cone filling devices, there is a need in the arts for improved methods, apparatus, and systems for filling cones with smokable materials.

SUMMARY OF THE INVENTION

Embodiments of the cone dispenser system dispenses a leading cone in a stack of cones into a cone receptacle. An example embodiment comprises a cone filler control system; a cone stack feed tube that receives a cone stack; a roller drive motor; a roller coupled to the roller drive motor that is located below the cone stack feed tube outlet, wherein the roller is rotated for a predefined duration by the roller drive motor when the roller drive motor is actuated by the cone filler control system; and a cone chute located below the roller and above a cone receptacle, wherein the roller rotates to draw the leading cone out from the cone stack feed tube outlet and into the cone chute inlet in response to actuation of the roller drive motor, and wherein the leading cone travels through the cone chute into the cone receptacle after the leading cone has entered into the cone chute.

Another embodiment includes a cone top sealing system that closes and seals a cone filled with a smokable material, said cone top sealing system comprising: a cone filler control system, a plurality of cone inserts each including a cylindrical body having an interior, an open end, and a lower end, said interior including an inner wall that progressively tapers inwards of said interior towards said lower end defining a taper lock area for readily holding or configured to hold a cone filled with smokable material, each of said plurality of cone inserts removably inserted to rotate and move freely within a corresponding cone receptacle residing in a cone carousel, said lower end of each of said plurality of cone inserts including an insert ring, a primary cone tamper actuator including a first tamper head, wherein the primary cone tamper actuator extends and retracts within a cone filled with smokable material, said cone filled with smokable material retained within one of said plurality of cone inserts, a gripper actuator including a first gripper arm, a second gripper arm, a first seal plate attached to a distal end of said first gripper arm, and at least a second seal plate attached to a distal end of said second gripper arm, said gripper arms moveable towards and away from each other, a cone sealing drive system including a motor with a shaft, and a drive wheel affixed to the distal end of said shaft, said drive wheel removably engaging an insert ring of each of said plurality of cone inserts, wherein the cone filler control system communicates or is configured to communicate a first control signal to actuate the primary cone tamper actuator extending the first tamper head downward into said cone filled with smokable material to pack said smokable material therein, and to capture said cone filled with smokable material within said taper lock area of one of said plurality of cone inserts, wherein the cone filler control system communicates or is configured to communicate a second control signal to operate the motor and rotate the drive wheel a predetermined time period to impart a rotating force on an insert ring of one of said plurality of cone inserts rotating said cone filled with smokable material simultaneously with one of said plurality of cone inserts that is rotating freely within a corresponding cone receptacle, and wherein the cone filler control system communicates or is configured to communicate a third control signal to actuate the gripper actuator forcing the gripper arms to move towards each other where the seal plates close a cone top of said cone filled with smokable material while one of said plurality of cone inserts and said cone filled with smokable material are rotated, via, the drive wheel, twisting said cone top to form a wick seal at the end of said cone filled with smokable material.

In one aspect, the at least second seal plate includes a third seal plate and a spacer captured between the second seal plate and the third seal plate forming a plate gap.

In another aspect, there is further included a second cone tamper actuator including a second tamper head retracted and extended within the cone filled with smokable material.

In another aspect, the primary cone tamper actuator, the second cone tamper actuator, and the gripper actuator are pneumatic or electronic actuators.

In one aspect, the gripper actuator is mounted to a mounting bracket adjustably attached to a frame member of the cone top sealing system and positioned within a cone sealing area so that a cone receiving area defined by a spaced-apart distance between a first seal plate and at least a second plate is configured to readily receive a cone top of a cone filled with smokable material.

In another aspect, the cone top sealing system further comprises a ramp system including a ramp situated below the cone carousel for supporting the lower ends of a plurality of cone inserts resting on an upper surface of the ramp, and at least one adjustment member in contact with the ramp for adjusting both the vertical height of both the ramp and the plurality of cone inserts. The ramp guides the plurality of cone inserts towards the gripper actuator where the cone top of a filled cone is positioned within a cone receiving area of the gripper actuator, and the drive wheel engages the insert ring on one of a plurality of cone inserts.

BRIEF DESCRIPTION OF THE DRAWINGS

The components in the drawings are not necessarily to scale relative to each other. Like reference numerals designate corresponding parts throughout the several views.

DETAILED DESCRIPTION

The disclosed systems and methods for filling cones with smokable material using a cone filling system 100, 300 will become better understood through review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods filling cones with smokable material using the cone filling system 100, 300 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Communicatively coupled" means that an electronic device is communicatively connected to another electronic device, either wirelessly or with a wire based connector, whether directly or indirectly through a communication network, wire based connector, or a wireless connection.

Figure 1:
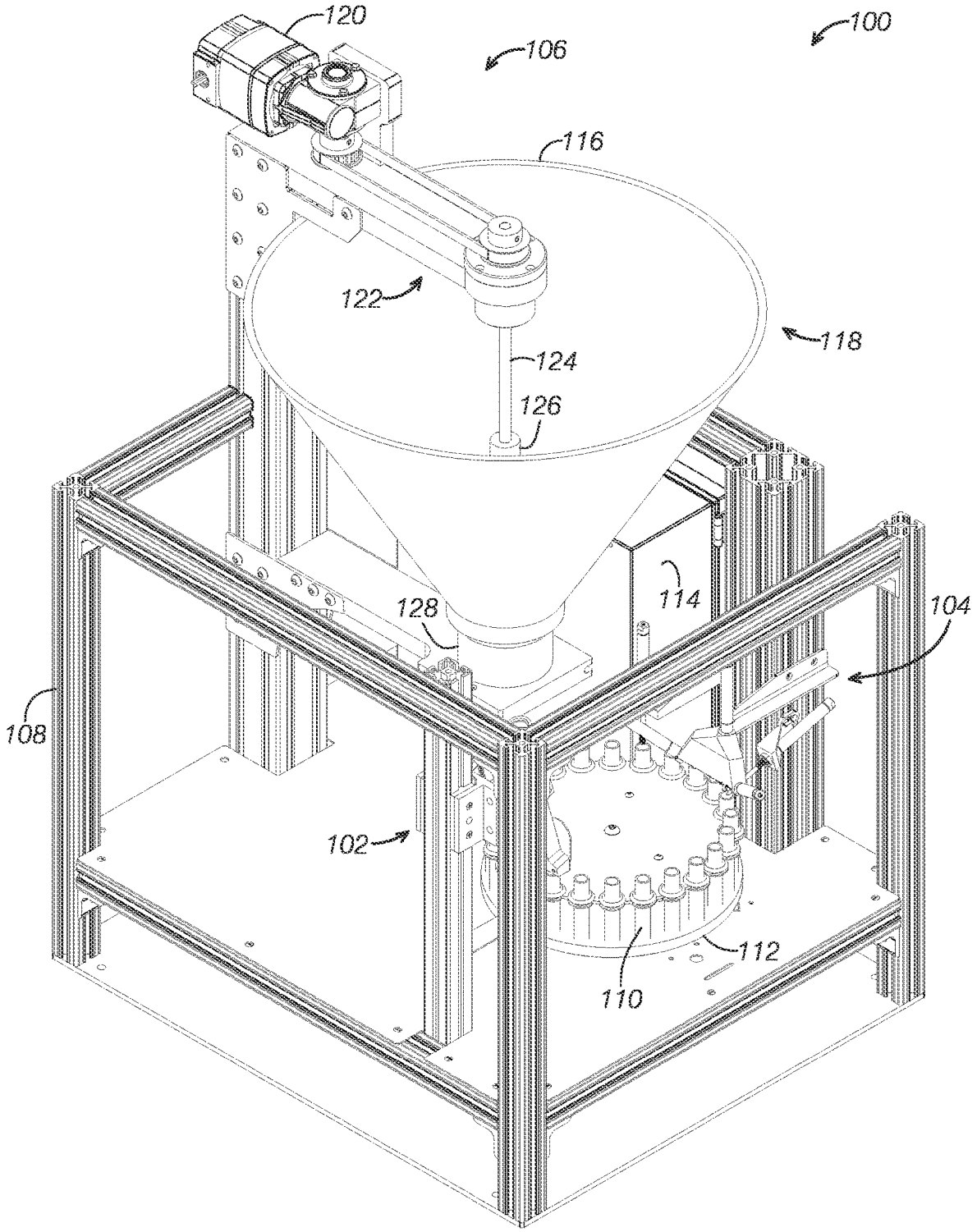
FIG. 1 is a perspective diagram of a cone filling system in accordance with one embodiment of the present invention.

Referring now to FIG. 1 there is shown a cone filling system 100 in accordance with one embodiment of the present invention. Cone filling system 100 comprise a cone dispenser system 102, a cone top sealing system 104, and an auger load system 106 secured on a frame 108. The cone dispenser system 102 dispenses individual cones in the cone receptacles 110 residing in the cone carousel 112. The auger control system 106 dispenses smokable material into an individual cone residing in a cone receptacle 110. A cone filler control system 114 manages the operation of the cone dispenser system 102, the cone top sealing system 104, the auger load system 106, and other components of the cone filling system 100.

The cone filling system 100 comprises a hopper 116 configured to receive some amount of smokable material that is added into a top portion 118 of the hopper 116. In response to a global start cycle generated by the cone filler control system 114, a plurality of operations are concurrently performed. A cone loading stage performs a first operation, interchangeably referred to herein as a cone dispensing operation, to dispense a single empty cone into an empty first cone receptacle 110 by the cone dispenser system 102. A cone filling stage performs a second operation, interchangeably referred to herein as a cone filling operation, that adds a predefined amount of smokable material into the empty cone residing in a second one of the cone receptacles 110 of the cone carousel 112. In some embodiments, an optional third operation referred to herein as a tamping process (cone tamping stage) is performed on a filled cone to compress the smokable material that has been added into the cone during the cone filling stage. A cone closing stage performs a fourth operation, interchangeably referred to herein as a cone folding stage, where the top of a filled cone residing in a third one of the cone receptacles 110 is folded and sealed by the cone top sealing system 104. An optional cone evacuation stage performs an optional fifth operation, interchangeably referred to herein a cone evacuation operation, wherein a filled and sealed cone is removed from a fourth one of the cone receptacles 110. At the conclusion of these operations, the cone filler control system 114 generates a carousel indexing signal that indexes the cone carousel 112 by one position. That is, the cone carousel 112 is rotated by one cone receptacle position such that each one of the cone receptacles 110 are rotated in a serial fashion through the cone loading stage, the cone filling stage, the optional tamping stage, the cone closing stage and the optional cone evacuation stage.

The illustrated portion of the auger load system 106 comprises an auger drive motor 120, a belt drive system 122, an auger shaft 124, and an auger 126. The auger load system 106 rotatably drives the auger 126 for a determined duration to dispense a predefined amount of the smokable material through a lower portion 128 of the hopper 116. The auger 126 extends through a hole (aperture) located at the lower portion 128 of the hopper 116. An outside diameter of the auger 126 is sized to fit through the hole, wherein a rim (edge) of the hole has a diameter that is slightly greater than the outside diameter of the auger 126. Accordingly, smokable material is not able to pass between the outside diameter of the edges of the helical screw blade of the auger 126 and the rim of the hole. However, the auger 126 is able to freely turn within the hole without any, or with very little, frictional resistance from the rim of the hole that the auger 126 extends through.

During operation, the control system 114 converts the user specified amount of smokable material received in the user input into a determined duration. The control signal is communicated from the cone filler control system 114. The belt drive system 122 couples a shaft 124 of the auger 126 to the auger drive motor. Actuation of the auger drive motor 120 for the determined duration, in response to the control signal, turns a belt of the belt drive system 122 so that the shaft 124 of the auger 126 rotates for the determined duration. The helical screw blade of the auger 126, as it is rotated for the determined duration, captures smokable material residing in the hopper 116. Rotation of the auger transports the captured smokable material downward and out through the lower portion 128 of the hopper 116. Accordingly, the helical screw blade of the auger 126 dispenses the user specified amount of smokable material out from the lower portion 128 of the hopper 116 into the empty cone. The captured smokable material is then transported downward by the movement of the helical screw blade of the auger 126, and is then dispensed out through the hole in the bottom of the hopper 116. The smokable material being dispensed from the hole of the hopper 116 is guided into a single cone residing in a cone receptacle 110 via a feed chute (not shown) that is oriented directly below the lower portion 128 of the hopper 116.

Figure 2:
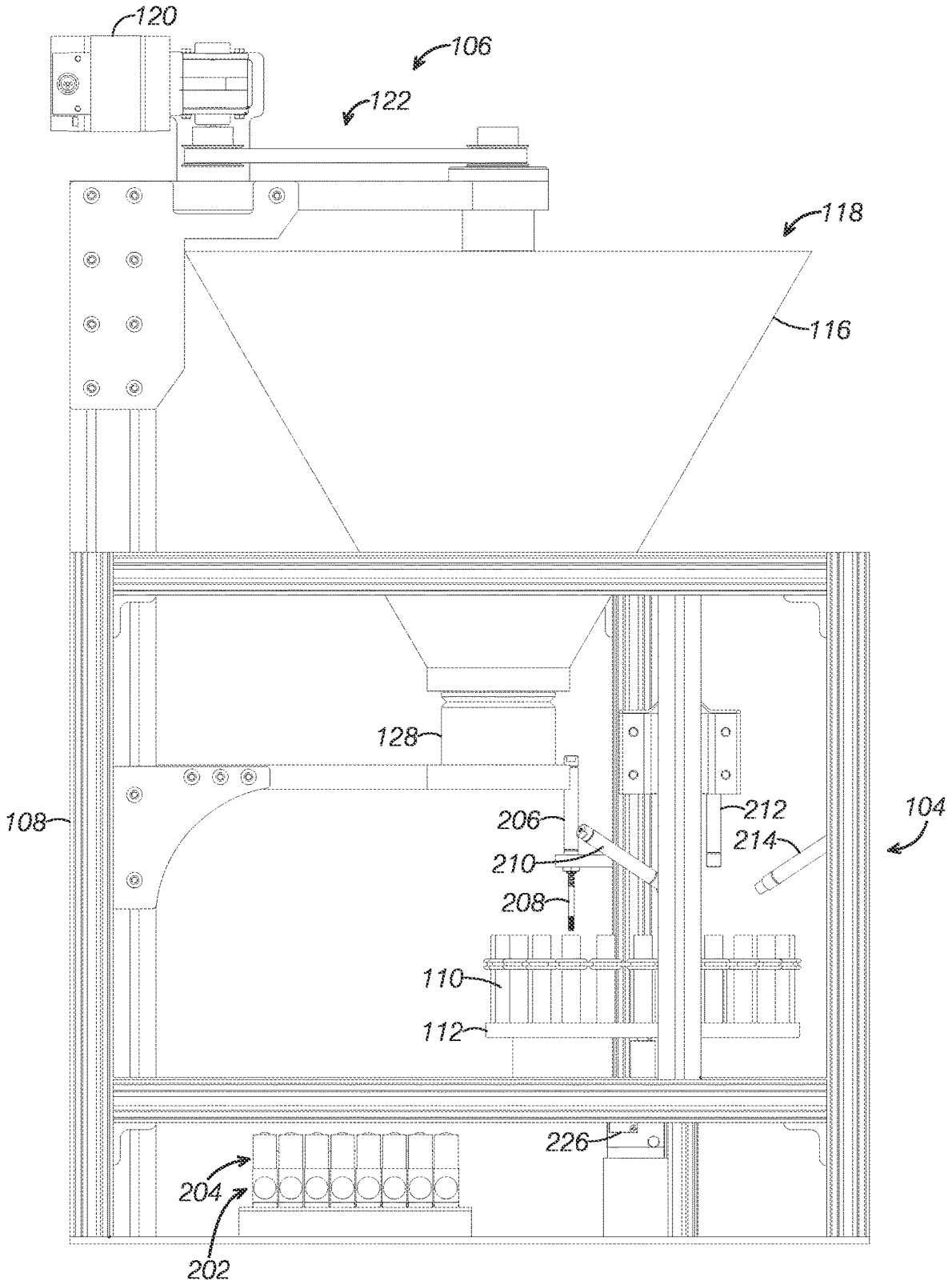
FIG. 2 is a side view of the cone filling system.
Figure 3:
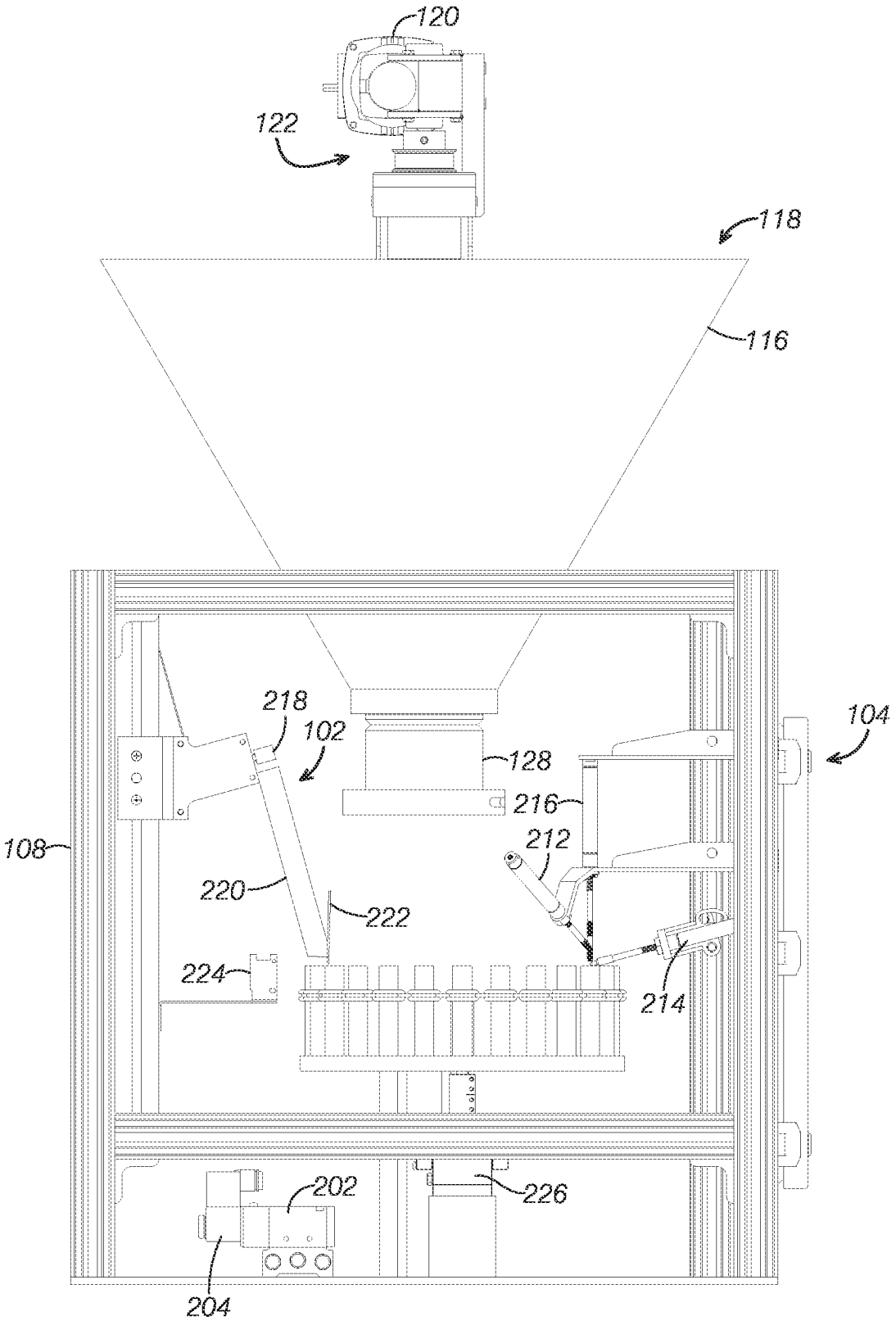
FIG. 3 is a front view of the cone filling system.

FIG. 2 is a side view of the example cone filling system 100 showing additional detail of the cone top sealing system 104. FIG. 3 is a front view of the example cone filling system 100 showing additional detail of the cone dispenser system 102 and the cone top sealing system 104. FIG. 3 illustrates a portion of the cone dispenser system 102 (not visible in FIG. 2).

In a preferred embodiment, various components of the cone filling system 100 are driven using compressed air, nitrogen, or any suitable gas. In a preferred embodiment, a plurality of electronically driven solenoids 202 are communicatively coupled to the cone filler control system 114 using a suitable wire connector and/or a wireless connection (not shown). When selected ones of the solenoids 202 are actuated by a control signal generated by the cone filler control system 114, the actuated solenoid 202 moves a piston (not shown) in an air compressor unit 204. The compressed air expelled from the air compressor unit 204 is communicated through an air hose (not shown) to a corresponding pneumatic actuator. In alternative embodiments, one or more of the actuators may be a hydraulic actuator operated by a pressurized liquid or another suitable fluid. Alternatively, or additionally, one or more of the actuators may be an electrical actuator communicatively coupled to the cone filler control system 114 that are operated by using an electronic solenoid under the control of the cone filler control system 114.

An optional cone packer actuator 206 (omitted from FIG. 3), coupled to one of the air compressor units 204, is operable to extend a packing tool 208 downward onto a cone that has been previously filled by the auger load system 106. One or more repeated extensions of the packing tool 208 compresses the smokable material down into the filled cone. Then, the cone with the compressed smokable material is moved by the cone carousel 112 to the cone top sealing system 104. In the various embodiments, the packing tool 208 may be a pneumatic actuator, a hydraulic actuator, or an electronic solenoid.

In a preferred embodiment, the cone top sealing system 104 comprises three cone top closing actuators 210, 212, and 214. A cone top sealing actuator 216 (not visible in FIG. 2) is disposed directly above the cone that is being closed. In the various embodiments, the actuators 210, 212, 214, and/or 216 may be a pneumatic actuator (solenoid), a hydraulic actuator, or an electronic solenoid. In other embodiments, other numbers of cone top closing actuators may be employed to close and seal the top of a filled cone.

As described in greater detail herein, during an operation of a cone folding stage, the first cone top closing actuator 210 is actuated in response to a control signal issued from the cone filter control system 114 to extend a first closing head (not shown) on a downward slant onto the top of the open cone that has been filled with the smokable material. In a preferred embodiment, the slant angle is forty five degrees (45°). Any suitable slant angle may be used in the various embodiments as a matter of design choice. The extending first closing head of the first cone top closing actuator 210 folds a first portion of the cone top downward onto the top of the compressed smokable material. Then, after the first closing head of the first cone top closing actuator 210 has been retracted, the cone top sealing actuator 216 (in response to a control signal issued from the cone filter control system 114) extends a tamping head downward onto the partially folded cone top to secure the folded first portion of the cone top. Next, the second cone top closing actuator 212 is actuated (in response to a control signal issued from the cone filter control system 114) to extend a second closing head (not shown) on a downward slant onto the top of the open cone. The extending second closing head of the second cone top closing actuator 212 folds a second portion of the cone top downward onto the top of the compressed smokable material. Then, after the second closing head of the first cone top closing actuator 212 has been retracted, the cone top sealing actuator 216 (in response to a control signal issued from the cone filter control system 114) extends the tamping head downward onto the partially folded cone top to secure the folded first and second portions of the cone top. Next, the third cone top closing actuator 214 is actuated (in response to a control signal issued from the cone filter control system 114) to extend a third closing head on a downward slant onto the top of the open cone that has been filled with the smokable material. The extending closing head of the third cone top closing actuator 214 folds a third remaining portion of the cone top downward onto the top of the compressed smokable material. Then, after the third closing head of the first cone top closing actuator 214 has been retracted, the cone top sealing actuator 216 (in response to a control signal issued from the cone filter control system 114) extends the tamping head down onto the folded cone top to secure and seal the folded first, second, and third portions of the cone top. Depending upon the embodiment, the cone top closing actuators 210, 212, 214 and the cone top sealing actuator 216 may be actuated one or more times during the cone top closing process as needed to ensure that the cone top has been secured and sealed. At this juncture, the cone top has been closed, secured, and sealed by the cone top sealing system 104. One skilled in the art appreciates that the cone top closing actuators 210, 212, 214 may be actuated in a different order in alternative embodiments.

The portion of the cone dispenser system 102 illustrated in FIG. 3 comprises a roller 218, a cone chute 220, an optional cone backboard 222, and an optical sensor 224. As described in greater detail herein, during operation of a cone loading stage, the spinning roller 218 engages the lower end of an empty cone in a stack of cones, and moves the engaged empty cone downward into the cone chute 220. The empty cone is further moved downward to the end of the cone chute 220 and is directed into an empty cone receptacle 110 by the cone backboard 222.

The optical sensor 224 is coupled to the frame 108 at a location that is below the outlet end of the cone chute 220 and that is above a top of the cone receptacle 110 (wherein the cone receptacle 110 is directly below the outlet end of the cone chute 220) The field of view of the optical sensor 224 lies between the outlet end of the cone chute 220 and the top of the cone receptacle 110. Accordingly, the optical sensor 224 may sense presence or absence of a cone in the cone receptacle 110. If a cone is detected in the cone receptacle 110 by the optical sensor 224, the optical sensor 224 communicates a signal to the cone filler control system 114 so that the roller 218 is not actuated a second time so as to move another empty cone downward through the cone chute 220 (since there already is an empty or a full cone in the examined cone receptacle 110). Alternatively, after one or more puffs of air have been issued from the airline, and after a predefined duration without receiving the signal from the optical sensor 224, the cone filler control system 114 may actuate the roller drive motor a second time for the predefined duration or a different duration to dispense the leading cone which had failed to pass through the outlet of the cone stack feed tube 404 into the cone chute 220.

In the various embodiments, the cone carousel 112 is secured in a fixed position during the cone loading stage, the cone filling stage, the optional cone tamping stage, the cone folding stage, and the optional cone evacuation stage. The cone carousel 112 remains stationary until completion of the operations performed at all of the stages which are concurrently operating at their respective cone receptacle 110. After all stages have completed operation of their respective task, the cone carousel 112 is incrementally rotated by one cone receptacle 110 so that the following cone receptacle 110 is advanced by one stage position to a next stage (noting that at any given time, a plurality of the cone receptacles 110 are located in between stages due to special constraints in defining the location of the various stages in the frame 108). Then, the operation of the stages is again initiated by a global start cycle under the control of the cone filler control system 114.

A last step performed is to actuate a carousel indexing motor 226 that rotates the cone carousel 112 in a step-wise fashion by one cone receptacle 110. In an example embodiment, the carousel indexing motor 226 is an electric step function motor. Other types of motors may be used in alternative embodiments. For example, but not limited to, a pneumatic stepping actuator may be used to index the cone carousel 112.

Prior to operation of the cone filling system 100, the user adds a desired amount (quantity) of smokable material into the open end at the top portion 118 of the hopper 116. The processes of cone loading, cone filling, cone tamping, cone closing and/or cone evacuation may then commence. In embodiments that employ a cone evacuation process to remove filled and sealed cones from the cone carousel 112, the processes may run indefinitely so long as a sufficient amount of smokable material is in the hopper 116. When the cone filling system 100 is continuously operating, the user may add additional smokable material as needed to keep the hopper 116 filled. If a different type of smokable material is to be packed into cones, and/or if different sized or shaped cones are to be filled, the user may stop operation of the cone filling system to add a different type of smokable material and/or to add a different type of cone into the cone filling system 100. The process may then be re-initiated by the user by causing the processor to begin a new global start cycle.

Figure 4:
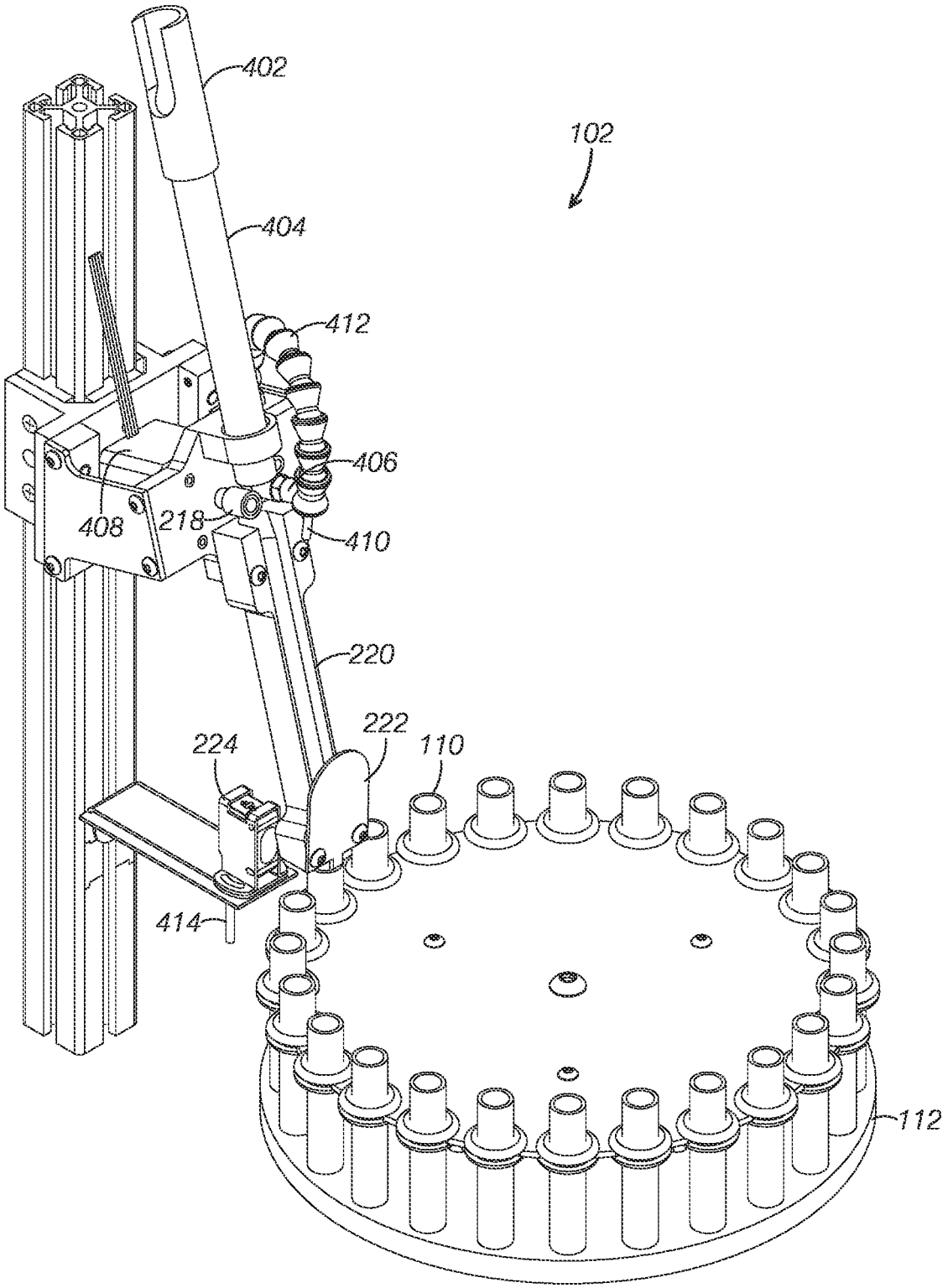
FIG. 4 is a perspective view of a cone dispenser system.
Figure 5:
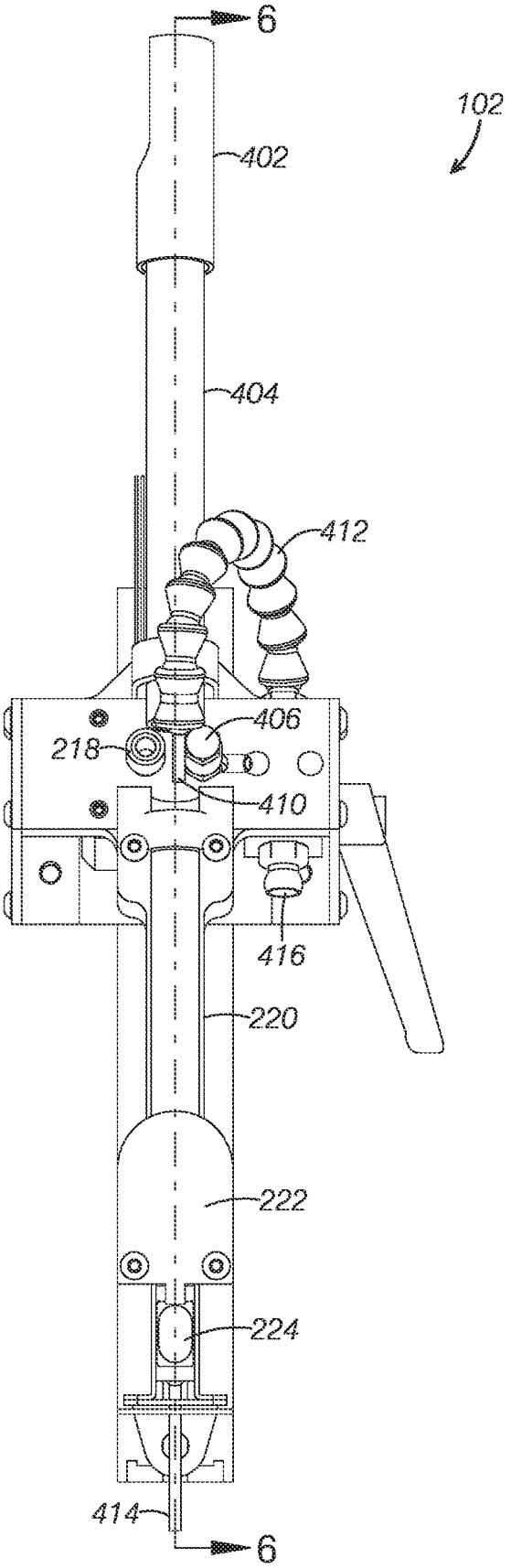
FIG. 5 is a front view of the cone dispenser system.
Figure 6:
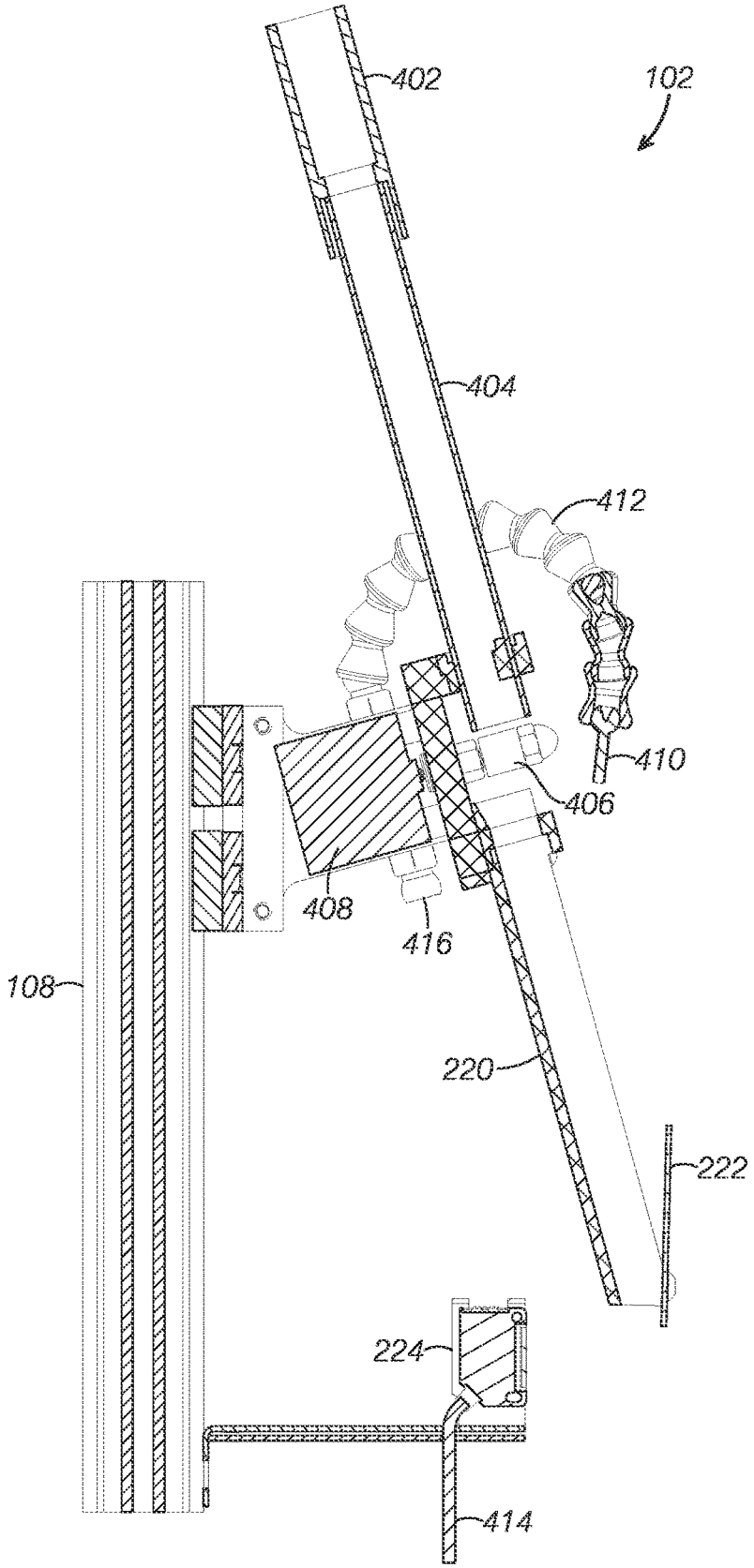
FIG. 6 is a cutaway side view of the cone dispenser system.

FIG. 4 is a perspective view of the cone dispenser system 102. FIG. 5 is a front view of the cone dispenser system 102. FIG. 6 is a cutaway side view of the cone dispenser system 102. The cone dispenser system 102 is secured to a portion of the frame 108 so as to be the first stage in the series of stages (the cone loading stage, the cone filling stage, the optional cone tamping stage, the cone folding stage, and the optional cone evacuation stage).

As described hereinabove, the cone dispenser system 102 comprises the roller 218, the cone chute 220, the optional cone backboard 222, and the optical sensor 224. The cone dispenser system 102 further comprises a cone infeed 402, a cone stack feed tube 404, an idling roller 406, a roller drive motor 408, an air nozzle 410, and an air line 412.

The upper inlet end of the cone infeed 402 is configured to receive a stack of cones manually inserted by a user. The lower outlet of the cone infeed tube is coupled to an inlet of the cone stack feed tube 404. In some embodiments, the inlet of the cone infeed 402 is configured to receive a plurality of different sized and shaped cones in a cone stack. In another embodiment, a plurality of different cone infeeds 402 are configured to receive a unique stack of cones having a unique shape and size. The plurality of different cone infeeds 402 are removably and/or slidably coupled to the inlet of the cone stack feed tube 404.

The roller 218 and the idling roller 406 are secured to the frame 108 immediately below the lower outlet of the cone stack feed tube 404. An inlet of the cone chute 220 is secured to the frame 108 directly below the roller 218 and the idling roller 406. The lower outlet of the cone chute 220 is located above one of the cone receptacles 110 such that a single dispensed cone slides down the cone chute 220, exits out of the outlet of the cone chute 220, and then enters into the empty cone receptacle 110. In an example embodiment, the back board 222 is secured to a portion of the outlet of the cone chute 220.

In practice, a plurality of stacked preformed cones are inserted into an inlet of the cone infeed 402 with the narrow bottom of the cone inserted first. The outlet of the cone infeed 402 is removably connected to an inlet of the cone stack feed tube 404. Gravity moves the stack of cones in a downward direction.

The gravity then slides the inserted stack of preformed cones down to the outlet at the bottom of the cone stack feed tube 404. The narrow bottom of the leading cone in the stack of preformed cones reaches the bottom of the cone stack feed tube 404 and then slides downward between the roller 218 and the idling roller 406. The non-rotating roller 218 and the idling roller 406 are adjacent to each other and are spaced apart by a predefined distance so as to let the narrow bottom of the cone fall between the roller 218 and the idling roller 406. The outward expanding mid-section of the engaged leading cone, which is at some point is wider that the separation distance between the roller 218 and the idling roller 406, frictionally engages the fixed roller 218 (non-rotating) such that the lower portion of the leading cone becomes fractionally secured by the roller 218 and the idling roller 406. Since the roller 218 is not being driven by the roller drive motor 408, the leading cone is not able to slide out from and exit the outlet of the cone stack feed tube 404. That is, the stationary roller 218 frictionally engages and secures the widened portion of the cone and thereby holds the cone securely in place.

The cone infeed 402, in a preferred embodiment, is configured to receive a plurality of different shaped and sized stacks of preformed cones. In an alternative embodiment, a plurality of different sized and shaped cone infeeds 402 are each configured to receive a particular shape and size of stacked preformed cones. The user may select the desired cone infeed 402 that is suitable for the particular type of cone that is to be filled with smokable material, and then secure the selected cone infeed 402 onto the top of the cone stack feed tube 404. Further, a plurality of different diameter cone stack feed tubes 404 may be interchangeable with each other so that different sized cones can be dispensed.

The cone chute 220, in a preferred embodiment, is configured to receive a plurality of different shaped and sized cones. In an alternative embodiment, a plurality of different sized and shaped cone chutes 220 are each configured to receive a particular shape and size of cones. The user may select the desired cone chute 220 that is suitable for the particular type of cone that is to be filled with smokable material, and then secure the selected cone chute 220 onto the frame 108.

At the start of the cone loading stage, which is initiated at the beginning of the global start cycle, the cone filler control system 114 actuates the roller drive motor 218 for some predefined duration that is sufficient to draw a single cone from the bottom of the cone stack feed tube 404. As the roller 218 is rotatably driven for the predefined duration by the roller drive motor 408, the ejecting cone is in frictional contact with the roller 218 and the idling roller 406. The idling roller 406 freely spins as the roller 218 drives the cone downward into the top of the cone chute 220. After the cone filler control system 114 has actuated the roller drive motor 408 for a predetermined duration (period of time) that is known to be sufficient to eject (discharge) a single cone from the bottom of the cone stack feed tube 404 into the top of the cone chute 220, the cone filler control system 114 ends actuation of (deactivates) the roller drive motor 408. That is, the rotation of the roller 218 ceases so that the next cone in the stack of cones is frictionally secured by the roller and is prevented from exiting the cone stack feed tube outlet. The bottom end of the next cone then drops downward in between the stationary roller 218 and the idling roller 406, and is held in place by the stationary roller 218 until the initiation of the next cone loading stage. That is, the roller 218 that is fixed in the stationary position prevents a next cone from exiting the outlet end of the cone feed stack tube 404.

In an alternative embodiment, the idling roller 406 is replaced by a second roller 218 that is driven by the roller drive motor(s) 408. In an example embodiment, the roller drive motor 408 drives both rollers. In another example embodiment, a second roller drive motor 408 drives the second roller. The two rollers 218 are both driven under the control of the cone filler control system 114 to cooperatively dispense a single cone from the bottom of the cone stack feed tube 404 downward into the top of the cone chute 220 when the two rollers are driven for the predefined duration. After the leading cone has been ejected from the cone stack feed tube 404, the bottom end of the next cone then drops down in between the stationary rollers 218 and is held in place by the stationary rollers 218 until the initiation of the next cone loading stage.

The cone filler control system 114 further actuates a selected one of the solenoids 202 to cause an air compressor unit 204 coupled to an inlet 416 of the airline 412 to issue one or more puffs of air out from the downwardly oriented air nozzle 410. Preferably, the puff of air is initiated after the leading cone has been ejected from the bottom of the cone stack feed tube 404 into the top of the cone chute 220 by the roller 218. The one or more puffs of air propel the single cone downward through the cone chute 220 towards an empty cone receptacle 110 that is positioned below the end of the cone chute 220. The leading end of the cone then enters into the top of the empty cone receptacle 110. The optional backboard 222 may facilitate directing and/or guiding the leading narrow end of the cone into the opening of the empty cone receptacle 110. Then, in some embodiments, a final puff of air is used to securely seat the cone into the cone receptacle 110.

During the cone loading stage, the optical sensor 224 is optically sensing the presence or absence of a cone in the cone receptacle 110 that is positioned below the lower end of the cone chute 220. The optical sensor communicates a signal to the cone filler control system 114 indicating the presence or absence of a cone in the cone receptacle 110 that is immediately below the outlet of the cone chute 220. If no cone is present, a corresponding signal may be issued by the optical sensor 224 to the cone filler control system 114, the cone filler control system 114 may initiate the cone loading stage. In an alternative embodiment, the absence of a signal from the optical sensor 224 may indicate that the cone receptacle 110 is empty.

After a cone has been seated into the cone receptacle 110, the optical sensor 224 senses the presence of the newly seated and empty cone in the cone receptacle 110. The optical sensor then communicates a signal to the cone filler control system 114 indicating that the cone is now in the cone receptacle 110. The cone filler control system 114 may then determine that the cone loading stage has been completed. In an example embodiment, the air compressor unit is optionally actuated, in response to receiving the signal from the optical sensor indicating that the leading cone is in the cone receptacle 110, a second time to emit gas from the nozzle a second time to seat the leading cone into the cone receptacle.

Alternatively, if the optical sensor 224 does not detect that the cone has been seated in the cone receptacle 110, the cone filler control system 114 may determine that the cone loading stage has not completed. Here, the cone filler control system 114 may generate further puffs of air to force the cone that may be stuck in the cone chute 220 downward into the opening of the cone receptacle 110. That is, in response to receiving the signal from the optical sensor indicating that the leading cone is in the cone receptacle 110, the air compressor unit is actuated a second time to emit gas from the nozzle a second time to further propel the leading cone down through the cone chute into the empty cone receptacle.

In some situations, as the cone carousel 112 is advanced by one position, a cone may already be present in the cone receptacle 110 that is moved into position below the lower end of the cone chute 220. Is in this situation, the optical sensor 224 detects the presence of a filled or unfilled cone. The optical sensor communicates a signal to the cone filler control system 114 that indicates the detected presence of the cone in the cone receptacle 110. In response to receiving the signal from the optical sensor 224 indicating presence of a detected cone, the cone filler control system 114 does not initiate the start of the cone loading stage. That is, the cone filler control system 114 does not actuate the roller drive motor 408. The cone filler control system 114 may then temporarily halt the cone loading stage and/or the other stages, and issue an error warning or the like to the user so that the user may investigate the situation and/or remove the detected cone. For example, a filled cone may have failed to have been evacuated from the cone receptacle 110. Accordingly, the non-evacuated cone remaining in the cone receptacle 110 would be detected by the optical sensor 224, thus preventing the loading of an empty cone into the otherwise occupied cone receptacle 110.

In some situations when the optical sensor may detect that a cone that has not been seated into the cone receptacle 110. Here, the cone filler control system 114 may determine that the cone may not have been successfully drawn out through the bottom of the cone stack feed tube 404. The cone filler control system 114 may then further actuate the roller drive motor 408 a second time for the predefined duration, or a different predefined duration, to finish expelling the leading cone out from the end of the cone stack feed tube 404 and down into the cone chute 220 so as to seat the cone in the cone receptacle 110.

In other situations when the optical sensor has not detected a cone that has been seated into the cone receptacle 110, the cone filler control system 114 may then temporarily delay the next global start cycle, and issue an error warning or the like to the user so that the user may investigate the situation. For example, the cone stack feed tube 404 may be empty, thereby requiring the user to add more cones into the cone infeed 402 to fill the cone stack feed tube 404 with new cones.

As described herein, the cone carousel 112 is incrementally rotated so that the cone receptacles 110 each pass through the cone loading stage, the cone filling stage, the optional cone tamping stage, the cone folding stage, and the optional cone evacuation stage. If during the initiation of the stages an empty cone carousel 112 has been placed into the cone filling system 100, the optical sensor will repeatedly detect empty cone receptacles 110 as they are advanced through the various stages. At some juncture, the first cone receptacle 110, now occupied with a filled and sealed cone, will rotate into the position in front of the optical detector 224. The optical detector 224 will send a signal to the cone filler control system 114 indicating that the filled and sealed cone has been detected. The cone filler control system 114 then ends the cone filling process and issues a message or the like to the user indicting that the cone carousel 112 is now filled with filled and sealed cones. Then, the user may remove and/or empty the cone carousel 112. Alternatively, with embodiments equipped with a cone evacuation system (not shown), the cone filling system can continuously operate to fill cones with the smokable material.

In the example illustrated embodiment, the optical sensor 224 is communicatively coupled to the cone filler control system 114 via a wire-based connector 414. An alternative embodiment may communicatively couple the optical sensor 224 to the cone filler control system 114 using a suitable wireless signal.

In a preferred embodiment, the air line 412 is a section of an adjustable lock air line with the air nozzle 410 coupled to one end of the air line 412. During set up, the adjustable lock airline may be conveniently positions and oriented to provide one or more downward directed puffs of air to force the leading coned down through the cone chute 220 and then into an empty cone receptacle 110. The opposing end of the adjustable lock air line 412 is coupled to an air line inlet 416 that is configured to be secured to the end of a flexible air line hose.

The opposing end of the air line 412 is coupled to one of the air compressor units 204. When the associated solenoid 202 is actuated by the cone filler control system 114 for a short predefined duration, the generated compressed air is expelled out as a puff of air through the air nozzle 410. In an alternative embodiment, any suitable air line 412 may be used. In some embodiments, the opposing end of the airline 412 is coupled directly to the air compressor unit 204.

In some embodiments, multiple air lines 412 (each with nozzles 410) may be positioned and oriented downward at various locations along the cone chute 220 to facilitate transport of a cone through the cone chute 220 and/or to seat the cone into the cone receptacle 110. For example, the cone filler control system 114 may serially actuate a plurality of solenoids 202 to cause corresponding air compressor units 204 to sequentially emit puffs of gas through the air nozzles 410 of the multiple air lines 412. The timing of the puffs of air out of each of the series of multiple air lines 412 may be arranged so as to advance a cone down through the cone chute 220 and into a cone receptacle 110.

Any suitable diameter and/or material of the roller 218 and the idling roller 406 may be used in the various embodiments. The diameters of the roller 218 and the idling roller 406 may be different. Further, in some embodiments, the position of one or both of the roller 218 and the idling roller 406 may be adjustable so that the separation distance between the roller 218 and the idling roller 406 can be adjusted to accommodate various sizes of cones.

Figure 7:
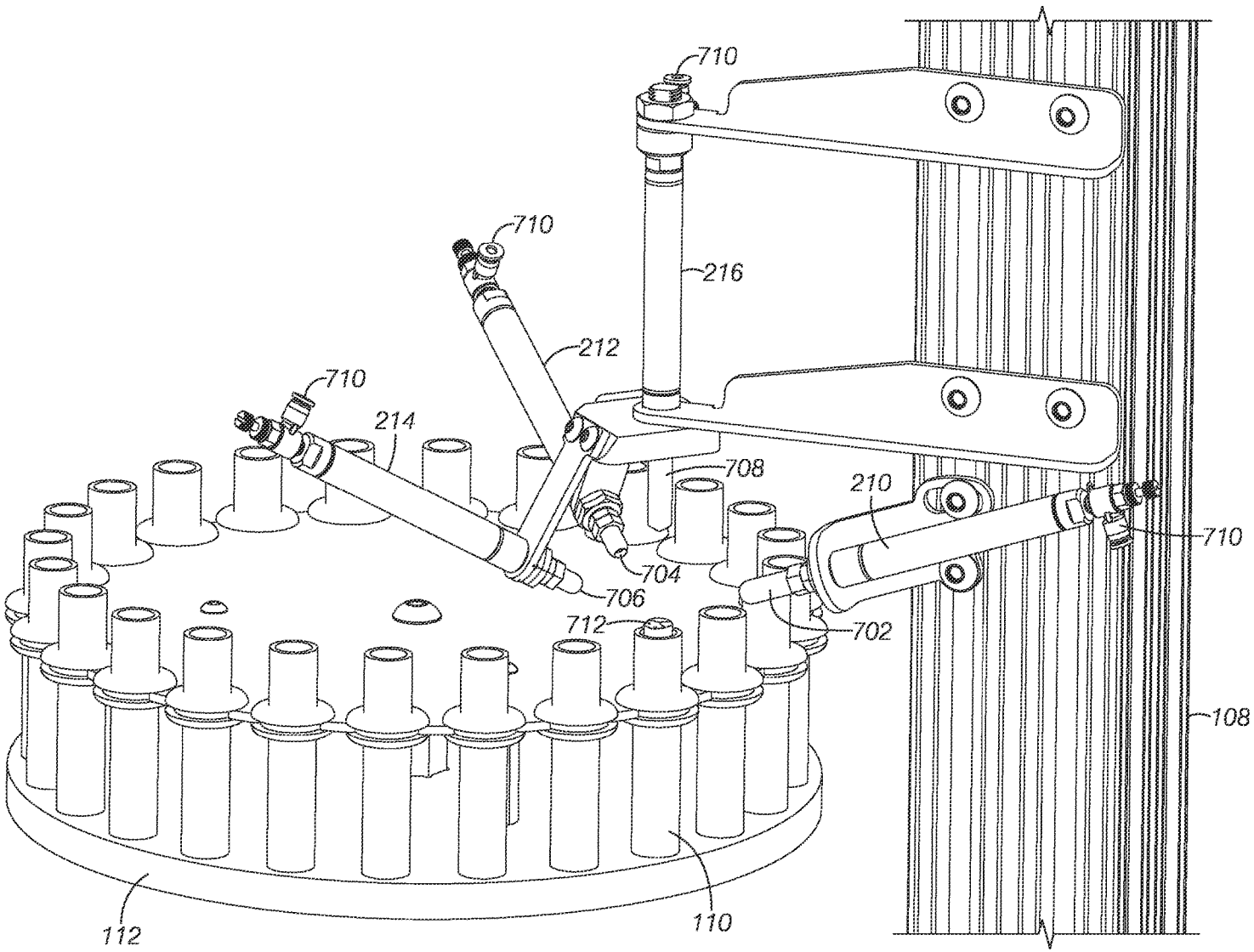
FIG. 7 is a perspective view of a cone top sealing system.

FIG. 7 is a perspective view of the cone top sealing system 104. The cone top sealing system 104 comprises a first cone top closing actuator 210, a second cone top closing actuator 212, a third cone top closing actuator 214, and a cone top sealing actuator 216. Each of the cone top closing actuators 210, 212, 214 are configured to fold down a portion of the top of a cone that has been filled with the smokable material. The cone top sealing actuator 216 is configured to tamp down and secure each folded portion of the top of the cone. The three cone top closing actuators 210, 212, 214 are oriented in a downward slanting position that is directed towards the filled cone that is to be closed and sealed. The cone top sealing actuator 216 is pointed downward and is located directly above the filled cone that is to be closed and sealed.

In a preferred embodiment, each of the cone top closing actuators 210, 212, 214 are pneumatic actuators that extend a closing head 702, 704, and 706, respectively, that sequentially engages and then pushes down a portion of the cone top down onto the top of the filled cone. The cone top sealing actuator 216 is a pneumatic actuator that extends a sealing head 708 downward onto the top of the filled cone that is being closed. Each of the actuators 210, 212, 214, 216 have an air inlet 710 that is coupled to an air line (not shown) that extends back to and that is coupled to an air compressor unit 204.

In a non-limiting example embodiment, the closing heads 702, 704, and 706 are shallow conical shaped heads. In some embodiments, an optional through hole (aperture) is bored or fabricated into the center of the closing head 702, 704, and 706 to facilitate attachment of the head to a shaft that is extended and retracted by the cone top closing actuators 210, 212, 214. Further, the rim edges of the hole improve the fold being made to the top of the cone that is being closed.

The sealing head 708 may be similarly shaped as the closing heads 702, 704, and 706. Alternatively, the sealing head 708 may be flat or substantially flat. Alternatively, or additionally, the sealing head 708 may include a small point or the like that improves the sealing of the folds made to the top of the cone that is being closed.

When the cone filler control system 114 actuates the solenoid 202 of a particular one of the air compressor units 204, that respective actuator 210, 212, 214, 216 extends its head down onto the filled cone that is to be closed. Here, the air compressor communicates pressurized air to its connected actuator 210, 212, 214, 216. The actuators 210, 212, 214, 216 are piston-like actuators, wherein the compressed air pushes the head outwardly from the actuator. A spring or other retaining device retracts the extended head after the head has completed its folding or tamping operation. Alternatively, or additionally, the air compressor unit may be actuated to generate a suction (negative air pressure) that retracts the head back into the actuator. In alternative embodiments, the actuators 210, 212, 214, 216 may be a hydraulic actuator and/or an electronic solenoid that is configured to extend and retract its respective head.

To conceptually disclose operation of the cone folding stage, a closed and sealed cone 712 is illustrated in the cone receptacle 110 of FIG. 7. Here, three folds are visible on the top of the closed and sealed cone 712. FIG. 7 further illustrates that the heads 702, 704, 706, and 708 are retracted into their respective actuator 210, 212, 214, 216.

The cone folding operation commences after the global start cycle is initiated by the cone filler control system 114. In an example embodiment, the global start cycle begins with a step-wise actuation of the carousel indexing motor 226 to advance the cone carousel 112 by one cone receptacle position. In the illustrated embodiment, the cone carousel 112 is rotated in a clockwise direction. (In other embodiments, the carousel indexing motor 226 is actuated after all stages have completed their respective tasks.)

Figure 8:
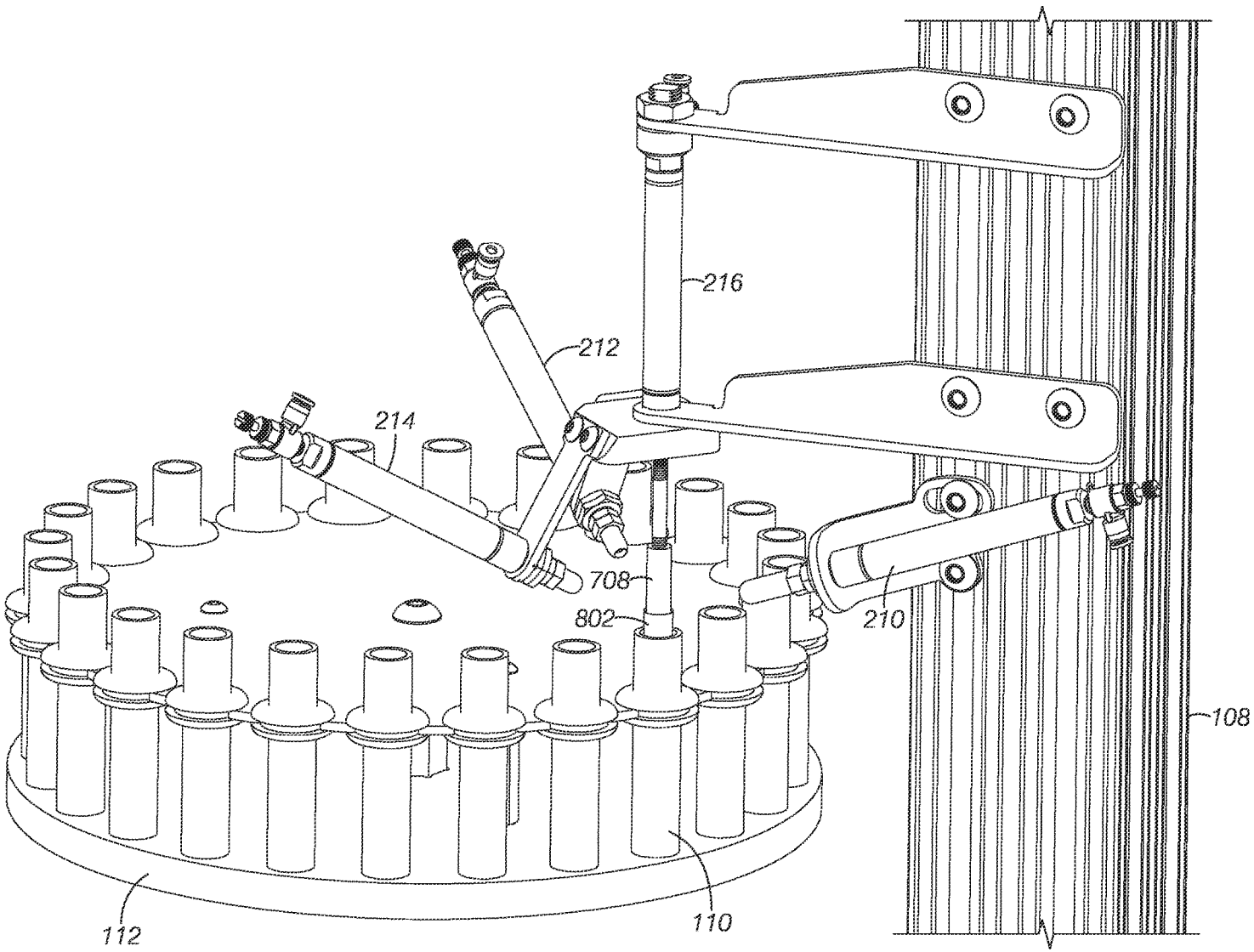
FIG. 8-11 illustrates exemplary steps in a cone closing operation.

FIG. 8 illustrates an example first step in a cone closing operation. To initiate the cone folding stage in a preferred embodiment, the cone filler control system 114 actuates one of the solenoids 202 to cause the corresponding air compressor unit 204 that is coupled to the cone top sealing actuator 216 to generate pressurized air that extends the cone sealing head 708 to move downward onto the top of the smokable material on the top of the cone that is to be closed. This optional first step packs down the smokable material into the cone that is to be closed. Here, the cone sealing head 708 is illustrated as being extended downward into the open top 802 of the open cone. The tamping process may be performed any desired number of times by the cone filler control system 114 by retracting the sealing head 708, and then again actuating the solenoid 202 to cause the cone sealing head 708 to again extend down onto the top of the smokable material. In embodiments that include the optional cone packer actuator 206, this tamping step may be omitted. The first tamping step concludes with a final retraction of the cone sealing head 708 into the cone top sealing actuator 216.

Figure 9:
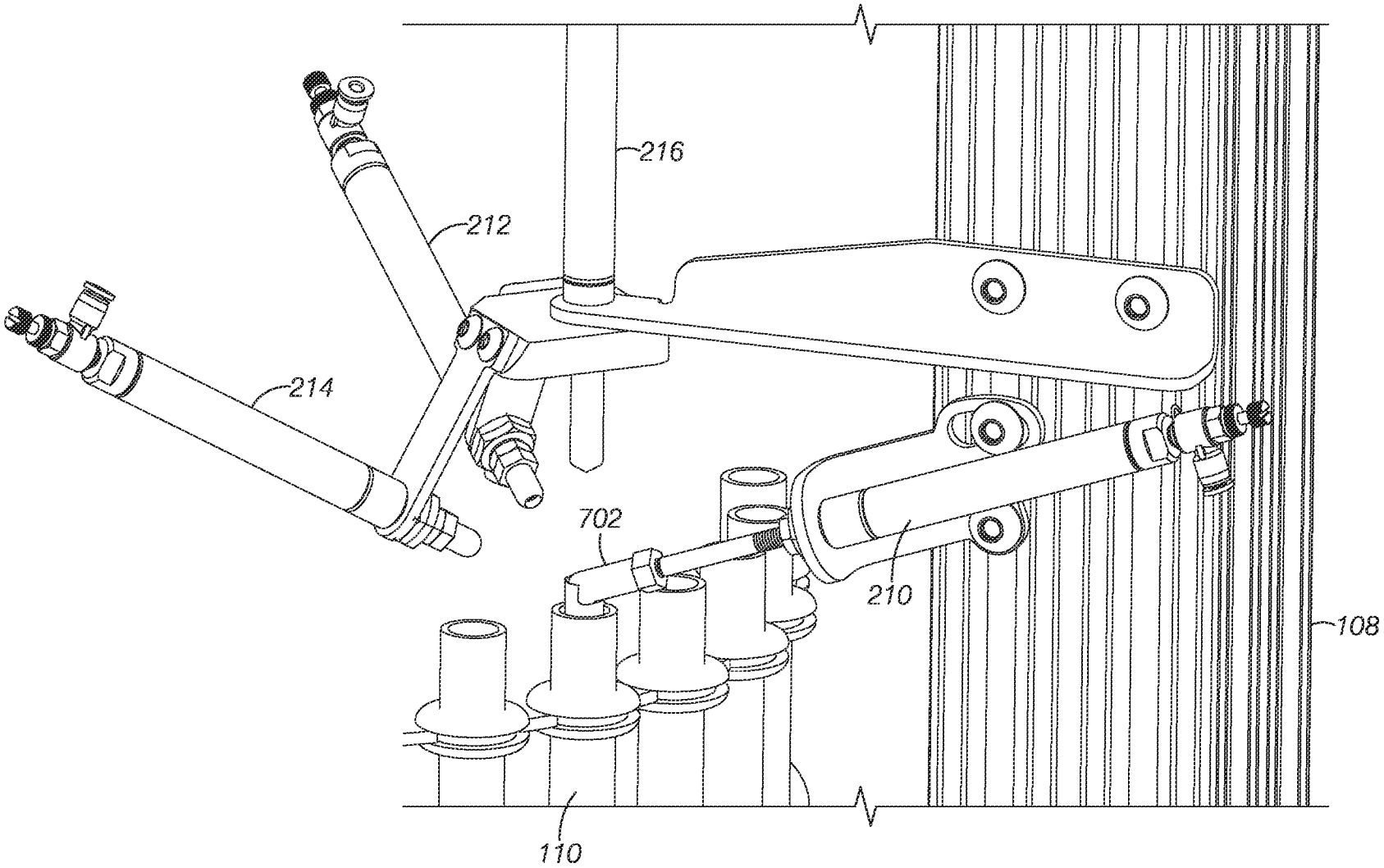

FIG. 9 illustrates second step in the clone closing operation. Here, the cone filler control system 114 actuates one of the solenoids 202 to cause the corresponding air compressor unit 204 that is coupled to the first cone top closing actuator 210 to generate pressurized air that extends the first cone closing head 702 to move downward onto the top 802 of the cone that is to be closed. The first cone closing head 702 pushes a first portion of the top 802 of the cone downward onto the top of the tamped smokable material as illustrated in FIG. 9. Some embodiments may optionally repeat the folding operation a plurality of times by retracting and then extending the first cone closing head 702 to ensure that a "good" first fold has been made to the cone top. The second step concludes with a final retraction of the first cone closing head 702 into the first cone top closing actuator 210.

Next, in a preferred embodiment, the cone filler control system 114 actuates the solenoid 202 coupled to the cone top sealing actuator 216 to cause the corresponding air compressor unit 204 to generate pressurized air that extends the cone sealing head 708 to move downward onto the first fold in the top 802 of the cone that is to be closed. Some embodiments may omit this step. This optional step secures the first fold down onto the top of the cone that is to be closed.

Figure 10:
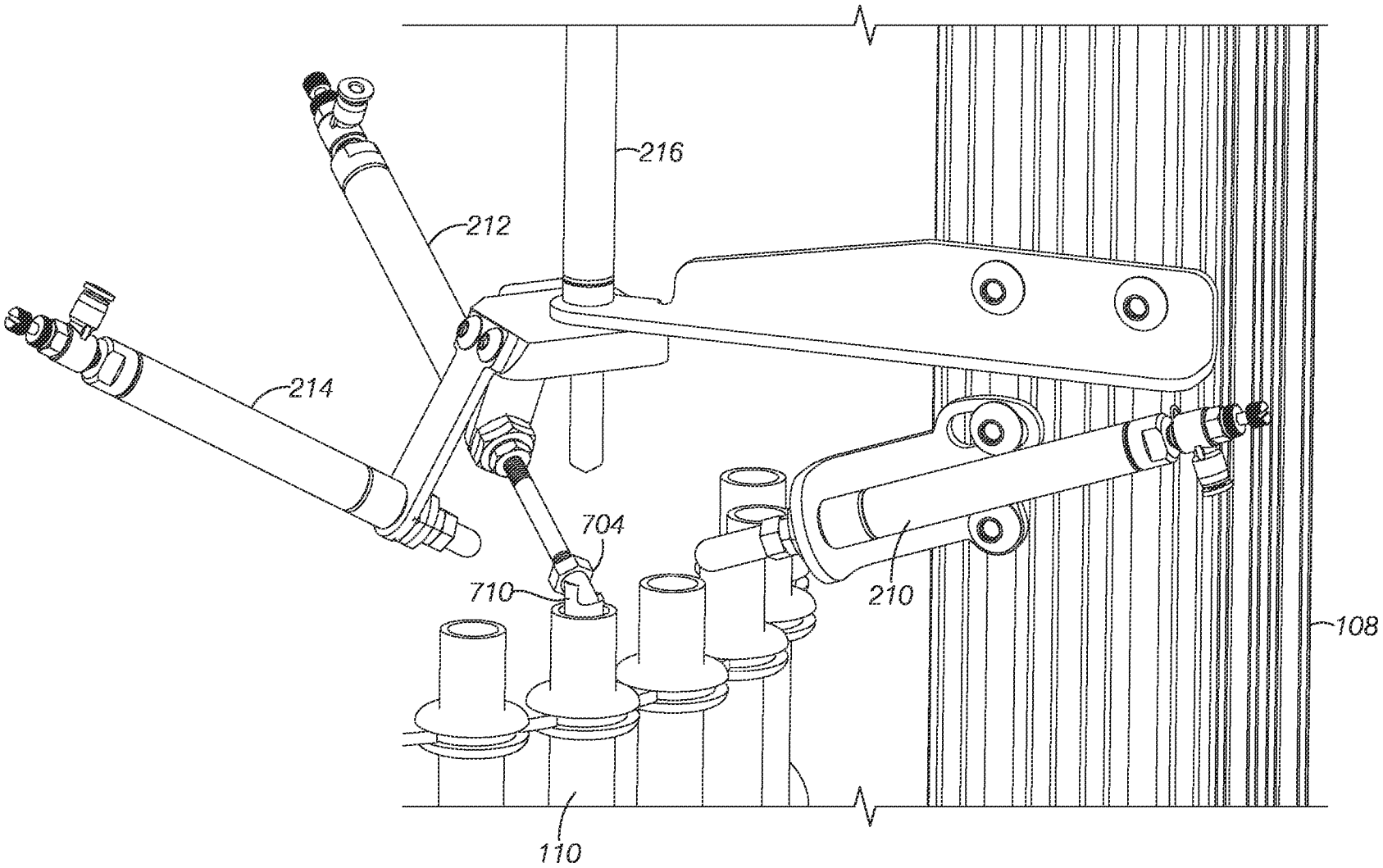

FIG. 10 illustrates a next step in the clone closing operation. Here, the cone filler control system 114 actuates one of the solenoids 202 to cause the corresponding air compressor unit 204 that is coupled to the second cone top closing actuator 212 to generate pressurized air that extends the second cone closing head 704 to move downward onto the top 802 of the cone that is to be closed. The second cone closing head 704 pushes a second portion of the top 802 of the cone downward onto the top of the tamped smokable material as illustrated in FIG. 10. Some embodiments may optionally repeat the folding operation a plurality of times by retracting and then extending the second cone closing head 704 to ensure that a "good" second fold has been made to the cone top. This step concludes with a final retraction of the second cone closing head 704 into the second cone top closing actuator 212.

Next, in a preferred embodiment, the cone filler control system 114 again actuates the solenoid 202 coupled to the cone top sealing actuator 216 to cause the corresponding air compressor unit 204 to generate pressurized air that extends the cone sealing head 708 to move downward onto the first fold and the second fold in top 802 of the cone that is to be closed. Some embodiments may omit this step. This optional step secures the first fold and the second fold down onto the top of the cone that is being closed.

Figure 11:
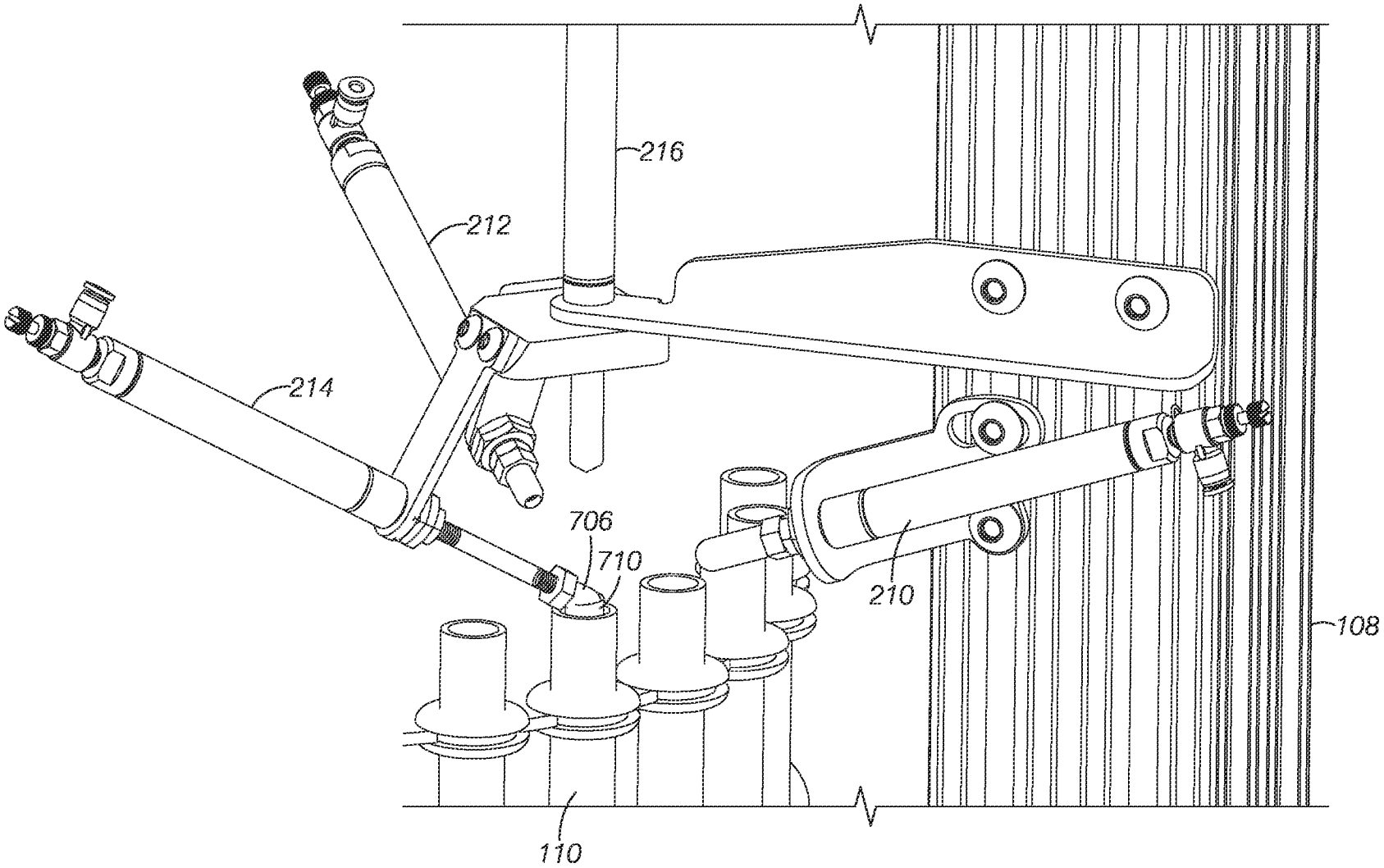

FIG. 11 illustrates a next step in the clone closing operation. Here, the cone filler control system 114 actuates one of the solenoids 202 to cause the corresponding air compressor unit 204 that is coupled to the third cone top closing actuator 214 to generate pressurized air that extends the third cone closing head 706 to move downward onto the top 802 of the cone that is to be closed. The third cone closing head 706 pushes a third and last portion of the top 802 of the cone downward onto the top of the tamped smokable material as illustrated in FIG. 11. Some embodiments may optionally repeat this folding operation a plurality of times by retracting and then extending the third cone closing head 706 to ensure that a "good" third fold has been made to the cone top. This step concludes with a final retraction of the third cone closing head 706 into the third cone top closing actuator 214.

Next, in a preferred embodiment, the cone filler control system 114 actuates the solenoid 202 coupled to the cone top sealing actuator 216 to cause the corresponding air compressor unit 204 to generate pressurized air that extends the cone sealing head 708 to move downward onto first, second, and third folds in the top 802 of the cone that is to be closed. Some embodiments may omit this step. This optional step secures the three folds down onto the top of the cone that is being closed.

At this juncture, after the cone top has been closed and sealed, the cone closing stage has been completed. Because the cone filler control system 114 is controlling the above-described cone closing steps, the cone filler control system 114 determines when the clone closing stage has been completed.

Figure 12:
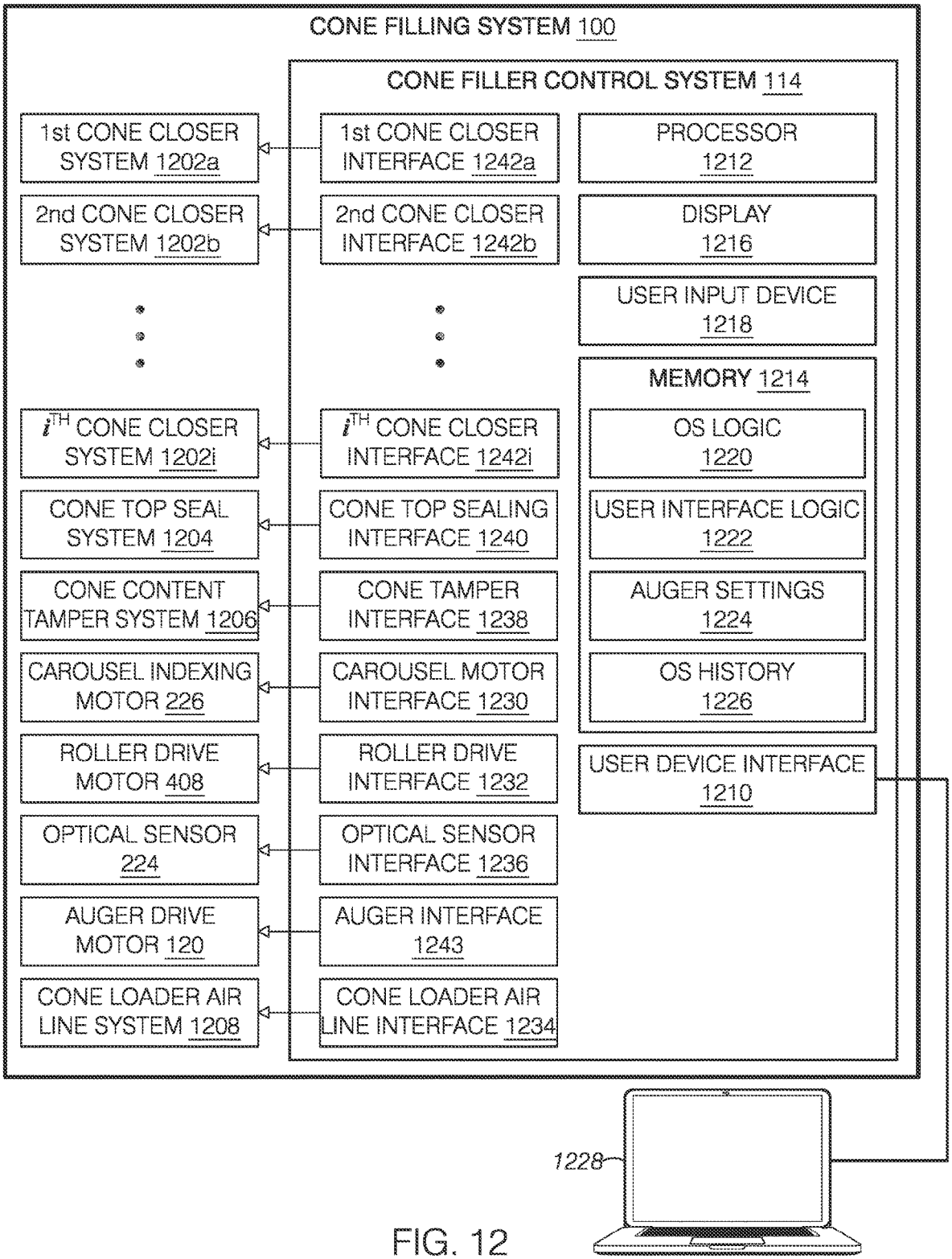
FIG. 12 is a block diagram of a cone filling system in accordance with one embodiment of the present invention.

FIG. 12 is a block diagram of an example embodiment of the cone filling system 100. The non-limiting exemplary cone filling system 100 comprises the cone filler control system 114, the auger drive motor 120, the roller drive motor 408, the optical sensor 224, a carousel indexing motor 226, a plurality of cone closer systems 1202*a*, 1202*b* and 1202*i*, a cone top seal system 1204, a cone content tamper system 1206, and a cone loader airline system 1208. The cone filler control system 114 comprises a user device interface 1210, a processor 1212, a memory 1214, an optional display 1216, a user input device 1218, and a plurality of interfaces (described hereinbelow). The memory 1214 comprises portions for storing the operating system (OS) logic 1220, the user interface logic 1222, the auger settings 1224, and the operating system (OS) history 1226. In some embodiments, the OS logic 1220 and the user interface logic 1222 may be integrated together, and/or may be integrated with other logic. In other embodiments, some or all of these memory and other data manipulation functions may be provided by using a remote server or other electronic devices suitably connected via the Internet or otherwise to a client device. Other cone filling systems 100 may include some, or may omit some, of the above-described media processing components. Further, additional components not described herein may be included in alternative embodiments.

In operation, the user provides setting information to the cone filler control system 114 by providing manual user input via the user input device 1218. The user input device 1218 may be a touch screen display (integrated into the display 1216), a keyboard device, and/or a plurality of controllers (buttons, switches, toggles, or the like). Alternatively, or additionally, the user may communicatively couple a computer, lap top, notebook, smart phone, or other electronic device 1228 to the cone filler control system 114 via the user device interface 1210 using a suitable wire-based or wireless connection.

The processor system, executing the user interface logic 1222, receives the user input and determines a plurality of user settings that control operation of the cone filling system 100. For example, the user may specify a particular amount of smokable material that is to be placed into each cone as the cone is being filled. The processor 1212 then determines how long the auger drive motor 120 is to be actuated so as to turn the auger 126 for some predefined duration. By turning the auger 126 by the determined duration, the rotating auger adds some corresponding amount of smokable material into a cone. Here, one skilled in the arts appreciates that rotation of the auger 126 for some per unit of time pushes a known amount of smokable material through the auger 126 and out of the lower end 128 of the cone 116. Other user commands may be similarly specified by the user. These determined user commands may be stored into the auger settings 1224 portion of memory 1214.

Based on the user setting information, the processor 1212, executing the OS logic 1220, can then begin the process of filling cones with smokable material. As described herein, the empty receptacles 110 of the cone carousel 112 are rotated in an incremental step-wise fashion from the cone loading stage to the cone filling stage, to the optional cone tamping stage, to the cone folding stage, and finally to the optional cone evacuation stage. Accordingly, for each stage increment, the processor 1212 retrieves specific information for loading cones, filing cones, tamping cones, folding cones, and evacuating cones from the memory 1214.

The process of loading cones is made in response to a user start command received at the user device interface 1210 or the user input device 1218. The processor 1212, executing the OS logic 1220 and the user interface logic 1222, initiates operation of the cone loading stage, the cone filling stage, the optional tamping stage, the cone closing stage, and the optional cone evacuation stage. This initiation process is referred to herein as the global start cycle since a plurality of states are concurrently initiated.

During a single operation cycle, the cone loading stage, the cone filling stage, the optional tamping stage, the cone closing stage and the optional cone evacuation stage are each concurrently performed until completion. When the operations being performed at all of the stages have been completed, a new global start cycle is initiated. Depending upon the embodiment, the cone carousel 112 may be incremented by one cone receptacle 110 position at the conclusion of the completion of all stages (prior to the next global start cycle). Alternatively, the cone carousel 112 may be incremented by one cone receptacle 110 position at the as a first step of the next global start cycle.

To index the cone carousel 112 by one cone receptacle position, the processor 1212 generates and communicates a control signal to the carousel motor interface 1230. In response to receiving the control signal, the carousel motor interface 1230 communicates a signal to the carousel indexing motor 226. In response thereto, the carousel indexing motor 226 rotates (indexes) the cone carousel 112 by one cone receptacle position. In an example embodiment, the carousel motor interface 1230 generates a step voltage signal for a predefined duration that operates the carousel indexing motor 226 for the predefined duration to index the cone carousel 112. Other embodiments may employ other motor controllers and signals to index the cone carousel 112. In embodiments where a pneumatic stepping actuator is used to index the cone carousel 112, a control signal is sent to a solenoid to actuate the indexing of the cone carousel 112.

In some embodiments, the cone carousel 112 is indexed one cone receptacle position in a clockwise direction such that a cone receptacle 110 passes sequentially through the cone loading stage, the optional tamping stage, the cone filling stage, the cone closing stage and the optional cone evacuation stage. In other embodiments, the cone carousel 112 rotates in a counter clockwise direction such that a cone receptacle 110 passes sequentially through the cone loading stage, the optional tamping stage, the cone filling stage, the cone closing stage and the optional cone evacuation stage.

During the cone loading stage performed by the cone dispenser system 102, the processor 1212 operates to generate an actuation signal that is communicated from the roller drive interface 1232 to the roller drive motor 408. Preferably, the signal is a step voltage signal that operates the roller drive motor 408 for a predefined period of time. Accordingly, the roller drive interface 1232 receives the actuation signal from the processor 1212, and then generates the step voltage function or the like that is communicated to the roller drive motor 408. As noted herein, the operation of the roller drive motor 408 transports an empty cone from the cone stack feed tube 404 into the cone chute 220.

After the empty cone has entered the cone chute 220, the roller drive motor 408 is deactivated such that the cone roller 218 becomes secured in a stationary position. Then, after some predefined duration, the cone filler control system 114 issues a control signal to the cone loader air line interface 1234. In response to receiving the control signal from the cone filler control system 114, the cone loader air line interface 1234 outputs a voltage and/or a current signal to the cone loader air line system 1208. The cone loader air line system 1208 comprises one of the solenoids 202, a corresponding air compressor unit 204, and the air line 412. The signal from the cone loader air line interface 1234 to the cone loader air line system 1208 causes the solenoid 202 to actuate, thereby causing the air compressor unit 204 to generate pressurized air that is communicated through the air line 412. A puff or stream of air or other gas then exits from the air nozzle 410 to push the empty cone downward through the cone chute 220. If multiple gas puffs are required, the cone filler control system 114 generates further control signals that are received by the cone loader air line interface 1234. If a plurality of air lines 412 are employed, then the cone filler control system 114 coordinates control signals to a plurality of cone loader air line interfaces 1234 that are each connected to a corresponding cone loader air line system 1208.

In response to receiving a signal at the optical sensor interface 1236 from the optical sensor 224 indicating that a cone has been loaded into the cone receptacle 110 that is located below the cone chute 220, the cone filler control system 114 determines that the cone loading stage is then complete. Here, the optical sensor interface 1236 converts the signal received from the optical sensor 224 into a control signal that is receivable by the processor 1212.

In embodiments that employ the optional cone packer actuator 206, the cone filler control system 114 initiates the tamping stage by generating and communicating a control signal to the cone tamper interface 1238. In response to receiving the control signal from the processor 1212, the cone tamper interface 1238 outputs a voltage and/or a current signal to the cone content tamper system 1206. The cone content tamper system 1206 comprises one of the solenoids 202, a corresponding air compressor unit 204, and the cone packer actuator 206. The signal from the cone tamper interface 1238 to the cone loader air line system 1208 causes the solenoid 202 to actuate, thereby causing the air compressor unit 204 to generate pressurized air that is communicated to the cone packer actuator 206. The compressed air extends the packing tool 208 downward onto the top of a filled cone, thereby tamping down the smokable material in the cone. If multiple tampings are required, the cone filler control system 114 generates further control signals that are received by the cone content tamper system 1206.

During the cone closing stage performed by the cone top sealing system 104, the processor 1212, executing the OS logic 1220, optionally operates to initially generate an actuation signal that is communicated from the processor 1212 to the cone top sealing interface (I) 1240. In response to receiving the control signal from the processor 1212, the cone top sealing interface 1240 outputs a voltage and/or a current signal to the cone top seal system 1204. In an example embodiment, the cone top seal system 1204 comprises one of the solenoids 202, a corresponding air compressor unit 204, and the cone top sealing actuator 216. The signal from the cone top sealing interface 1240 to the cone top seal system 1204 causes the solenoid 202 to actuate, thereby causing the air compressor unit 204 to generate pressurized air that is communicated to the cone top sealing actuator 216. The compressed air extends the sealing head 708 downward onto the top of a filled cone that is to be closed, thereby tamping down the smokable material in the cone. If multiple tampings are required, the cone filler control system 114 generates further control signals that are received by the cone top seal system 1204.

Next, the processor system generates and communicates a control signal to the first cone closer interface (I) 1242*a*. In response to receiving the control signal from the processor 1212, the first cone closer interface 1242*a* outputs a voltage and/or a current signal to the first cone closer system 1202*a*. In an example embodiment, the first cone closer system 1202*a* comprises one of the solenoids 202, a corresponding air compressor unit 204, and the first cone top closing actuator 210. The signal from the first cone closer interface 1242*a* to the first cone closer system 1202*a* causes the solenoid 202 to actuate, thereby causing the air compressor unit 204 to generate pressurized air that is communicated to the first cone top closing actuator 210. The compressed air extends the closing head 702 downward onto the top of a filled cone that is to be closed, thereby making the first fold in the top of cone. If multiple tampings are required, the cone filler control system 114 generates further control signals that are received by the first cone closer system 1202*a*.

Next, the processor 1212 may operate to generate another actuation signal that is communicated from the processor 1212 to the cone top sealing interface 1240. In response to receiving the control signal from the processor 1212, the cone top sealing interface 1240 outputs another voltage and/or a current signal to the cone top seal system 1204. Compressed air extends the sealing head 708 downward onto the top of a filled cone that is to be closed, thereby sealing the first fold. If multiple tampings are required to seal the first fold, the cone filler control system 114 generates further control signals that are received by the cone top seal system 1204.

Next, the processor system generates and communicates a control signal to the second cone closer interface (I) 1242*b*. In response to receiving the control signal from the processor 1212, the second cone closer interface 1242*b* outputs a voltage and/or a current signal to the second cone closer system 1202*b*. In an example embodiment, the second cone closer system 1202*b* comprises one of the solenoids 202, a corresponding air compressor unit 204, and the second cone top closing actuator 212. The signal from the second cone closer interface 1242*b* to the second cone closer system 1202*b* causes the solenoid 202 to actuate, thereby causing the air compressor unit 204 to generate pressurized air that is communicated to the second cone top closing actuator 212. The compressed air extends the closing head 704 downward onto the top of a filled cone that is to be closed and sealed, thereby making a second fold in the top of cone. If multiple tampings are required, the cone filler control system 114 generates further control signals that are received by the second cone closer system 1202*b*.

Next, the processor 1212 may again operate to generate an actuation signal that is communicated from the processor 1212 to the cone top sealing interface 1240. In response to receiving the control signal from the processor 1212, the cone top sealing interface 1240 outputs another voltage and/or a current signal to the cone top seal system 1204. Compressed air extends the sealing head 708 downward onto the top of a filled cone that is to be closed, thereby sealing the first and second folds. If multiple tampings are required to seal the first and second folds, the cone filler control system 114 generates further control signals that are received by the cone top seal system 1204.

Then, the processor system generates and communicates a control signal to the third example ($i^{th}$) cone closer interface (I) 1242*i*. In response to receiving the control signal from the processor 1212, the cone closer interface 1242*i* outputs a voltage and/or a current signal to the third cone closer system 1202*i*. In an example embodiment, the cone closer system 1202*i* comprises one of the solenoids 202, a corresponding air compressor unit 204, and the third cone top closing actuator 214. The signal from the cone closer interface 1242*i* to the third cone closer system 1202*i* causes the solenoid 202 to actuate, thereby causing the air compressor unit 204 to generate pressurized air that is communicated to the third cone top closing actuator 214. The compressed air extends the closing head 706 downward onto the top of a filled cone that is to be closed and sealed, thereby making the third fold in the top of cone. If multiple tampings are required, the cone filler control system 114 generates further control signals that are received by the cone closer system 1202*i*.

Finally, the processor 1212 may again operate to generate an actuation signal that is communicated from the processor 1212 to the cone top sealing interface 1240. In response to receiving the control signal from the processor 1212, the cone top sealing interface 1240 outputs another voltage and/or a current signal to the cone top seal system 1204. Compressed air extends the sealing head 708 downward onto the top of a filled cone that is to be closed, thereby sealing the first, second, and third folds. If multiple tampings are required to seal the first, second, and third folds, the cone filler control system 114 generates further control signals that are received by the cone top seal system 1204.

In other embodiments, two, or more than two, cone closer interfaces may be used to control operation of corresponding cone top closing actuators to create any desired number of folds on the top of a filled cone. For example, four cone top closing actuators may be used to close and seal the cone top in an alternative embodiment. Any suitable number of cone top closing actuators may be used in the various embodiments.

The user interface logic 1222, under the execution of the processor 1212, is configured to receive one or more user commands that are intended to control the amount of smokable material that is to be added into a cone during the cone filling stage. The amount of smokable material added into a cone is precisely controlled by controlling the duration of the rotational operation of the auger 126. In a preferred embodiment, the rotational speed of the auger is predefined and is precisely controlled by the auger drive motor 120. Accordingly, the amount of smokable material that is added from the auger 126 into a cone over a per unit of time (duration) is determinable. Accordingly, the amount of smokable material that is added into an empty cone is readily controllable as is appreciated in the arts. The cone filler control system 114 simply processes a user command defining the desired amount of smokable material that is to be added into an empty cone, and then computes the auger operation time duration (interchangeably referred to herein as the determined duration) for the auger 126. The processor 1212 communicates a control signal corresponding to the computed auger operation time duration to the auger interface 1243. The auger interface 1243, in an example embodiment, generates and communicates a voltage and/or current signal to the auger drive motor 120 for the computed auger operation time duration. At the end of the duration, the rotation of the auger 126 is halted, thereby preventing additional smokable material from being added into the now-filled cone. This cone filling process is performed one time after the start of each global start cycle.

In embodiments with a touch sensitive screen display 1216, the user may specify a desired amount of smokable material that is to be entered into an empty cone. Here, a user's touch of an active area on the touch sensitive screen corresponds to a user input. In response to sensing the user's touch on a particular active area on the touch sensitive screen display 1216, the touch sensitive screen display 1216 generates a user input signal that is communicated to the processor 1212, wherein the communicated user input signal corresponds to the intended user input.

Figure 13:
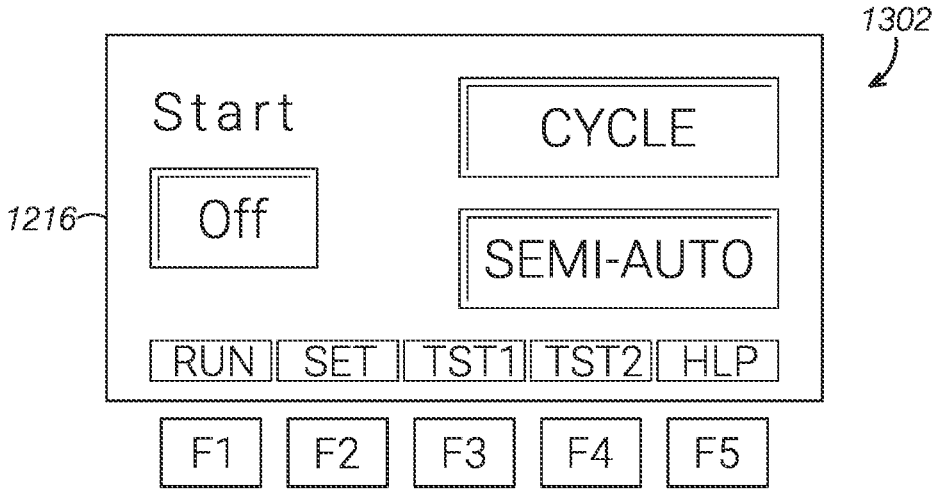
FIG. 13 is an example graphical user interface (GUI) that is presented on the display of an example embodiment of the cone filling system.

FIG. 13 is an example graphical user interface (GUI) 1302 that is presented on the display 1216 of an example embodiment of the cone filling system 100. A plurality of controllers F1-F5 residing on the surface of the cone filler control system 114 enclosure are also illustrated. In other embodiments, the GUI 1302, or a similar GUI, may be presented on the display of the electronic device 1228 (FIG. 12). The GUI 1302 is a conceptual non-limiting example of a GUI that may be presented to the user. Alternative embodiments may present another GUI with more information, or less information, or different information, to the user. The non-limiting GUI 1302 may be presented to the user before the user initiates the global start cycle to begin the filling and sealing of cones using the cone filling system 100. Alternatively, or additionally, one or more of the functions indicated on the example GUI 1302 may be implemented using a physical actuator, such as a button, switch, or the like. In alternative embodiments, any suitable text may be used to inform the user of the various operational states and/or settings in effect or that may be available for selection by the user.

The example GUI 1302 conceptually illustrates a presentation made to the user prior to the start of operation of the cone filling system 100. Accordingly, the highlighted "OFF" icon, an active area of the GUI 1302, indicates to the user that the cone filling system 100 is not operating (in an off state). Operation of the cone filling system 100 may be initiated if the user touches the "OFF" icon, wherein an "ON" icon may then be displayed to indicate that the cone filling system 100 is now in an operational state.

The user may select the "CYCLE" icon active area to initiate a single cycle that concurrently operates the cone loading stage, the cone filling stage, the optional tamping stage, the cone closing stage, and the optional cone evacuation stage. Here, the user may want to conduct one or more test cycles to verify that the cone filling system 100 is operating as intended.

The "SEMI-AUTO" icon active area indicates to the user that the cone filling system 100 is configured to operate on a semi-automatic basis wherein the cone filling system 100 operates through a complete cycle to load cones into the cone receptacles 110, fill empty cones with the smokable material, and then seal all of the cones of the cone carousel 112. Once all cones in the plurality of cone receptacles 110 in a cone carousel 112 have been filled and sealed, the process ends and the cone filling system 100 ceases operation.

Alternatively, the user may touch the presented "SEMI-AUTO" icon active area to toggle operation to continuous operation. Here, the presented icon would change to "FULL AUTO" active area or the like to indicate to the user that the cone filling system 100 is set to operate on a continuous basis. This mode of operation may be suitable when the cone filling system 100 performs a cone evacuation process to evacuate full and sealed cones from the cone carousel 112.

A plurality of relatively small hot buttons (touch sensitive active area icons) are presented along the bottom portion of the display 1216. When touched by the user, the hot buttons cause the cone filling system 100 to implement an associated function. The text presented on each of the hot buttons intuitively informs the user of the associated function that will be performed by the cone filling system 100 if actuated by the user. Any suitable text may be used to intuitively indicate a function to the user. In alternative embodiments, any suitable number of hot buttons may be presented on the display 1216 at any suitable location.

For example, if the user touches the "RUN" hot button, the global start cycle may be initiated. As another example, if the user touches the "SET" hot button, the screen display may be changed to a set up screen (see FIG. 14 or FIG. 15) that enables the user to control various settings of interest. As another example, the "TST 1" hot button may load an empty cone into a cone receptacle 110 to test operation of the cone loading stage or to fill an empty cone. The "TST 2" hot button may be configured to sequentially operate the actuators 210, 212, 214, 216 to test their operation to test the cone closing stage. The "HLP" hot button causes the display 1216 to present a help menu to assist the user in answering operating questions, resolving issues, or the like.

Conceptually illustrated below the display 1216 are a plurality of physical function buttons F1-F5. In an example embodiment, the function buttons control which particular GUI is presented on the display 1216. For example, actuation of the "F1" function button may cause the example GUI 1302 to be presented on the display 1216. Actuation of other ones of the function buttons F2-F5 may cause other GUIs to be presented to the user. In some embodiments, the function buttons F1-F5 may be presented on the display 1216 as hot buttons that can be selected by touching on the corresponding surface area of the display 1216.

Figure 14:
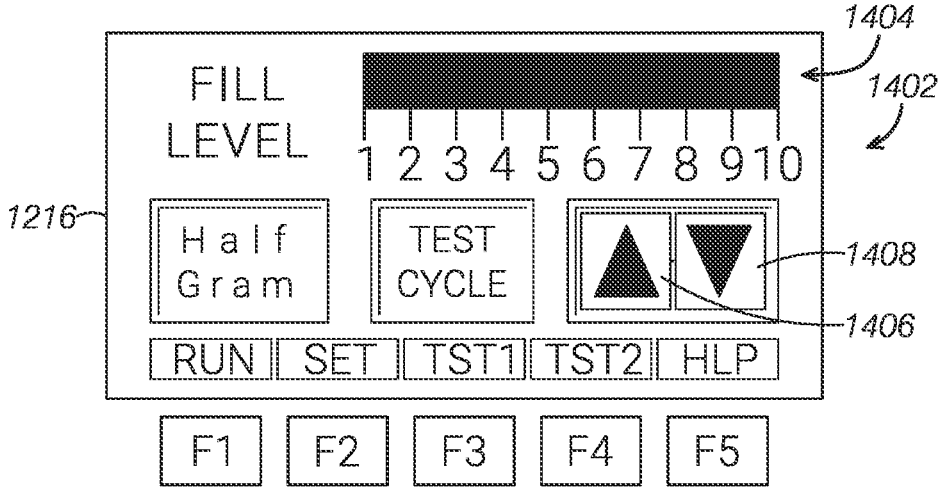
FIGS. 14-15 conceptually illustrate a presented GUI indicating a current user specified fill level or amount defining an amount of smokable material to be added in an empty cone during operation of a cone filling stage.

FIG. 14 conceptually illustrates a presented GUI 1402 indicating a current user specified fill level or amount defining an amount of smokable material that is to be added into an empty cone during operation of the cone filling stage. Here, a fill level bar 1404 indicates a plurality of fill levels ranging from a fill level of one (1) to a fill level of ten (10). The user intuitively understands that with the indicated fill level of 1, the empty cone will be partially filled during the cone filling stage. The user appreciates that each numerical increment on the fill level bar 1404 corresponds to an incremental amount of smokable material that will be added into an empty cone.

The user further appreciates that touching the hot button 1406 indicating the upward pointing arrowhead is an active area that will incrementally increase the fill level by some predefined amount. In an example embodiment, when the user touches the second active area indicating the incremental increase in the user specified amount of smokable material, the user intuitively understands that the amount of dispensed smokable material will be increased. To increase the amount of dispensed smokable material, the cone filler control system 114 increases the determined duration by an incremental duration to that a new determined duration is 6,500 milliseconds plus the incremental duration of 50 milliseconds. When the auger drive motor 120 operates to rotate the auger 126 for the new determined duration of 6,500 milliseconds plus the incremental duration of 50 milliseconds in response to the control signal, the helical screw blade of the auger 126 rotates to dispense more than the gram of smokable material out from the lower portion 128 of the hopper 116 into the empty cone. Any suitable increasing incremental duration may be used in alternative embodiments.

Similarly, touching the hot button 1408 indicating the downward point arrow will incrementally decrease the fill level by some predefined amount. In an example embodiment, when the user touches the second active area indicating the incremental decrease in the user specified amount of smokable material, the determined duration is decreased by an incremental duration to that a new determined duration is 6,500 milliseconds minus the incremental duration of 50 milliseconds. When the auger drive motor 120 operates to rotate the auger 126 for the determined duration of 6,500 milliseconds minus the incremental duration of 50 milliseconds in response to the control signal. The helical screw blade of the auger 126 rotates to dispenses less than the gram of smokable material out from the lower portion 128 of the hopper 116 into the empty cone. Any suitable decreasing incremental duration may be used in alternative embodiments.

In alternative embodiments, the user may be able to select one of a plurality of specified base amounts of smokable material. For example, the user may be able to select from a half gram, three quarters of a gram, a full gram, etc. Any suitable number of selectable amount choices and/or amount values may be provide to the user.

In an example embodiment, the user may be able to specify the amount values to the cone filler control system 114 to define the amount of smokable material that is to be put into an empty cone. Alternatively, or additionally, the user may be able to define the increasing or decreasing incremental durations and/or the associated incremental amounts of smokable material. The user may use the touch sensitive display screen 128 or another electronic device 1228 to specify these values, incremental durations and/or amounts prior to operation of the cone filling system 100.

Figure 15:
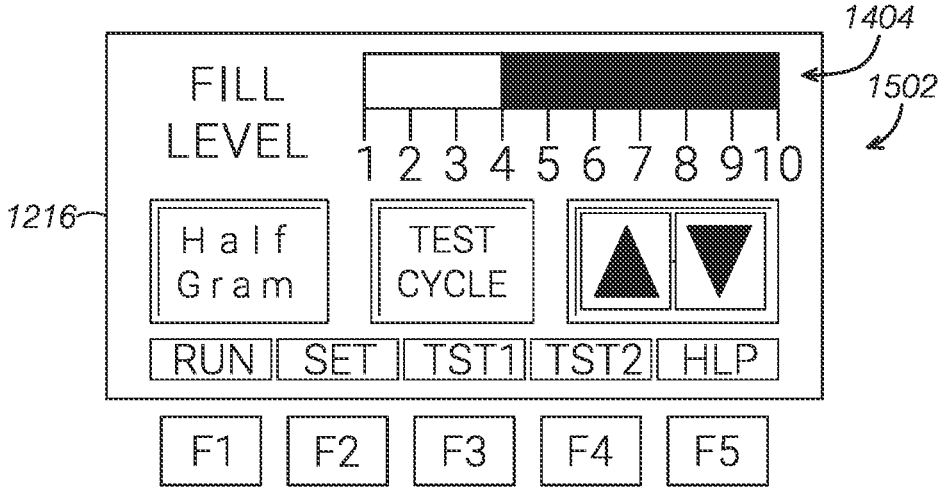

FIG. 15 conceptually illustrates a presented GUI 1502 indicating a current user specified fill level 1405 of four (4). The fill level of four defines an amount of smokable material that is to be added into an empty cone during operation of the cone filling stage. Here, one skilled in the art appreciates that the user has touched the hot button 1406 three times to increment the fill level from one (1) as illustrated in FIG. 14 to four (4) as illustrated in FIG. 15.

The "HALF GRAM" hot button, interchangeably referred to herein as an active area that is presented at a predefined portion of a touch sensitive screed display, indicates to the user that the incremental adjustment amounts are based on a half gram of smokable material. If the user touches the half gram hot button, the presentation transitions to a "FULL GRAM" hot button on the display 1216. Here, the user appreciates that that the incremental adjustment amounts are based on a full gram of smokable material.

The "TEST CYCLE" hot button initiates a test cycle wherein an empty cone is filled in accordance with the current fill setting indicated on the GUI 1402 or 1502. Accordingly, the user may touch the test cycle hot button, and a cone will be filled and sealed in accordance with the current fill settings. If the test filling of a cone was satisfactory, the user can initiate a full production run wherein a plurality of cones are filled and sealed in accordance with the current fill settings. If the test cone is not filled as desired, the user can revise the current fill settings, and then conduct another test cycle.

Figure 16:
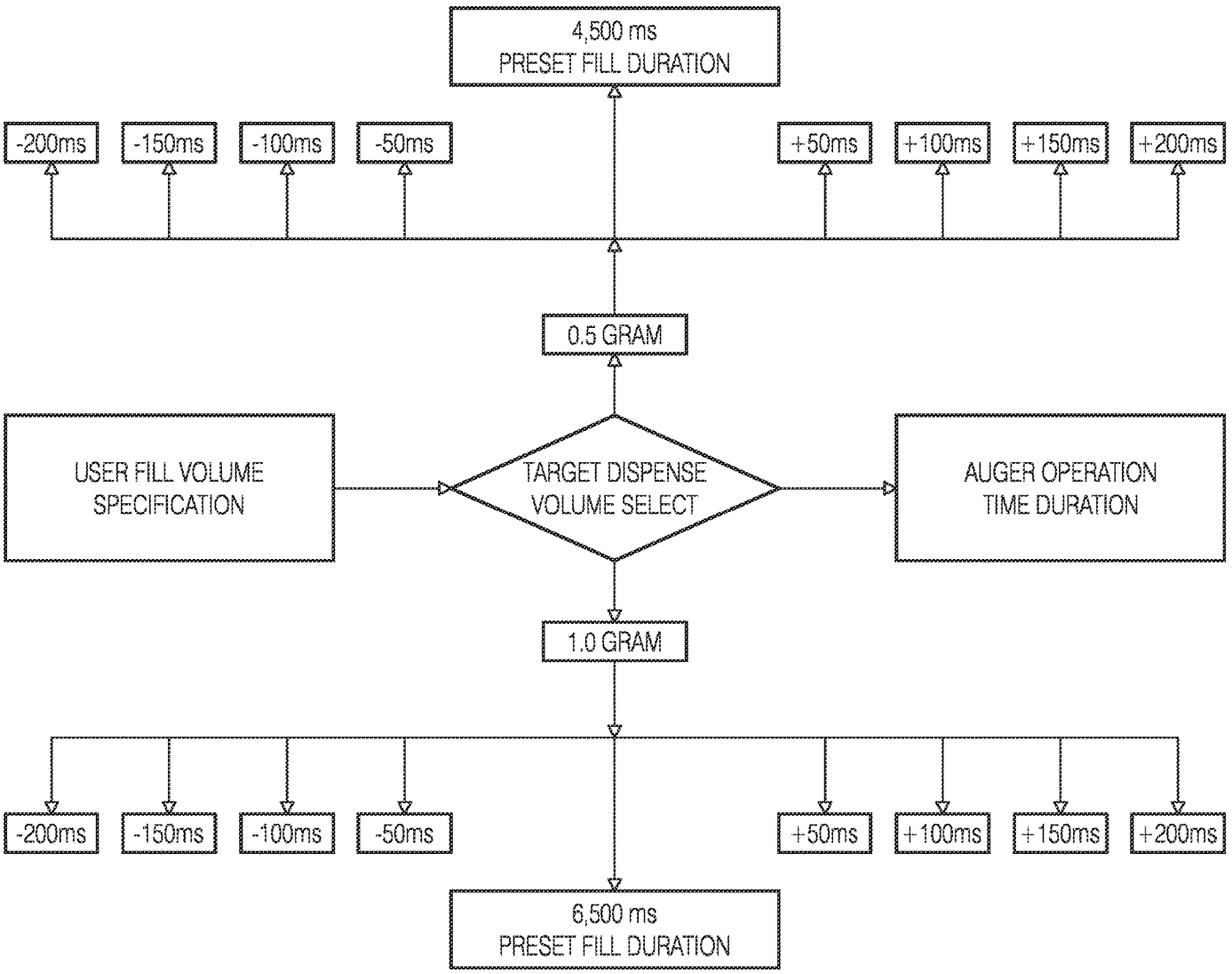
FIG. 16 conceptually illustrates the relationship between a target dispense volume specified by a user and an auger operation time duration calculations.

FIG. 16 conceptually illustrates the relationship between a target dispense volume specified by a user and the auger operation time duration calculations performed by the processor 1212 (FIG. 12) executing the OS logic 1220. The auger operation time duration is the time period that the auger 126 is rotated to dispense the smokable material from the hopper 116. The auger operation time duration calculation is based on a specified user target dispense volume. The computed auger time duration calculation is preferably saved in the auger settings 1224 portion of memory 1214 (FIG. 12). Thus, as each global start cycle is initiated by the cone filler control system 114, the current auger time duration may be retrieved for each cone filling stage operation as the cone carousel 112 is indexed by one cone receptacle 110.

As conceptually indicated in FIG. 16, the user may specify an initial fill level of a half gram (0.5 gram) or a full gram (1.0 gram) from the GUI 1402 (FIG. 14) or GUI 1502 (FIG. 5). The user input specifies an amount of the smokable material that is to be dispensed into an empty cone. Preferably, the specified amount is specified as a weight of the smokable material.

In a preferred embodiment, the user may specify either a half gram or a full gram as a base value for the specified amount of smokable material. If the full gram amount is specified by the user, the cone filler control system 114 determines that the auger operation time duration is to be set to 6,500 milliseconds (ms). If the half gram amount is specified by the user, the cone filler control system 114 determines that the auger operation time duration is to be set to 4,500 milliseconds (ms). These durations are determined and predefined based on the known amount of smokable material that is dispensed from the rotation auger 126 to dispense a half gram or a full gram of smokable material into an empty cone during the cone filling stage.

Because physical characteristics of the smokable material may vary, the actual amount of dispensed smokable material for any particular auger operation time determinable duration may vary. Accordingly, the user may actuate the example "TST 1" hot button (FIG. 13) to test fill an empty cone. Upon inspection of the filled test cone, the user may wish to add more or to add less smokable material in to an empty cone.

Accordingly, the user may adjust the fill level touching the hot button 1406 to incrementally increase the amount of smokable material that is dispensed into an empty cone. In an example embodiment, a user selection of one increase increment in the specified amount causes the cone filler control system 114 to determine a new predefined duration that increases the auger operation time duration by fifty ms (+50 ms). Each additional increment in the user specified amount causes the cone filler control system 114 to determine a new predefined duration that increases the auger operation time duration by an additional 50 ms.

Conversely, the user may adjust the fill level touching the hot button 1408 to incrementally decrease the amount of smokable material that is dispensed into an empty cone. In an example embodiment, a user selection of one decrease increment decreases the auger operation time duration by fifty ms (−50 ms). Each additional increment decreases the auger operation time duration by an additional 50 ms. For example, FIG. 15 illustrates a setting level of 4, and illustrates a half gram setting. Here, the adjustment made to the 4,500 ms auger operation time duration is −50 ms to correspond with the setting 4 shown on the GUI 1502.

The current auger operation time duration, after testing so that the user is satisfied with the amount of smokable material that is added into an empty cone, may then be accepted by the user as the current cone fill setting. Here, the determined auger operation time duration is stored into the auger setting 1224 portion of memory 1214.

The control logic that is used to adjust the auger operation time duration based on user specifications is managed by the user interface logic 1222 in an example embodiment. Any suitable base value auger operation time duration for a half gram setting and/or a full gram setting may be specified by a user. Further, any suitable auger operation time duration increment can be specified by a user. That is, the example 4,500 ms auger operation time duration base setting for a half gram, the 6,500 ms auger operation time duration base setting, and the amount of time for an incremental adjustment may be specified by the user, preferably during an initial set up of the cone filling system 100.

Figure 17:
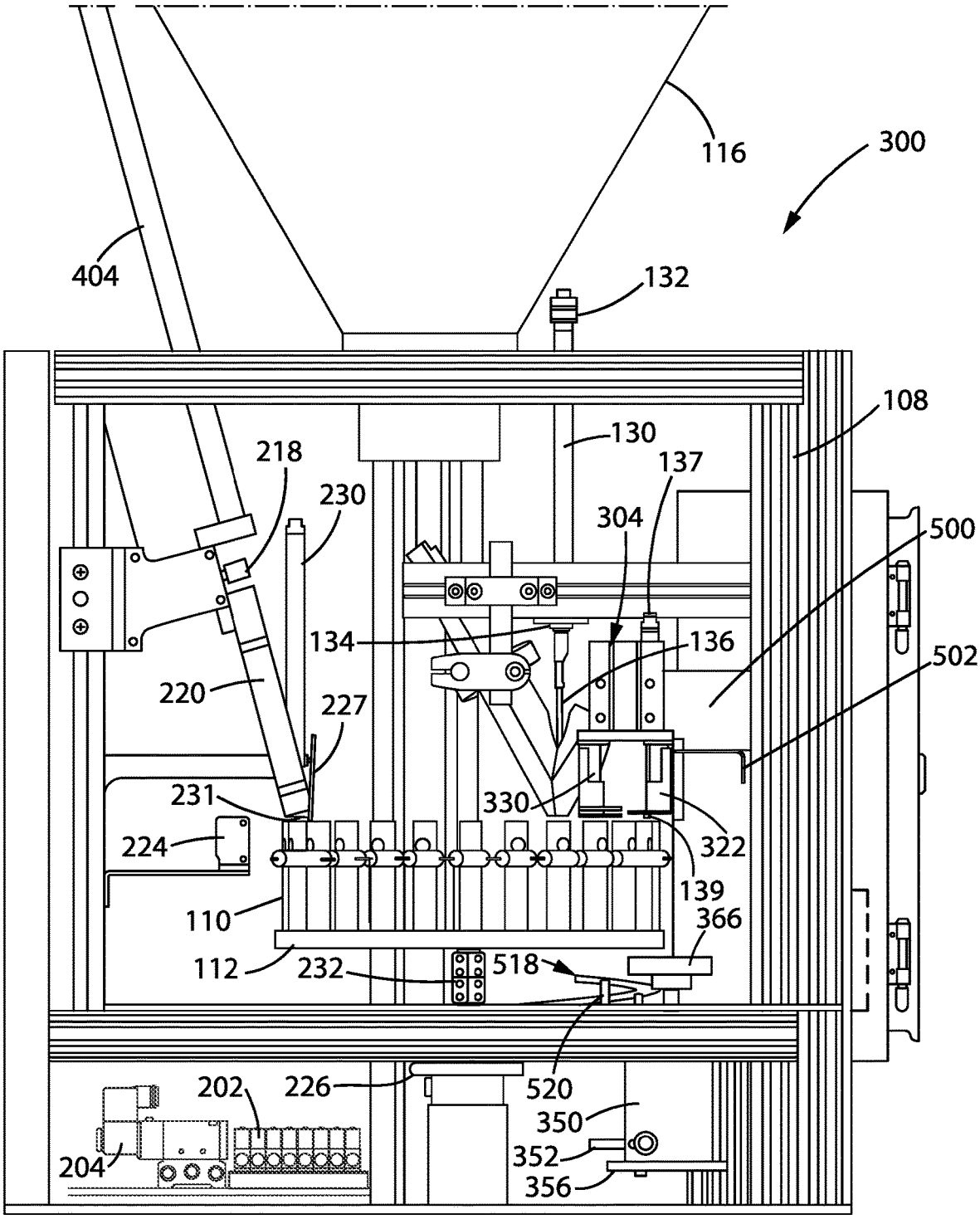
FIG. 17 is a side view of a cone filling system in accordance with an alternative embodiment of the present invention.
Figure 28:
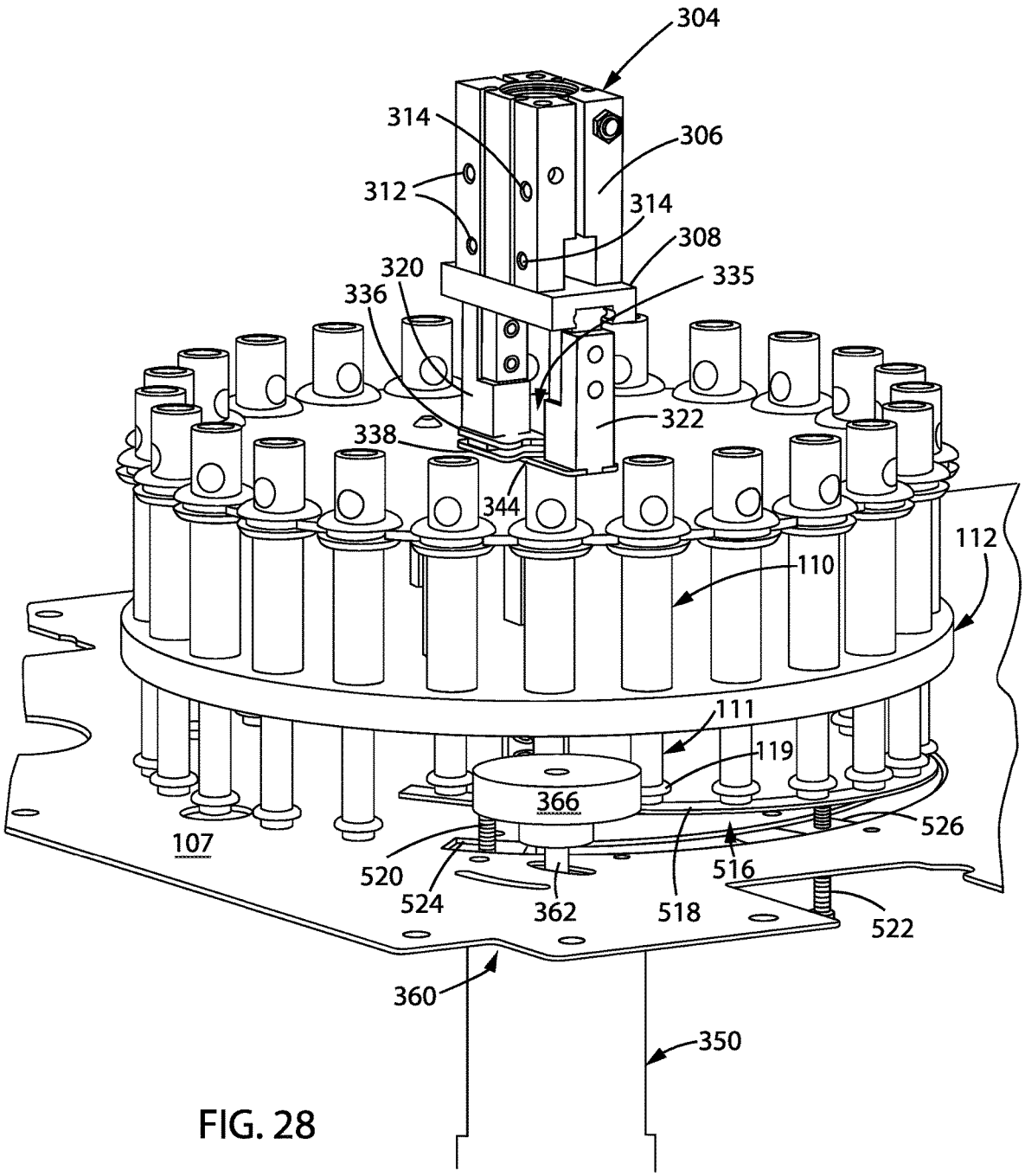
FIG. 28 is a perspective view of the cone sealing system including a cone ramp system for positioning the top opening of a filled cone within the cone receiving area of the gripper actuator, and engaging the ring insert of the cone insert with the drive wheel of the motor for readily rotating the filled cone.
Figure 33:
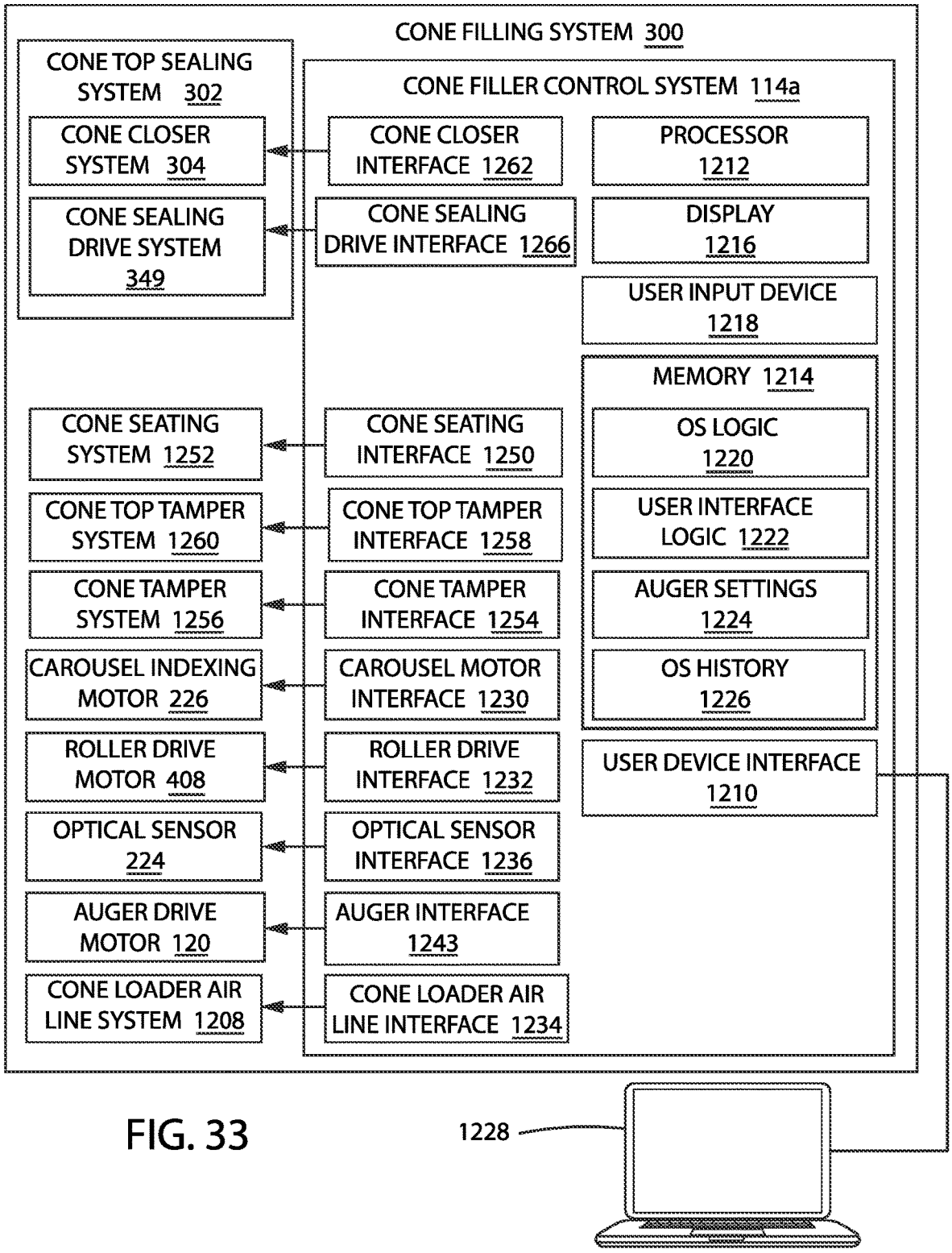
FIG. 33 is a block diagram of a cone filling system including a cone filler control system in accordance with another embodiment of the present invention.

Turning now to FIG. 17 there is shown a side view of a cone filling system 300 in accordance with an alternative embodiment of the present invention. Cone filling system 300 comprises equivalent functional components and systems of the cone filing system 100 with the exception of an alternative cone top sealing system 302 replacing cone top sealing system 104, modifications made to the cone filler control system 114*a*, as shown in FIG. 33, the addition of a cone seating actuator 230, a secondary tamper actuator 137, and a cone ramp system 518, as shown in FIG. 28. Cone filling system 300 includes a cone dispenser system 102, an auger load system 106 secured on a frame 108, a cone filler control system 114*a*, a cone top sealing system 302, and other equivalent components as represented by like numbers of the cone filling system 100. The cone filling system 300 comprises a hopper 116 configured to receive an amount of smokable material. In response to a global start cycle generated by the cone filler control system 114*a*, a plurality of operations are concurrently performed. A cone loading stage performs a first operation, interchangeably referred to herein as a cone dispensing operation, to dispense a single empty cone into an empty first cone receptacle 110 by the cone dispenser system 102. A cone filling stage performs a second operation, interchangeably referred to herein as a cone filling operation, for adding a predefined amount of smokable material into an empty cone disposed in a second one of the cone receptacles 110 of the cone carousel 112. In one embodiment, a third operation referred to as a cone tamping stage is employed to tamp smokable material deposited within an empty cone during the cone filling stage. A cone top sealing stage performs a fourth operation where the cone top sealing system 302 closes the open top of the filled cone or cone filled with smokable material therein, while rotating the filled cone to seal and twist the cone top forming a "wick" at the end of the filled cone. An optional cone evacuation stage performs an optional fifth operation, interchangeably referred to herein as a cone evacuation operation, wherein a sealed cone is removed from a fourth one of the cone receptacles 110. At the conclusion of these operations, the cone filler control system 114*a* generates a carousel indexing signal that indexes the cone carousel 112 by one position. That is, the cone carousel 112 is rotated by one cone receptacle position such that each one of the cone receptacles 110 are rotated in a sequential or serial fashion through the cone loading stage, the cone filling stage, the cone tamping stage, the cone sealing stage, and the optional cone evacuation stage.

For purposes of illustration, the term "cone top" as used herein, refers to a cylindrical portion of a filled cone that extends above a smokable material level in a cone, where the cylindrical portion of the filled cone is void of smokable material. Also, the term, "filled cone" as used herein, refers to a cone that is filled with a smokable material at or below a predetermined material level within the cone.

Figure 25:
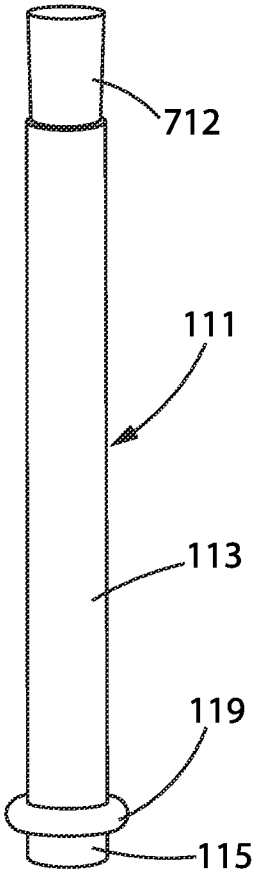
FIGS. 24 and 25 is a front, and a front perspective view, respectively, of a cone insert including a cylindrical body, an interior with an opening, and a groove formed at a lower end of the cylindrical body for receiving an insert ring adapted to releasably engage the drive wheel of the motor.

As illustrated in FIG. 17, a cone seating stage includes a cone seating actuator 230 including a seating actuator arm 231 for securely seating empty cones within cone inserts 111 deposed in cone receptacles 110. The cone seating actuator 230 is mounted to a frame member, via a mounting bracket, and strategically positioned after the cone dispensing stage but prior to the cone filling stage. In a preferred embodiment, a plurality of electronically driven solenoids denoted at 202, are communicatively coupled to the cone filler control system 114*a* using a suitable wire connector and/or a wireless connection (not shown). When one or more solenoids 202 are actuated by a control signal generated by the cone filler control system 114*a*, one or more of the actuated solenoids 202 move a piston (not shown) in an air compressor unit 204 to deliver air to the cone seating actuator 230 for extending a seating actuator arm 231 within an empty cone capturing the empty cone within a designated cone insert 111 (See FIGS. 24-27). It is understood that air compressor unit 204 may reside within the structure of the cone filling system 300, or alternatively comprise a compressor or compressor source that is retained a distance away from the cone filling system 300. Seating actuator arm 231 includes a seating head having a geometry including for example a conical shape adapted for contacting the closed bottom or filter of an empty cone. As the seating actuator arm 231 extends downwards within the empty cone, the seating head pushes the empty cone within the cone insert 111 where a portion of the cylindrical body of the empty cone enters a hollow, taper lock area 123 formed within the cone insert 111, as better illustrated in FIG. 27. The cone seating actuator 230 also sets the height of the empty cone relative to the cone insert 111 and ensures that the top, and interior of the empty cone are readily open to receive smokable material therein. As an empty cone is secured within a cone receptacle 111, a cone top of the empty cone extends upwards from the cone insert 111 a predefined height, as illustrated in FIG. 25. The cone seating actuator 230 may comprise a pneumatic or hydraulic cylinder, or an electrical linear actuator, and may be operated or cycled any number of times for extending the seating actuator arm 231.

After completing the cone filling cycle in which a predetermined amount of smokable material is deposited within a seated, empty cone, and after completing all other concurrent stages, cone carousel 112 is indexed, via the cone filler control system 114*a* (See FIG. 33), to position a filled cone within a first and second area of a cone tamping stage. The first area of the cone tamping stage includes a primary cone tamper system, and the second area of the cone tamping stage includes a secondary cone top tamper system for tamping or compressing smokable material deposited within a cone after the cone filling stage. The primary cone tamper system includes a primary cone tamper actuator 130, an actuator adjuster 132, a first actuator mounting bracket 134, a primary actuator arm 136 having a narrow tamper head located at the distal end of the actuator arm, one or more solenoids 202 and a compressor source 204. The primary cone tamper actuator 130 is mechanically affixed to a frame member via, a first mounting bracket 134 including for example, fasteners, brackets, nuts, or any combination thereof. The narrow tamper head may comprise any geometry including for example, a narrow, an annular, a flat, a cone, a rounded, or a convex head. The narrow tamper head of the primary actuator arm 136 is configured to extend deep within the filled cone to tamper the smokable material downwards to the lower to mid-section area of the cone. The cone filler control system 114*a* communicates with one or more solenoids 202 to activate the air compressor 204 and deliver air to a first air inlet of the primary tamper actuator 130 for operatively extracting and extending the primary actuator arm 136 within the filled cone. Actuator adjuster 132 is employed to increase or decrease the stroke length of primary actuator arm 136 thereby increasing or decreasing the distance the primary actuator arm 132 extends within the filled cone. The actuator adjuster 132 is beneficial when using smokable material of different densities during the cone packaging process. Primary cone tamper actuator 130 may be activated any number of times to assure the smokable material is adequately compacted within the cone.

When a cone filled with smokable material has been tamped by the primary tamper actuator 130, the filled cone is subsequently introduced to the second area of the cone tamping stage which includes a secondary cone top tamper system. The secondary cone tamper system includes a secondary cone tamper actuator 137, a second actuator mounting bracket 502, a secondary actuator arm 139 having a broad tamper head located at the distal end of the secondary actuator arm 139, one or more solenoids 202, and compressor 204. The secondary cone tamper actuator 137 is operated by one or more solenoids 202, the compressor source 204, and the cone filler control system 114*a*. The secondary actuator arm 139 is used for tamping any remaining, loose smokable material deposited within the filled cone, and for setting the desired material level of smokable material within the cone. The broad tamper head comprises a requisite geometry for effectively pressing down on, and tamping any remaining, loose smokable material deposited in the cone. It is appreciated that the primary tamper actuator arm 136 has a narrow tamper head while the secondary actuator arm 139 includes a broad tamper head. The narrow tamper head is used to tamp or compress smokable material towards the lower to mid-section area of the cone allowing a narrow tamper head to reach deeper within the cone, while the broad tamper head is used to tamp or compress smokable material from the mid-section to upper area of the filled cone reaching less into the filled cone. Because the mid-section to upper area of the filled cone is generally larger in diameter, a broader tamper head is more effective in tamping the remaining smokable material. The secondary cone tamper actuator 137 is mechanically affixed to frame member 108 via, a second mounting bracket 502 using fasteners, brackets, nuts, or any combination thereof. The second mounting bracket 502 is configured to finely adjust the secondary cone tamper actuator 137 in any vertical and/or horizontal position. It is understood that both the primary and secondary cone tamper actuator 130, 137 may comprise a pneumatic actuator, a hydraulic actuator, an electrical linear actuator, or any combination thereof. The secondary cone tamper actuator 137 may also include an adjuster to increase or decrease the stroke length of the secondary actuator arm 139 when extending within a filled cone, and may be operated any number of times to fully compact the smokable material and set and define a fill level within the filled cone.

Upon filling a cone with a smokable material, and initiating both the primary and secondary cone tamper actuators 130, 137, the cone filler control system 114*a* generates a signal to index cone carousel 112 where the cone filled with smokable material enters a cone closing stage. The cone closing stage employs a cone top sealing system 302 for closing and sealing smokable material within the cones, as better illustrated in FIGS. 18 and 19. The cone top sealing system 302 includes a cone closer system including a gripper actuator 304 having a gripper body 306 of a generally square or rectangular shape mounted to a horizontal gripper base 308, and a gripper assembly 309. Gripper assembly 309 includes parallel gripper arms 320, 322 that move towards and away from each other along a track 305 provided in gripper base 308. Gripper actuator elements (not shown) used to operate the parallel gripper arms 320, 322 are housed within a cavity of the gripper block 306 and retained therein via, closure cap 310. In one embodiment, the gripper actuator elements are controlled pneumatically via, the cone filler control system 114*a* which generates a signal to one or more solenoids 202 for activating the air compressor 204 and delivering air to an air inlet 303, via a delivery hose (not shown). An air exhaust port 311 is provided to exhaust air out from the gripper actuator 304. It is noted that the gripper actuator elements may comprise mechanical or electrical components that are operated by a hydraulic, pneumatic, or an electrical system.

A plurality of threaded bores 312, 314 are provided within the gripper body 306 to adjustably mount the gripper actuator 304 to a mounting bracket 500 via, fasteners. Any number of threaded bores, each comprising the same or different diameter and/or depth, may be strategically located anywhere within the gripper body 306 to permit adjusting the gripper actuator 304 in a vertical and/or horizontal position within the cone sealing area of the cone filling system 300.

As illustrated in FIGS. 17 through 20, gripper assembly 309 includes parallel gripper legs 316, 318 each extending downwards from the gripper base 308, and capable of oscillating back and forth within track 305 by mechanical gripper elements housed within the gripper body 306. Gripper assembly 309 further includes a first gripper arm 320 securely affixed to a gripper leg 316 via, screws 328. Each screw 328 includes a threaded shank that extends through holes 324, 332 formed through the body of both the first gripper arm 320, and gripper leg 316, respectively. Gripper assembly 309 further includes a second gripper arm 322 securely affixed to gripper leg 318 via, set screws 330 which also include a threaded shank that extends through holes 326, 334 formed in the second gripper arm 322, and gripper leg 318, respectively. Each gripper arm 320, 322 comprises a generally "L" shaped body including a protrusion 319, 321 provided on the bottom of each body. In assembly, protrusion 319 is received within respective notches 323, 325 formed in seal plates 336, 338, and protrusion 321 is received in notch 327 formed in seal plate 344, as better illustrated in FIG. 20. A planar, vertical portion of each gripper arm 320, 322 is attached to a corresponding planar, outer, vertical surface of each respective gripper leg 316, 318, via, screws 328 and 330.

Figure 20:
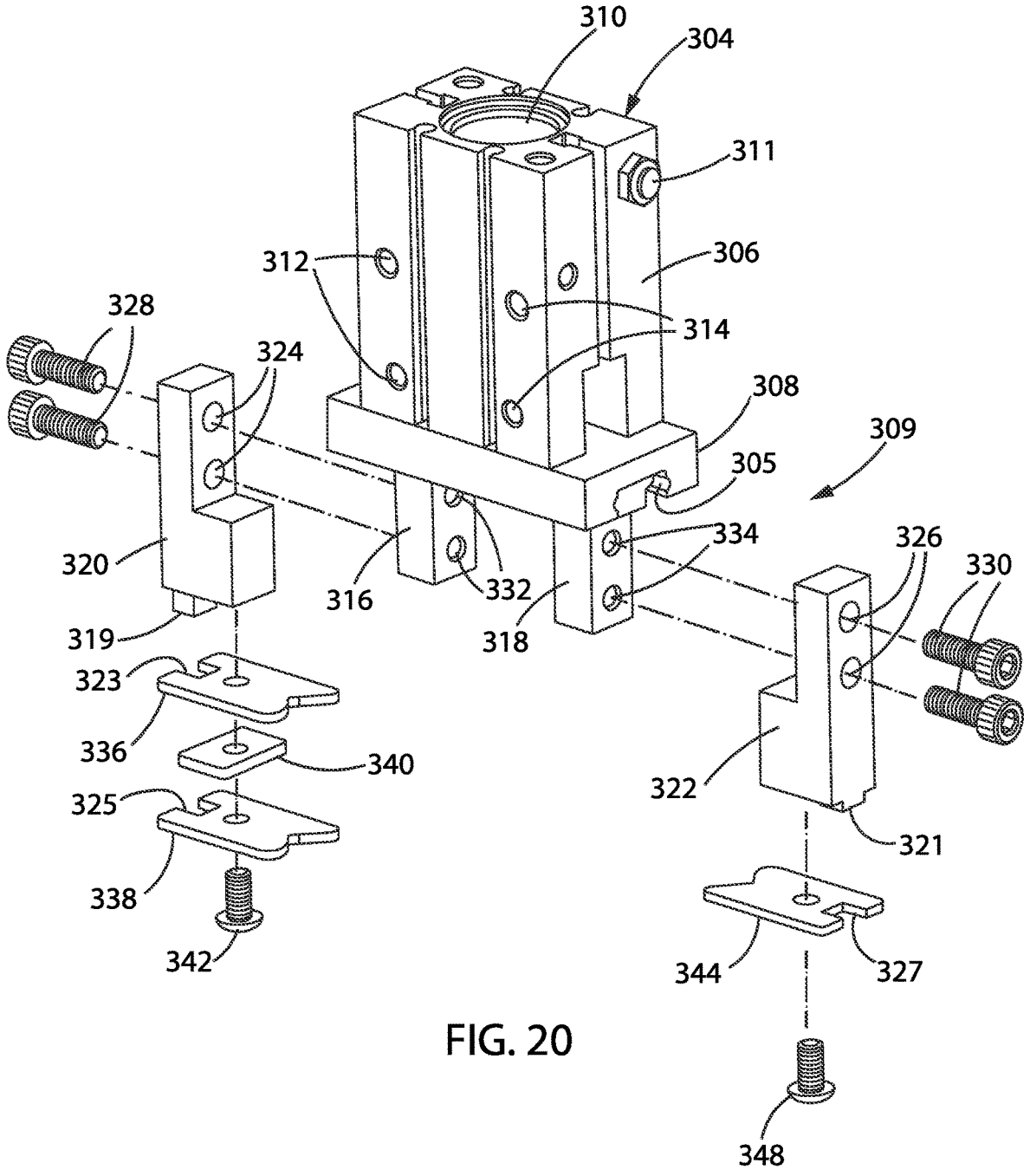
FIG. 20 is an exploded view of the gripper actuator showing the gripper assembly including gripper arms mountable to parallel gripper legs, and seal plates attachable to the bottom of each gripper arm.

As better illustrated in FIG. 20, gripper assembly 309 further includes seal plates 336, 338, 344 each comprising a square or rectangular geometry including a distal contact end, and a cut-out notch 323, 325, 327 (generally square or rectangular in shape) formed at a proximate end, opposite the distal contact end. In a preferred embodiment, each distal contact end of seal plate 336, 338, 344 includes a progressively tapered "V-shape" groove adapted for closing and sealing top openings of filled cones by compressing the top cylindrical paper portion of the filled cone during the cone closing process. Each seal plate 336, 338, 344 includes a hole to accommodate threaded shanks of fasteners 342, 348 for securing the seal plates 336, 338, 344 to respective bottoms of each gripper arm 320 and 322. In assembly, a pair of seal plates 336, 338 are attached together so that the notches 323, 325 and holes align with each other as the seal plates 336, 338 are assembled together. In assembly, notches 323, 325 of each respective seal plate 336, 338 receive protrusion 319 provided on gripper arm 320 to prevent the seal plates 336, 338 from rotating or shifting during use. A spacer 340 having a geometric shape and thickness is captured between seal plates 336, 338 defining a plate gap 341, as better illustrated in FIGS. 21*a* and 22*a*. Seal plate 344 is similarly mounted to gripper arm 322 so that notch 327 receives protrusion 321 of the gripper arm 322. The threaded shank of each fastener 342, 348 extends through the aligned holes of each seal plate 336, 338, 344 and spacer 340, and enters a threaded bore provided within the bottom of each gripper arm 320 and 322. Once assembled, seal plates 336, 338 are secured asymmetrically to seal plate 344 allowing seal plate 344 to enter plate gap 341 during the cone sealing process. It is appreciated that spacer 340 comprises a thickness that is slightly larger than seal plate 344 for allowing the distal contact end of seal plate 344 to enter plate gap 341. The cone filler control system 114*a* generates a signal to one or more solenoids 202 to operate the air compressor unit 204 and deliver compressed air to the air inlet 303 of the gripper actuator 304, via an air delivery hose (not shown) for operating the mechanical gripper elements of the gripper actuator 304 forcing the gripper arms 320, 322 towards each other via, track 305 of gripper base 308, where seal plate 344 enters plate gap 341 closing a top opening of a filled cone.

Figure 22:
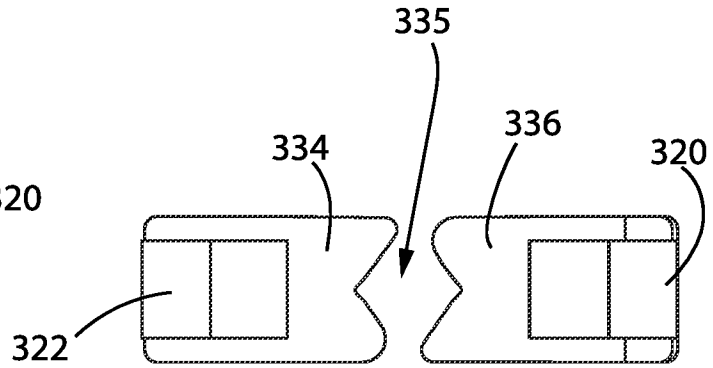
FIGS. 22 and 22*a* are top, and side perspective views, respectively, of the gripper arms shown open with the contact end of a seal plate extracted from the plate gap formed by the pair of seal plates arranged in parallel defining a cone receiving area.
Figure 21:
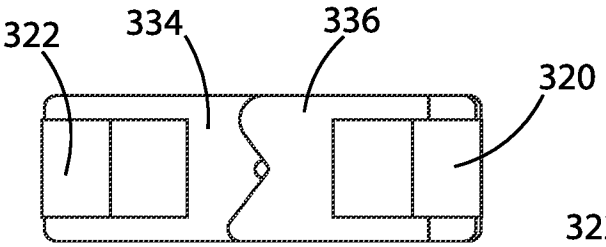
FIGS. 21 and 21*a* are top, and side perspective views, respectively, of the gripper arms shown closed with a contact end of a seal plate entering a plate gap defined by a pair of seal plates arranged in parallel with each other.
Figure 22A:
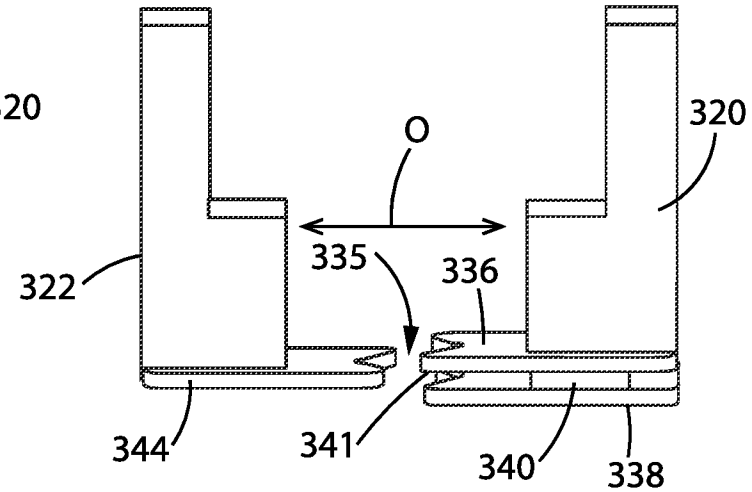

As illustrated in FIGS. 21 through 22*a*, each seal plate 336, 338, 344 comprises a dimension having a width that is preferably equivalent to, or slightly larger than, the width of the body of each gripper arm 320, 322, and includes a predetermined length, and thickness. Seal plates 336, 338, 344 may be fabricated from a durable hard plastic material, or lightweight metal such as aluminum or stainless steel. It is noted that in one embodiment, seal plates 336, 338, 344 may comprise interchangeable seal plates each having the same or different size, shape, or contact end. For example, one or more interchangeable seal plates may comprise a contact end including a wave, a semi-circular, a saw tooth, or a "U" shaped form. Further, a non-friction material may be imparted on the outer surface of each contact end to prevent the cylindrical paper portion of the top opening of a filled cone from sticking to the seal plate 336, 338, 344 during the cone sealing process. Such non-friction material may be beneficial when packaging cones in areas that have high humidity. It is appreciated that the length of each seal plate 336, 338, 344 impacts the size opening of the cone receiving area 335, as illustrated in FIG. 22*a*. Shorter seal plates provide a larger cone receiving area while longer seal plates provide a smaller size cone receiving area 335.

Figure 21A:
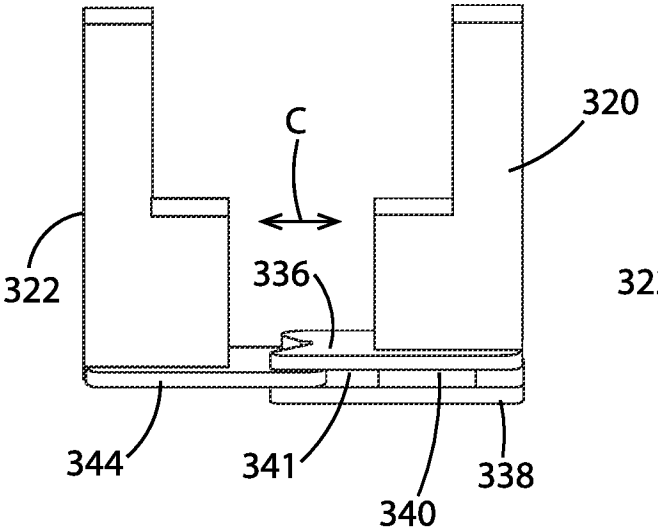

As shown in FIGS. 22 and 22*a*, gripper arms 320, 322 remain normally open O a spaced-apart distance from each other when gripper actuator 304 is non-operating or de-energized displacing seal plate 344 away from seal plates 336, 338 defining a cone receiving area 335. Upon a cone top of a filled cone entering the cone receiving area 335, an electrical signal is generated from the cone filler control system 114*a* to operate the compressor 204 or alternatively, a power supply, and activate the gripper actuator 304 forcing the gripper arms 320, 322 to move towards each other in a closed position C. As the parallel gripper arms 320, 322 move towards each other, seal plate 344 enters plate gap 341 formed by spacer 340 captured between seal plates 336, 338 as illustrated in FIG. 21*a*, closing and holding the cylindrical cone top of a filled cone.

Figure 23:
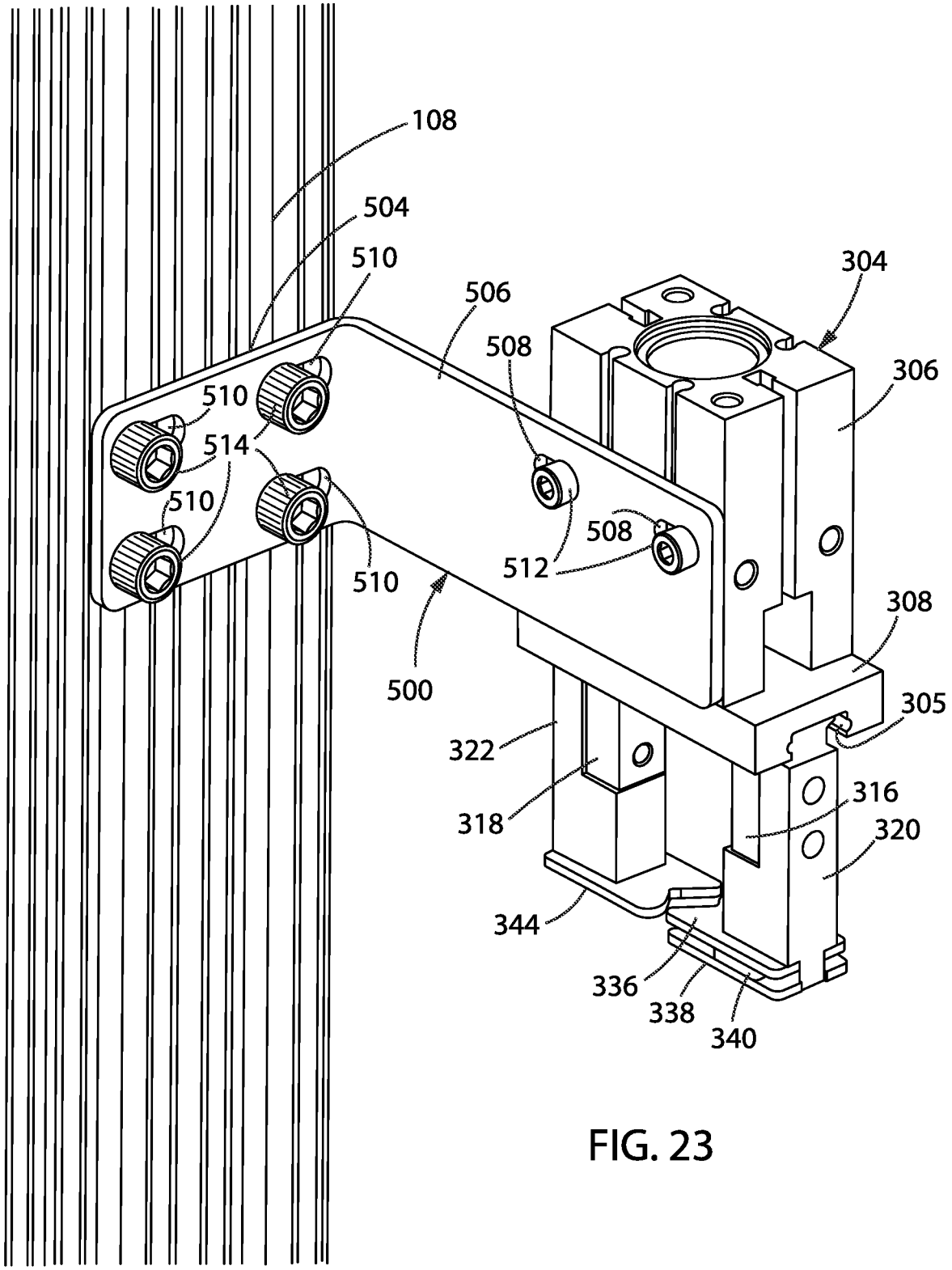
FIG. 23 is a back, perspective view of the gripper actuator affixed to a mounting bracket adjustably mounted to a frame member via, fasteners.

In reference to FIG. 23 there is shown a back, perspective view of the gripper actuator 304 mounted to a mounting bracket 500 adjustably attached to frame member 108 of the cone filling system 300. The mounting bracket 500 is used to strategically position the gripper actuator 304 within the cone sealing area. Mounting bracket 500 allows operators to finely adjust the vertical and/or horizontal position of the gripper actuator 304 within the cone sealing stage to properly receive top openings of filled cones within the cone receiving area 335. In one embodiment, mounting bracket 500 includes a first leg 504 integral with a second leg 506 forming an "L" shaped bracket. A pair of slots or holes 508 are formed within the body of the second leg 506, and a plurality of slots or holes 510 are formed within the body of the first leg 504. Each slot or hole 508, 510 is dimensioned to permit adjusting the positon of the gripper actuator 304 in proper alignment above a designated cone receptacle 110. Each slot or hole 508, 510 may comprise the same or different dimension, size, shape, and/or orientation. Mounting bracket 500 may be fabricated from any well-known heavy or lightweight material including metal such as aluminum, or steel, or a durable, rigid plastic. Upon mounting the gripper actuator 304, the plurality of threaded bores 312, 314 provided within the gripper body 306 are aligned with slots 508 on the second leg 506 of mounting bracket 500. Operators can select any pair of threaded bores 312, 314 provided on body 306 to accommodate attaching the gripper actuator 302 to bracket 500. After properly aligning slots 508 of leg 506 with threaded bores 312 or 314 of gripper body 306, threaded shanks of fasteners 512 are inserted there-through to retain the gripper actuator 304 in position in the cone sealing area. The first leg 504 of the mounting bracket 500 is adjustably attached to frame member 108, via, threaded fasteners 514. The mounting bracket 500 may be mounted to frame member 108 using any number of T-nuts as well. Each threaded fastener 514 includes a threaded shank that is either threaded within a threaded bore formed within frame member 108, or alternatively, secured to the frame member 108 using fastening nuts. In finely adjusting the gripper actuator 302, operators simply loosen threaded fasteners 514 and maneuver the first leg 504 of the mounting bracket 500 to any desired position via, slots 510. Operators can also loosen threaded screws 512, and maneuver the gripper body 306 along the second leg 506 of the mounting bracket 500 to adjust the horizontal position of the gripper actuator 302 as well. It is appreciated that the height of the gripper actuator 304 may also be adjusted by opting to select other threaded bores provided on the gripper body 306. It is understood that slots 508, 510 may comprise any number, dimension, size, and configuration to permit adjusting the gripper actuator 304 along any vertical and/or horizontal position above a cone receptacle 110 residing in cone carousel 112.

Figure 18:
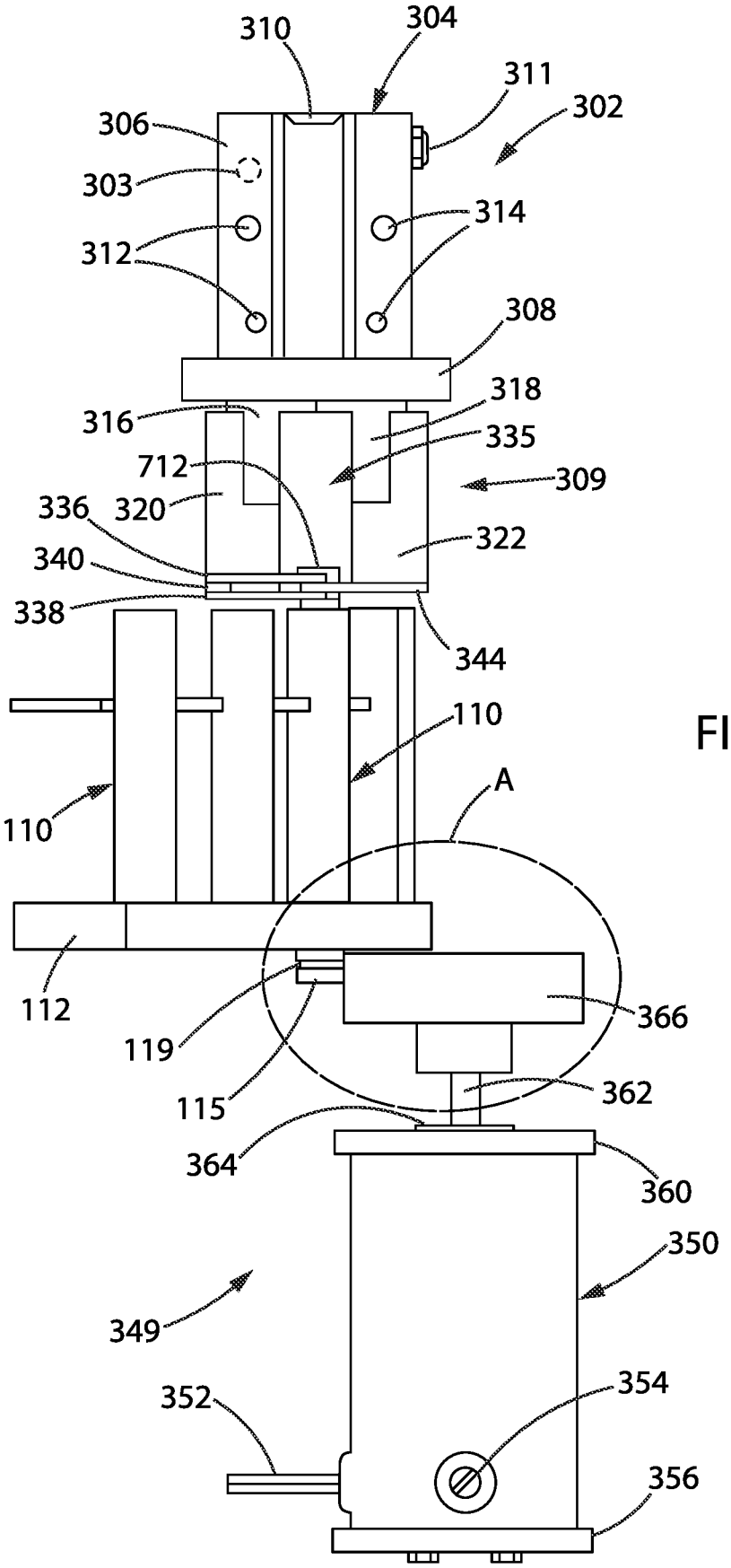
FIGS. 18 and 19 are side, and top side perspective views, respectively, of a cone top sealing system showing a gripper actuator including a gripper assembly with parallel gripper arms, seal plates provided at distal ends of each gripper arm for closing a top opening of a filled cone retained in cone receptacles residing in a cone carousel, and a motor including a drive wheel rotatably engaging a cone insert for rotating a filled cone during a cone top sealing process.
Figure 19:
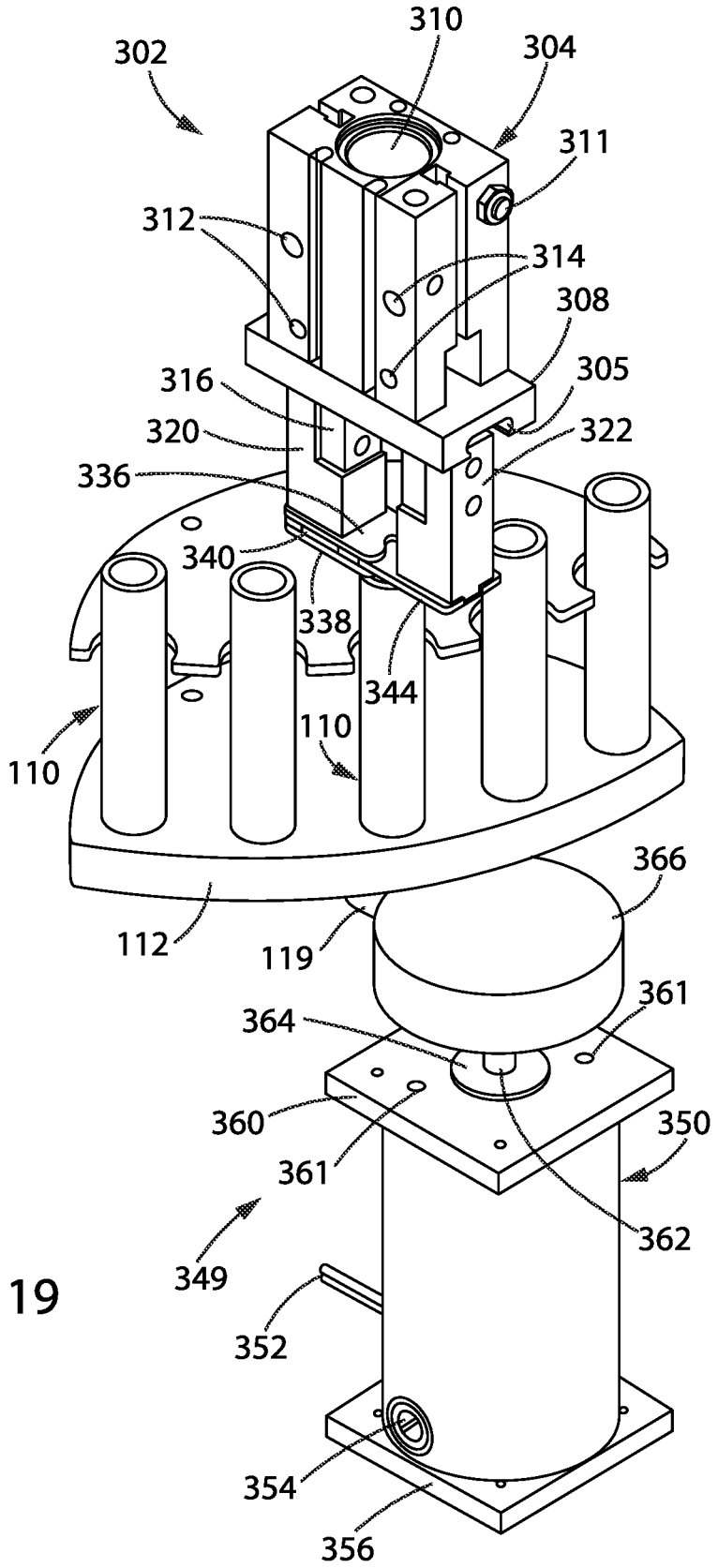

Referring again to FIGS. 18 and 19, the cone top sealing system 302 further includes a cone sealing drive system generally denoted at 349 for rotating cone inserts 111 provided in respective cone receptacles 110. The cone sealing drive system 349 includes a motor 350 powered by an external pneumatic, hydraulic, or electrical source via, one or more hoses, or electrical cables 352. In a preferred embodiment, motor 350 comprises an electric motor such as a DC motor, a servo motor, stepper motor, or an AC motor powered and controlled by the cone filler control system 114*a*. The cone sealing drive interface 1266 comprises the necessary electrical circuitry and components for operating and controlling motor 350. The cone filler control system 114*a* is safely housed within an enclosure located on the system frame, as shown in FIG. 17. In one embodiment, motor 350 includes replaceable dc carbon brushes via, a brush port 354. Other types of motors may be contemplated for use in the cone filling system 300 including a pneumatic or hydraulic stepping motor. As illustrated in FIG. 18, one end of motor 350 includes a first motor plate 356, and another end of the motor 350 includes a second motor plate 360 including a plurality of mounting holes 361 for mounting the motor 350 to a base plate 107 below the cone carousel 112, as shown in FIG. 28. Motor 350 includes a rotating shaft 362 and shaft seal 364 to prevent moisture, dirt, or dust from entering the casing of the motor 350. A drive wheel 366 is mounted to the distal end of the motor shaft 362 via, a hub set-screw or coupling device. Drive wheel 366 comprises a predetermined diameter, and thickness, and is preferably fabricated from a solid, metal, such as aluminum however, other materials such as rubber or plastic may be employed. In reference to area "A" in FIG. 18, drive wheel 366 releasably engages an insert ring 119 provided on a lower end 115 of a cone insert 111. In operation, the cone filler control system 114*a* generates a signal, via cone sealing drive interface 1266, to energize the motor 350 and rotate shaft 362 which in turn rotates drive wheel 366. Drive wheel 366 imparts a rotational force on insert ring 119 simultaneously rotating both a cone insert 111, and a filled cone 712 retained within the cone insert 111 during the cone sealing process to seal the end of the filled cone 712 forming a wick. In one embodiment, drive wheel 366 may include a friction material or coating such as an elastomer or rubber material disposed on the circumferential outer surface of the wheel, or alternatively include knurls that are formed within the metal body of the drive wheel 366 to enhance frictional engagement of the drive wheel 366 with insert ring 119 of a cone insert 111. It is appreciated that various mechanical configurations can be employed in controlling the motor operation. For example, the cone sealing drive system may further include gear boxes, encoders, feedback control, and/or torque control.

Figure 24:
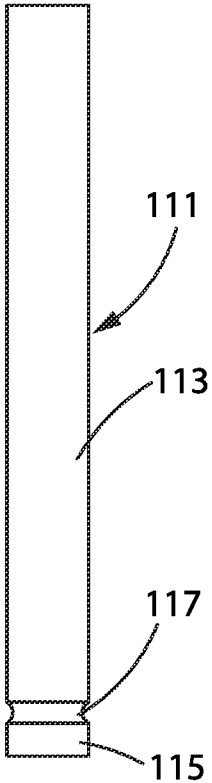

Referring to FIGS. 24 and 25 there is shown a front, and a front, perspective view, respectively, of a cone insert 111 adapted for holding, and rotating filled cones 712 during the cone sealing process. Cone insert 111 comprises a cylindrical body 113 having a length and diameter including an interior, a lower end 115, and an open top in communication with the interior. A groove 117 is formed at the lower end 115 of the cylindrical body 113 to receive an insert ring denoted at 119. Insert ring 119 comprises an elastic, rubber, or elastomeric ring or band such as an O-ring. Insert ring 119 provides frictional, rotational engagement with drive wheel 366 during the cone sealing process. Insert ring 119 can be easily replaced if needed, or alternatively, insert ring 119 can be permanently disposed within the insert groove 117 using any technique including for example, transfer molding, injection molding, adhesive, or over-molding. Each cone insert 111 is disposed within a corresponding cone receptacle 110 residing in cone carousel 112 such that the lower end 115 of the cone insert 111 extends below the planar surface of the cone carousel 112 a predetermined distance exposing the insert ring 119 for rotational engagement with drive wheel 366. Insert ring 119 prevents removing the cone insert 111 from the cone carousel 112 as the insert ring 119 is larger in diameter than that of the cone receptacle 110.

Figure 27:
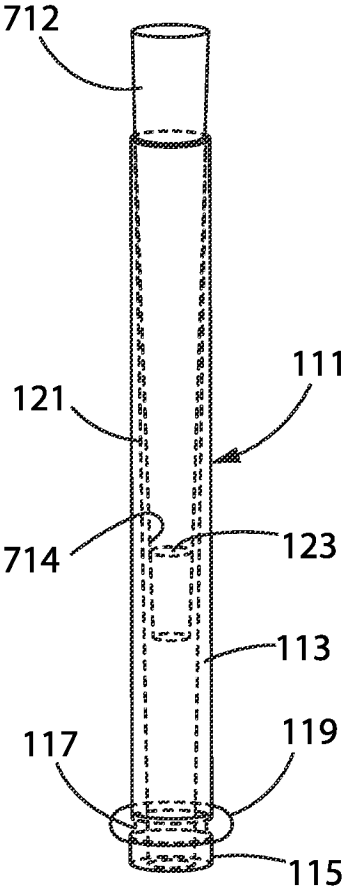
FIGS. 26 and 27 is a front, and front perspective inner view, respectively, of the cone insert of FIGS. 24 and 25, illustrating the interior including an inner wall progressively tapering towards the lower end of the cylindrical body forming a hollow taper lock area shown in dotted lines for taper locking the filled cone within the cone insert.
Figure 26:
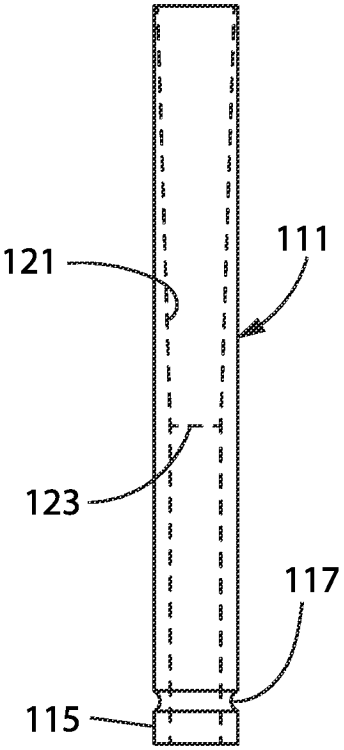

Secured engagement of a filled cone 712 within a cone insert 111 permits simultaneously rotating the filled cone 712 while rotating the cone insert 111 as better illustrated in FIGS. 26 and 27. Each cone insert 111 includes an interior wall 121 that progressively tapers inwards towards the interior while extending towards the lower end 115 of the cylindrical body 113 defining a hollow, taper lock area 123. The hollow taper lock area 123 provides a taper lock configuration for securely retaining a filled cone 712 within the cone insert 111. For example, a cone 712 generally includes a tapered, cylindrical body 714 having a closed cone bottom, an interior for holding smokable material therein, and a top opening. When the cone is loaded into a cone insert 111, a portion of the cylindrical body 714 is wedged within the hollow, taper lock area 123 forming a tapered locking engagement between a cone and cone insert 111. Operation of the cone seating actuator 230, the primary cone tamper actuator 130, and secondary cone tamper actuator 137 function to push and wedge the cylindrical, tapered body 714 of the cone 712 within the hollow, taper lock area 123 securely locking the filled cone in position within the cone insert 111, as illustrated in FIG. 27. The tapered locking engagement of the filled cone 712 within the cone insert 111 allows the filled cone 712 to rotate simultaneously with the cone insert 111 360 degrees via, drive wheel 366 of motor 350. It is appreciated that the top opening of a filled cone 712 extends upwards a predetermined height from the top of cone insert 111 for readily closing and sealing the top opening of the filled cone 712 forming a wick.

The cone insert 111 may comprise a number of interchangeable cone inserts each having an interior with a different size providing a hollow taper lock area 123 with a different size in diameter. The convenience of having interchangeable cone inserts 111 is the ability to accommodate packaging cones with different sizes. As such, cone inserts 111 can be selected in accordance with the size of empty cones being used. This feature eliminates the need of having to retool machinery and change cone receptacles 110, or the cone carousel 112 itself.

Turning now to FIG. 28 there is shown a perspective view of the cone sealing system 302 further including a ramp system 516 for guiding cone inserts 111 towards the gripper actuator 304 and positioning cone inserts 111 in physical engagement with drive wheel 366, and cone tops of filled cones 712 correctly within the cone receiving area 335 of the gripper actuator 304. The ramp system 516 includes a semi-helical or semi-circular ramp 518 adjustably mounted on base plate 107 of the cone filling system 300 via, adjustable members 520 and 522. In a preferred embodiment, ramp 518 is located below the peripheral area of the cone carousel 112 to accommodate the lower ends of the cone inserts 111 extending out from the bottom of each cone receptacle 110. Adjustable members 520, 522 are secured to base plate 107 via, holding plates 524, 526 which are displaced below the ramp 518. In one exemplary embodiment, each adjustable member 520, 522 comprises a bolt having a threaded shank that extends through threaded openings formed within each holding plate 524, 526 where a distal end of the threaded shank engages the under surface of ramp 518, and the proximate end of the threaded shank includes a bolt head that rotates freely allowing the threaded shanks to travel within the threaded openings of the holding plates 524 and 526. Using a manual wrench or electric tool, each bolt head is rotated to move the threaded shank vertically up or down within the holding plates 524, 526 thereby adjusting the vertical position of ramp 518. As ramp 518 is adjusted vertically upwards, the cone inserts 111 are elevated upwards placing the cone top of a filled cone 712 further within the cone receiving area 335 thus allowing the cone top sealing system 302 to form a longer wick at the end of the filled cone. As the ramp 518 is adjusted vertically downwards, the cone inserts 111 resting on the top surface of the ramp 516 move downwards by gravity where the cone top of a filled cone 712 extends less within the cone receiving area 335 allowing the cone top sealing system 302 to form a shorter wick at the end of the filled cone. Different types of smokable material may have different densities which impacts the length of wick formed at the end of a filled cone during the cone sealing process. For example, compacting denser smokable material within a cone can result in a cone having a higher level of smokable material resulting in a shorter cone top which correlates to a shorter wick being formed at the end of a filled cone. In an effort to provide wick seals having consistent lengths throughout, regardless of the type of smokable material used, the cone insert ramp system 516 provides adjustable members 520, 522 to vertically adjusting the ramp 518 upwards or downwards to adjust positioning cone tops of filled cones within the cone receiving area 335 of the gripper actuator 304 during the cone sealing process. It is understood that other types of adjustable members can be employed such as pneumatic or hydraulic cylinders, or electrical linear actuators that are controlled by the cone filler control system 114*a*. For example, preprogrammed parameters or values associated with the type or characteristic of the smokable material may be used to control linear actuators for adjusting the vertical height of the ramp 516. Operators can enter or select the type of smokable material used during packaging via, the GUI for controlling each linear actuator.

Figure 29:
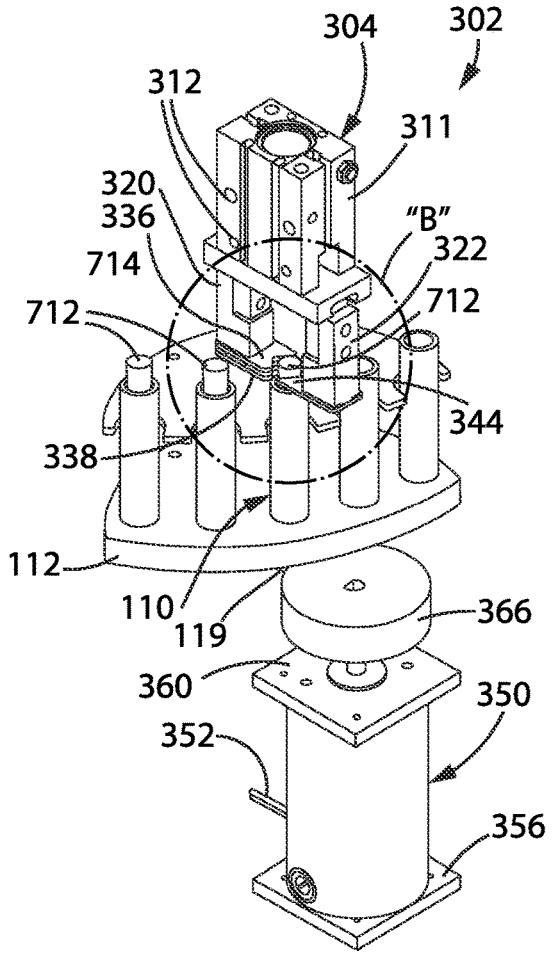
FIG. 29 is a top, side perspective view of the cone sealing system showing filled cones readily indexed, via the cone carousel for sequentially positioning a top opening of a filled cone within the cone receiving area of the gripper actuator while engaging the lower end of the cone insert with the drive wheel of the motor to readily rotate the filled cones during the cone sealing process.
Figure 30:
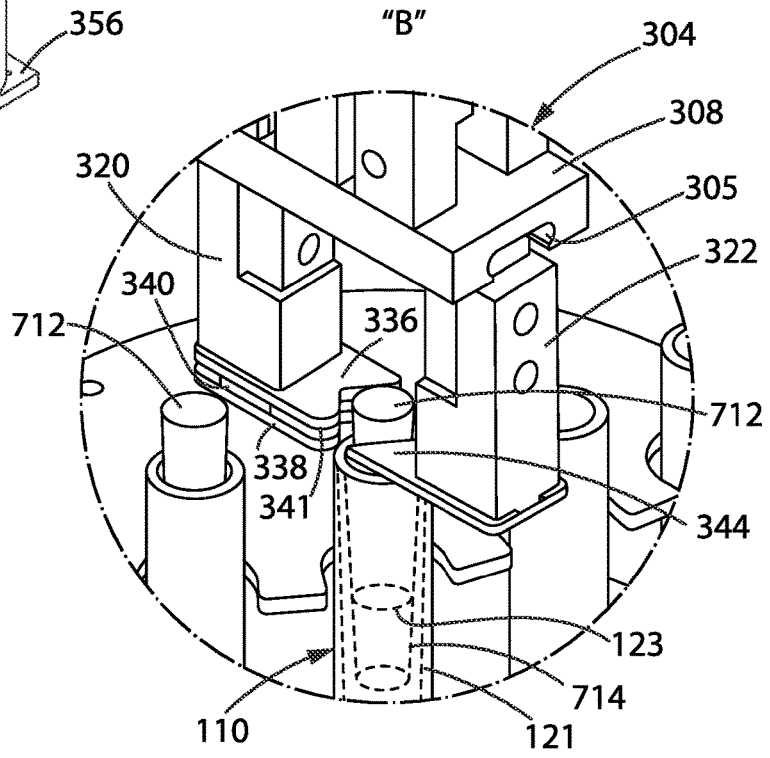
FIG. 30 is a partial, enlarged view of section "B" in FIG. 29, showing the top opening of a filled cone positioned within the cone receiving area defined by a spaced-apart distance between the seal plates of the gripper actuator, and a taper lock engagement of the filled cone disposed within a cone insert in a cone receptacle shown in dotted lines.

Readily positioning filled cones 712 within the cone top sealing system 302 is illustrated in FIGS. 29 and 30. FIG. 29 illustrates a top, side perspective view of the cone top sealing system 302 showing filled cones 712 taper locked within respective cone receptacles 110 residing in cone carousel 112 that is readily indexed. During operation, the cone filler control system 114*a* generates a carousel indexing signal for indexing the cone carousel 112 by one cone receptacle position such that each one of the cone receptacles 110 are rotated in a serial fashion through the cone loading stage, the cone filling stage, the cone tamping stage, the cone closing stage and the optional cone evacuation stage. Cone carousel 112 comes to a complete stop where insert ring 119 of cone insert 111 engages drive wheel 366 of motor 350. The cone top of a filled cone 712 is positioned within the cone receiving area 335 defined by the distance between asymmetrical seal plate 344, and seal plates 336, 338. The progressively tapered V-shape groove of each seal plate 336, 338, 344 faces the outer cylindrical surface of cone top of the filled cone 712 while a portion of the cylindrical body of the filled cone 712 is taper locked within the cone insert 111 to simultaneously rotate with the cone insert 111 when motor 350 is activated, as shown in FIG. 30.

Figure 32:
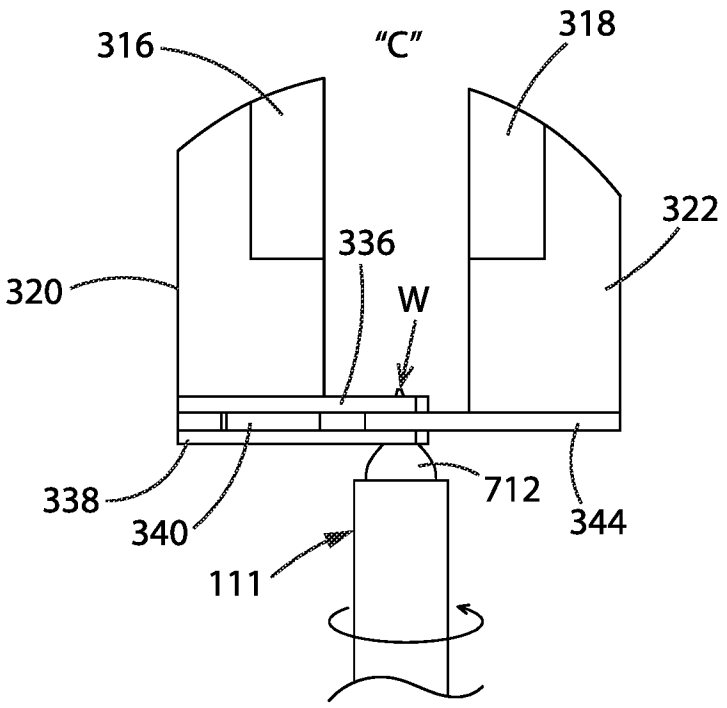
FIGS. 31 and 32, is a side, and a partially, enlarged side view, respectively, of the cone sealing system showing seal plates of the gripper actuator closing the top opening of a filled cone with the drive wheel of the motor imparting a rotating force on the insert ring of the cone insert for rotating and twisting the top opening of the filled cone forming a wick at the end of the filled cone.
Figure 31:
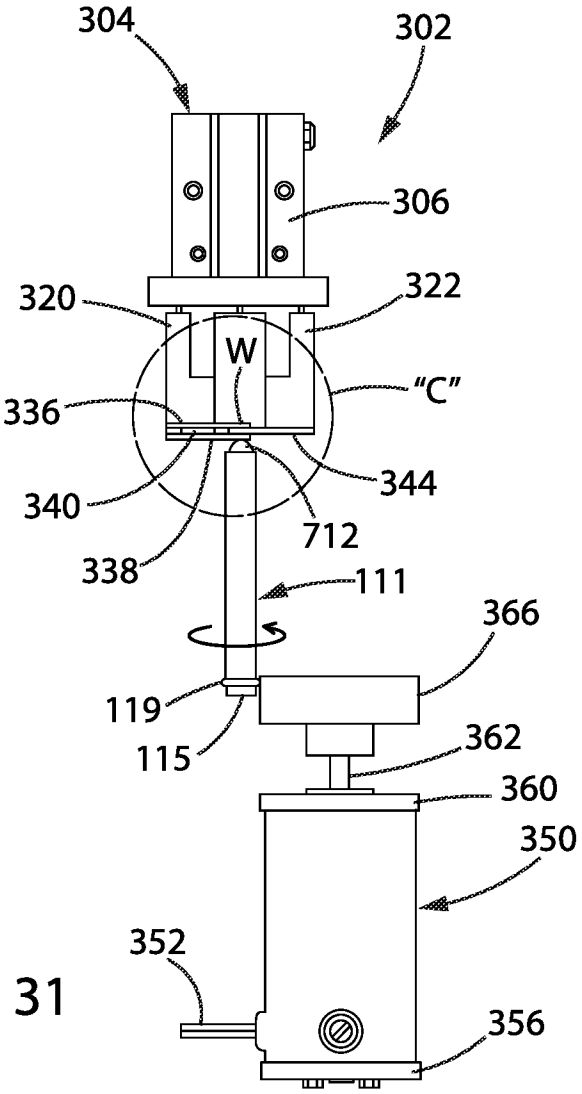

The cone filler control system 114*a* generates a signal, via the cone sealing drive interface 1266, to operate motor 350 to rotate shaft 362 which in turn rotates the drive wheel 366. The drive wheel 366 imparts a rotational force on the ring insert 119 causing cone insert 111 to rotate a predetermined time period, as illustrated in FIGS. 31 and 32. A timing system is employed for controlling the on and off duty cycle of motor 350. Alternatively, in one embodiment, an encoder may be coupled to the motor 350 to determine a number of rotational cycles for use in rotating cone insert 111. Because the filled cone 712 is securely retained within the cone insert 111 via, a taper lock engagement, both the cone insert 111 and filled cone 712 rotate together simultaneously. Simultaneously with, or shortly after the motor 350 is activated, the cone filler control system 114*a* generates a signal to one or more of the selected solenoids 202 to operate air compressor unit 204 or in an alternative embodiment, a power supply unit, to actuate gripper actuator 304 forcing gripper arms 320, 322 towards each other. As the gripper arms 320, 322 move towards each other, the progressively tapered V-shape groove of each seal plate 336, 338, 344 physically compress and close the cone top of the filled cone 712, as shown in FIG. 31. As the cone top is held closed by seal plates 336, 338, 344 of the gripper actuator 304, the filled cone is rotated causing the open top to twist thereby sealing and forming a wick W at the end of the filled cone, as better illustrated in the partial, enlarged view of FIG. 32.

In one embodiment, the cone top sealing system 302 may include a visual inspection system to analyze the efficacy of the wicks formed at the end of filled cones. For example, the inspection system may include one or more cameras situated adjacent the gripper actuator 304 and directed towards the wick sealing area to capture still or video images in real-time of formed wicks. The captured images can be categorized and compared with other images of properly formed wicks provided in one or more look-up tables in a database accessible by a computer system or processor, to warn operators when a wick seal is formed incorrectly, is damaged, is not properly sealed or twisted, or is too long or short in length. The warning may comprise an audible or visual alert to operators provided via hardware such an alarm or lighting device, or via software such as producing a flashing icon, pop-up screen, or display banner on a graphical user interface or computer display.

A complete cycle of the cone filling system 300 begins at the cone loading stage. Initially, operators set the position of the ramp 516 via, adjuster members 520, 522 based on one or more physical characteristics of the smokable material used in the cone packaging process to provide wicks of uniform lengths. Once the ramp setting is determined, the cycle of filling and sealing cones begins. A portion of the cone dispenser system 102 as illustrated in FIG. 3 comprises a roller 218, a cone chute 220, an optional cone backboard 222, and an optical sensor 224. During operation of a cone loading stage, the spinning roller 218 engages the lower end of an empty cone in a stack of cones, and moves the engaged empty cone downward into the cone chute 220. The empty cone is further moved downward to the end of the cone chute 220 and is directed into an empty cone insert 11 of a receptacle 110 residing in cone carousel 112. Once the optical sensor 224 senses the presence of a cone in the cone receptacle 110, the roller 218 ceases to operate. The cone carousel 112 indexes the cone receptacle 110 with a deposited empty cone to a cone seating station. A cone seating signal is generated by the cone filler control system 114*a* to activate the cone seating actuator 230. The cone seating actuator 230 extends the seating actuator arm 231 within the empty cone 712 engaging the bottom end of the cone, and pressing downward within the empty cone 712 wedging a portion of the cylindrical body 714 of the empty cone 712 within the hollow, taper lock area 123 of the cone insert 111, as illustrated in FIG. 27. The cone carousel 112 indexes the cone receptacle 110 with the seated empty cone 712 to the filling, and cone tamping stages. A predetermined amount of smokable material is dispensed within the empty cone 712 seated within the cone insert 111. The cone carousel in indexed a cone receptacle position into a first cone tamping area. The cone filler control system 114*a* generates a signal to activate the primary cone tamper actuator 130 to extend the primary actuator arm 136 within the partially filled cone where the narrow tamper head of the actuator arm 136 presses down on, and compacts the smokable material towards the lower end to mid-section area of the cone. The tamped cone is subsequently indexed to a second area of the cone tamping stage where a secondary cone tamper actuator 137 is activated, via the cone filler control system 114*a*, to extend the secondary actuator arm 139 including a broad tamping head within the filled cone tamping, and compacting any loose remaining smokable material towards the mid-section to upper area of the filled cone defining a material level. Once the smokable material is fully tamped or compressed within the filled cone, the cone filled with smokable material enters a cone closing stage. As the carousel comes to a stop in the cone closing stage, the insert ring 119 of cone insert 111 engages drive wheel 366 of motor 350, and the cone top of the filled cone 712 is positioned within the cone receiving area 335 of the gripper actuator 304. The progressively tapered V-shape groove of each seal plate 336, 338, 344 faces the outer cylindrical surface of the cone top of the filled cone 712 while the cylindrical body of the filled cone 712 is taper locked within the hollow, taper lock area 123 of the cone insert 111. The cone filler control system 114*a* subsequently generates a signal to activate motor 350 to rotate shaft 362 which in turn rotates drive wheel 366. The drive wheel 366 imparts a rotational force on the ring insert 119 thereby rotating the filled cone simultaneously with the cone insert 111. The cone filler control system 114*a* generates another signal to one or more of the selected solenoids 202 to operate an air compressor unit 204 or in an alternative embodiment, a power supply unit, to actuate the gripper actuator 304 forcing gripper arms 320, 322 towards each other where the progressively tapered V-shape groove of each seal plate 336, 338, 344 physically compresses the cone top of the filled cone 712 closing the top opening of the cone. As seal plates 336, 338, 344 holdably close the cone top of the filled cone 712, the motor 350 rotates the filled cone 712, via rotating the cone insert 111, thereby twisting the cone top of the filled cone 712 and sealing the top opening to form a wick W seal at the end of the filled cone. Once the power source to the motor 350 is interrupted and the motor has stopped rotating, operation of the gripper actuator 304 is terminated allowing the gripper actuator 304 to return to a normally open state where gripper arms 320, 322 move away from each other allowing seal plate 344 to separate a spaced-apart distance from seal plates 336, and 338. In one optional embodiment, the filled cone is introduced to an optional evacuation stage where the filled cone with a formed wick is removed from the cone insert 111 of cone receptacle 110. As the cone carousel 112 is indexed to introduce the filled cone with the formed wick into the evacuation stage, the lower end 115 and insert ring 119 of the cone insert 111 moves pass the drive wheel 366. The evacuation stage may include robotics, vacuum, forced air, mechanical ejectors, or gripper actuators to remove the filled cone from the cone insert 111.

FIG. 33 is a block diagram of an exemplary embodiment of the cone filling system 300 including a cone filler control system denoted at 114*a*. Some elements and features of the cone filler control system 114 illustrated in FIG. 12 are functionally equivalent in operation in the cone filler control system 114*a* and are represented by the same reference numbers throughout for illustrative purposes. Differing elements of the cone filler control system 114*a* comprise a cone seating interface 1250 and cone seating system 1252, a cone tamper interface 1254, and a cone tamper system 1256, a cone top tamper interface 1258, and cone top tamper system 1260, a cone closer interface 1262, and cone closer system 304, and a cone sealing drive interface 1266, and cone sealing drive system 349. The cone filler control system 114*a* includes a user device interface 1210, a processor 1212, a memory 1214, an optional display 1216, a user input device 1218, and a plurality of interfaces. The memory 1214 comprises portions for storing the operating system (OS) logic 1220, the user interface logic 1222, the auger settings 1224, and the operating system (OS) history 1226. In some embodiments, the OS logic 1220 and the user interface logic 1222 may be integrated together, and/or may be integrated with other logic. In other embodiments, some or all of these memory and other data manipulation functions may be provided by using a remote server or other electronic devices suitably connected via the Internet or otherwise to a client device.

In operation, the operator provides initial setting information to the cone filler control system 114*a* by providing manual operator inputs via the user input device 1218. The user input device 1218 may be a touch screen display (integrated into the display 1216), a keyboard device, and/or a plurality of controllers (buttons, switches, toggles, or the like). Alternatively, or additionally, the user may communicatively couple a computer, lap top, notebook, smart phone, or other electronic device 1228 to the cone filler control system 114*a* via the user device interface 1210 using a suitable wire-based or wireless The processor system, executing the user interface logic 1222, receives the user input and determines a plurality of user settings that control operation of the cone filling system 300. For example, the user may specify a particular amount of smokable material to be placed into each cone as the cone is being filled. The processor 1212 then determines how long the auger drive motor 120 is to be actuated so as to turn the auger 126 for some predefined duration. By turning the auger 126 by the determined duration, the rotating auger adds some corresponding amount of smokable material into a cone. Here, one skilled in the arts appreciates that rotation of the auger 126 for some per unit of time pushes a known amount of smokable material through the auger 126 and out of the lower end 128 of the cone 116. Other user commands may be similarly specified by the user. These determined user commands may be stored into the auger settings 1224 portion of memory 1214. Based on the user setting information, the processor 1212, executing the OS logic 1220, begins the process of filling cones with smokable material. As described herein, the empty receptacles 110 of the cone carousel 112 are indexed in an incremental step-wise fashion from the cone loading stage to the cone filling stage, to the cone tamping stage, to the cone closing and sealing stage, and finally to the optional cone evacuation stage. Accordingly, for each stage increment, the processor 1212 retrieves specific information for loading cones, filing cones, tamping cones, closing and sealing cones, and evacuating cones.

The process of loading cones is made in response to a user start command received at the user device interface 1210 or the user input device 1218. The processor 1212, executing the OS logic 1220 and the user interface logic 1222, initiates operation of the cone loading stage, the cone filling stage, the cone tamping stage, the cone closing stage, and the optional cone evacuation stage. This initiation process is referred to herein as the global start cycle since a plurality of states are concurrently initiated. During a single operation cycle, the cone loading stage, the cone filling stage, the cone tamping stage, the cone closing stage and the optional cone evacuation stage are each concurrently performed until completion. When the operations being performed at all of the stages have been completed, a new global start cycle is initiated. Depending upon the embodiment, the cone carousel 112 may be incremented by one cone receptacle 110 position at the conclusion of the completion of all stages (prior to the next global start cycle). Alternatively, the cone carousel 112 may be incremented by one cone receptacle 110 position at the as a first step of the next global start cycle.

To index the cone carousel 112 by one cone receptacle position, the processor 1212 generates and communicates a control signal to the carousel motor interface 1230. In response to receiving the control signal, the carousel motor interface 1230 communicates a signal to the carousel indexing motor 226. In response thereto, the carousel indexing motor 226 rotates (indexes) the cone carousel 112 by one cone receptacle position. In an example embodiment, the carousel motor interface 1230 generates a step voltage signal for a predefined duration that operates the carousel indexing motor 226 for the predefined duration to index the cone carousel 112. Other embodiments may employ other motor controllers and signals to index the cone carousel 112. In embodiments where a pneumatic stepping actuator is used to index the cone carousel 112, a control signal is sent to a solenoid to actuate the indexing of the cone carousel 112. In some embodiments, the cone carousel 112 is indexed one cone receptacle position in a clockwise direction such that a cone receptacle 110 passes sequentially through the cone loading stage, the cone tamping stage, the cone filling stage, the cone closing stage and the optional cone evacuation stage. In other embodiments, the cone carousel 112 rotates in a counter clockwise direction.

During the cone loading stage performed by the cone dispenser system 102, the processor 1212 operates to generate an actuation signal that is communicated from the roller drive interface 1232 to the roller drive motor 408. Preferably, the signal is a step voltage signal that operates the roller drive motor 408 for a predefined period of time. Accordingly, the roller drive interface 1232 receives the actuation signal from the processor 1212, and then generates the step voltage function or the like that is communicated to the roller drive motor 408. As noted herein, the operation of the roller drive motor 408 transports an empty cone from the cone stack feed tube 404 into the cone chute 220.

After the empty cone has entered the cone chute 220, the roller drive motor 408 is deactivated such that the cone roller 218 becomes secured in a stationary position. Then, after some predefined duration, the cone filler control system 114*a* issues a control signal to the cone loader air line interface 1234. In response to receiving the control signal from the cone filler control system 114*a*, the cone loader air line interface 1234 outputs a voltage and/or a current signal to the cone loader airline system 1208. The cone loader airline system 1208 comprises one of the solenoids 202, a corresponding air compressor unit 204, and the air line 412. The signal from the cone loader air line interface 1234 to the cone loader airline system 1208 causes the solenoid 202 to actuate, thereby causing the air compressor unit 204 to generate pressurized air that is communicated through the air line 412. A puff or stream of air or other gas then exits from the air nozzle 410 to push the empty cone downward through the cone chute 220. If multiple gas puffs are required, the cone filler control system 114*a* generates further control signals that are received by the cone loader air line interface 1234. If a plurality of air lines 412 are employed, then the cone filler control system 114*a* coordinates control signals to a plurality of cone loader airline interfaces 1234 that are each connected to a corresponding cone loader airline system 1208.

In response to receiving a signal at the optical sensor interface 1236 from the optical sensor 224 indicating that an empty cone has been loaded into the cone receptacle 110 located below the cone chute 220, the cone filler control system 114*a* initiates a cone seating stage by generating and communicating a control signal to the cone seating interface 1250. In response to receiving the control signal from the processor 1212, the cone seating interface 1250 outputs a voltage and/or a current signal to the cone seating system 1252. The cone seating system 1252 comprises one of the solenoids 202, air compressor unit 204, and the cone seating actuator 230. The signal from the cone seating interface 1250 to the cone loader airline system 1208 causes a designated solenoid 202 to actuate, thereby causing the air compressor unit 204 to generate pressurized air that is delivered to an air inlet of the cone seating actuator 230. The compressed air extends the seating actuator arm 231 within the empty cone setting the height of a cone top above the cone insert 111.

The user interface logic 1222, under the execution of the processor 1212, is configured to receive one or more user commands that are intended to control the amount of smokable material added into a cone during the cone filling stage. The amount of smokable material added into a cone is precisely controlled by controlling the duration of the rotational operation of the auger 126. In a preferred embodiment, the rotational speed of the auger is predefined and is precisely controlled by the auger drive motor 120. Accordingly, the amount of smokable material added into an empty cone is readily controllable. The cone filler control system 114*a* simply processes a user command defining the desired amount of smokable material that is to be added into an empty cone, and then computes the auger operation time duration (interchangeably referred to herein as the determined duration) for the auger 126. The processor 1212 communicates a control signal corresponding to the computed auger operation time duration to the auger interface 1243. The auger interface 1243, in an example embodiment, generates and communicates a voltage and/or current signal to the auger drive motor 120 for the computed auger operation time duration. At the end of the duration, the rotation of the auger 126 is halted, thereby preventing additional smokable material from being added into the now-filled cone. This cone filling process is performed one time after the start of each global start cycle. In embodiments with a touch sensitive screen display 1216, the user may specify a desired amount of smokable material that is to be entered into an empty cone. Here, a user's touch of an active area on the touch sensitive screen corresponds to a user input. In response to sensing the user's touch on a particular active area on the touch sensitive screen display 1216, the touch sensitive screen display 1216 generates a user input signal that is communicated to the processor 1212, wherein the communicated user input signal corresponds to the intended user input.

Upon depositing smokable material within a seated empty cone, the primary cone tamper system is employed to tamp smokable material deposited within the filled cone. Cone filler control system 114*a* communicates a control signal to the cone tamper interface 1254. In response to receiving the control signal from the processor 1212, the cone tamper interface 1254 outputs a voltage and/or a current signal to the cone tamper system 1256. The cone tamper system 1256 comprises one of the solenoids 202, a corresponding air compressor unit 204, and a primary cone tamper actuator 130 including a narrow tamper head disposed at the distal end of a primary actuator arm 136. A signal from the cone tamper interface 1254 causes the air compressor unit 204 to generate pressurized air that is communicated to an air inlet of the cone tamper actuator 130 forcing the primary actuator arm 136 to extend within the filled cone where the narrow tamper head of the primary actuator arm 136 tamps the smokable material down towards the bottom to mid-section of the cone. If multiple tamping is required, the cone filler control system 114*a* generates further control signals that are received by the cone tamper system 1256. In completing the tamping, the primary cone actuator 130 is fully retracted.

Upon restarting a global cycle, the cone carousel 112 is subsequently indexed to a second area of the cone tamping stage where a cone top tamper system is employed to tamp any loose or remaining smokable material within the filled cone. Processor 1212, executing the OS logic 1220, optionally operates to initially generate an actuation signal that is communicated from the processor 1212 to the cone top tamper interface 1258. In response to receiving the control signal from the processor 1212, the cone top tamper interface 1258 outputs a voltage and/or a current signal to the cone top tamper system 1260. In an example embodiment, the cone top tamper system 1260 comprises one of the solenoids 202, a corresponding air compressor unit 204, and a secondary cone tamper actuator 137 including a secondary actuator arm 139 having a broad tamping head at the distal end of the secondary actuator arm 139. A signal from the cone top tamper interface 1258 causes the air compressor unit 204 to generate pressurized air that is delivered to an air inlet of the secondary cone tamper actuator 137 forcing the secondary actuator arm 139 to extend within the filled cone where the broad tamper head tamps down any loose, remaining smokable material from the mid-section to upper area of the cone defining a material level. If multiple tamping is required, the cone filler control system 114*a* generates further control signals that are received by the cone top tamping interface 1258 which outputs a voltage and/or a current signal to the cone top tamper system 1260 to activate the secondary cone tamping actuator 137. Upon completing the tamping process, the secondary cone tamper actuator 137 is fully retracted.

Upon initiating another global cycle, the cone filler control system 114*a* generates a signal to index the cone carousel 112 to a cone closing stage including a cone top sealing system 302. In an example embodiment, the cone top sealing system 302 comprises one or more solenoids 202, a corresponding air compressor unit 204, a gripper actuator 304 including a gripper assembly 309, and a cone sealing drive system 349. As the cone carousel 112 comes to a stop in the cone closing stage, the insert ring 119 of cone insert 111 engages drive wheel 366 of motor 350, and the cone top of the filled cone 712 is positioned within the cone receiving area 335 of the gripper actuator 304. The progressively tapered V-shape groove of each seal plate 336, 338, 344 faces the outer cylindrical surface of the cone top of the filled cone 712 while the cylindrical body of the filled cone 712 is taper locked within the hollow, taper lock area 123 of the cone insert 111.

The processor system generates and communicates a control signal to the cone sealing drive interface 1266. In response to receiving the control signal from the processor 1212, the cone sealing drive interface 1266 outputs a voltage and/or a current signal to the cone sealing drive system 349 to activate motor 350 and rotate shaft 362 which in turn rotates drive wheel 366 a predetermined amount of time. Drive wheel 366 imparts a rotational force on the ring insert 119 thereby rotating the filled cone simultaneously with the cone insert 111.

The processor simultaneously, or shortly after activing the motor 350, generates and communicates a control signal to the cone closer interface 1262. In response to receiving the control signal from the processor 1212, the cone closer interface 1262 outputs a voltage and/or a current signal to the cone closer system comprising gripper actuator 304. The cone filler control system 114*a* generates a signal to one or more solenoids 202 to operate the air compressor unit 204 and deliver compressed air to air inlet 303 of the gripper actuator 304, via an air delivery hose (not shown) for operating the mechanical gripper elements of the gripper actuator 304 and forcing gripper arms 320, 322 towards each other via, track 305 of gripper base 308, where the progressively tapered V-shape groove of each seal plate 336, 338, 344 physically close the cylindrical cone top of the filled cone 712. As the seal plates 336, 338, 344 close the cone top of the filled cone 712, the filled cone 712 is rotated, via rotating cone insert 111, thereby twisting the closed cone top forming a wick W seal at the end of the filled cone. The voltage and/or current signal delivered to both the cone sealing drive system 349 and cone closer system 304 is terminated where the motor 350 stops rotating, and the gripper actuator 304 returns to a normally open state where gripper arms 320, 322 move away from each other allowing seal plate 344 to separate a spaced-apart distance from seal plates 336, 338 freeing the formed wick.

In a cone filling system having an evacuation stage, upon the start of a global start cycle, the cone filler control system 114*a* generates a signal to the carousel motor interface 1230 to index the cone carousel 112 into the cone evacuation stage where sealed cones are removed from the cone receptacle 110 residing on the cone carousel 112. It is appreciated that the cone filler control system 114*a* may include a cone evacuation interface in electrical communication with a cone evacuation system. In one embodiment, the cone evacuation system may comprise one or more solenoids 202, a corresponding air compressor unit 204, or an electrical power source, and an evacuation apparatus comprising a gripper, robotic arm, a mechanical ejector, a vacuum device, or puller.

It should be emphasized that the above-described embodiments of the cone filling system 100, 300 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

What is claimed is:

1. A cone top sealing system that closes and seals a cone filled with a smokable material, said cone top sealing system comprising:

a cone filler control system;

a plurality of cone inserts each including a cylindrical body having an interior, an open end, and a lower end, said interior including an inner wall that progressively tapers inwards of said interior towards said lower end defining a taper lock area for holding a cone filled with smokable material, each of said plurality of cone inserts removably inserted to rotate and move freely within a corresponding cone receptacle residing in a cone carousel, said lower end of each of said plurality of cone inserts including an insert ring;

a gripper actuator including a first gripper arm, a second gripper arm, a first seal plate attached to a distal end of said first gripper arm, and at least a second seal plate attached to a distal end of said second gripper arm, said gripper arms moveable towards and away from each other;

a cone sealing drive system including a motor with a shaft, and a drive wheel affixed to the distal end of said shaft, said drive wheel removably engaging an insert ring;

wherein during operation, the cone filler control system communicates a second control signal to operate the motor and rotate the drive wheel a predetermined time period to impart a rotating force on an insert ring of one of said plurality of cone inserts rotating said cone filled with smokable material simultaneously with one of said plurality of cone inserts that is rotating freely within a corresponding cone receptacle; and wherein during operation, the cone filler control system communicates a third control signal to actuate the gripper actuator forcing the gripper arms to move towards each other so that the seal plates close a cone top of said cone filled with smokable material while one of said plurality of cone inserts and said cone filled with smokable material are rotated, via, the drive wheel, twisting said cone top to form a wick seal at the end of said cone filled with smokable material.

2. The cone top sealing system of claim 1, further comprising a primary cone tamper actuator including a first tamper head, wherein the primary cone tamper actuator extends and retracts within a cone filled with smokable material, said cone filled with smokable material retained within one of said plurality of cone inserts.

3. The cone top sealing system of claim 2, wherein during operation, the cone filler control system communicates a first control signal to actuate the primary cone tamper actuator extending the first tamper head downward into said cone filled with smokable material to pack said smokable material therein, and to capture said cone filled with smokable material within said taper lock area of one of said plurality of cone inserts.

4. The cone top sealing system of claim 3, wherein said at least second seal plate includes a third seal plate and a spacer captured between said second seal plate and said third seal plate forming a plate gap.

5. The cone top sealing system of claim 4, wherein the primary cone tamper actuator, and gripper actuator are pneumatic actuators.

6. The cone top sealing system of claim 5, further including a first solenoid coupled to an air compressor source, wherein in response to receiving the first control signal communicated from the cone filler control system, the first solenoid is actuated to cause the air compressor to deliver pressurized air to a first air inlet of said primary cone tamper actuator to extend said first tamper head within said cone filled with smokable material.

7. The cone top sealing system of claim 6, further including a second solenoid coupled to said air compressor source, wherein in response to receiving the third control signal communicated from the cone filler control system, the second solenoid is actuated to cause the air compressor to deliver pressurized air to a second air inlet of said gripper actuator to move said gripper arms towards each other such that a distal end of said first seal plate enters said plate gap closing said cone top of said cone filled with smokable material.

8. The cone top sealing system of claim 7, further including a secondary cone tamper actuator including a second tamper head retracted and extended within said cone filled with smokable material, said secondary cone tamper actuator comprising a pneumatic actuator.

9. The cone top sealing system of claim 7, wherein said cone control filler system includes a cone sealing drive interface communicating with said motor for setting and controlling said predetermined time period of powering said motor to rotate said shaft.

10. The cone top sealing system of claim 8, wherein the cone filler control system communicates a fourth control signal to actuate the secondary cone tamper actuator extending the second tamper head into said cone filled with smokable material to pack said smokable material within said cone, and to further capture said cone filled with smokable material within a taper lock area of one of said plurality of cone inserts.

11. The cone top sealing system of claim 10, further including a third solenoid coupled to an air compressor source, wherein in response to receiving the fourth control signal communicated from the cone filler control system, the third solenoid is actuated to cause the air compressor to deliver pressurized air to a third air inlet of said secondary cone tamper actuator to extend said second tamper head within said cone filled material with smokable material.

12. The cone top sealing system of claim 1, wherein said gripper actuator is mounted to a mounting bracket adjustably attached to a frame member of the cone top sealing system and positioned within a cone sealing area so that a cone receiving area defined by a spaced-apart distance between said first seal plate and said at least second plate is configured to readily receive a cone top of a cone filled with smokable material.

13. The cone top sealing system of claim 1, further comprising a ramp system including a ramp situated below said cone carousel for supporting the lower ends of said plurality of cone inserts resting on an upper surface of said ramp, and at least one adjustment member in contact with said ramp for adjusting the vertical height of both said ramp and said plurality of cone inserts.

14. A cone top sealing system that closes and seals a cone filled with a smokable material, said cone top sealing system comprising:

a cone filler control system;

a plurality of cone inserts each including an interior having an inner wall that progressively tapers inwards towards a lower end defining a taper lock area configured to hold a cone filled with smokable material, each of said plurality of cone inserts removably inserted to rotate and move freely within a corresponding cone receptacle residing in a cone carousel, each lower end including an elastomeric ring;

at least one cone actuator including a first tamper head, wherein said at least one cone actuator retracts and extends within the cone filled with smokable material;

a gripper actuator including a first gripper arm in parallel with a second gripper arm, a first seal plate attached to said first gripper arm, and a second seal plate, a third seal plate, and a spacer attached to said second arm where said spacer is captured between said second seal plate and said third seal plate defining a plate gap, said parallel gripper arms moveable towards, and away from each other;

a cone sealing drive system including a motor with a shaft, and a drive wheel affixed to the distal end of said shaft, said drive wheel removably engaging an insert ring of each of said plurality of cone inserts;

wherein the cone filler control system is configured to communicate a first control signal to actuate the at least one cone actuator and extend the first tamper head downward into the cone filled with smokable material to pack said smokable material therein, and to capture said cone filled with smokable material within said taper lock area of one of said plurality of cone inserts;

wherein the cone filler control system is configured to communicate a second control signal to operate the motor and rotate the drive wheel a predetermined time period to impart a rotating force on an insert ring of one of said plurality of cone inserts holding said cone filled with smokable material to rotate said cone filled with smokable material; and wherein the cone filler control system is configured to communicate a third control signal to actuate the gripper actuator forcing the gripper arms to move towards each other so that the seal plates close a cone top of said cone filled with smokable material while said one of said plurality of cone inserts holding said cone filled with smokable material rotates to twist said cone top and form a wick seal at the end of said cone filled with smokable material.

15. The cone top sealing system of claim 14, wherein said at least one cone actuator further includes a cone seat actuator including a seating head extending within an empty cone dispensed within one of said plurality of cone inserts, said cone seat actuator setting a height of a cone top of said empty cone residing in one of said plurality of cone inserts, said cone seat actuator comprising a pneumatic actuator, or an electrical actuator.

16. The cone top sealing system of claim 14, wherein said at least one cone actuator includes a second cone actuator including a second tamper head.

17. The cone top sealing system of claim 16, wherein said at least one cone actuator is a first electrical actuator that is in electrical communication with the cone filler control system, and that extends the first tamper head within a cone filled with smokable material in response to receiving the first control signal communicated from the cone filler control system;

wherein said secondary cone actuator is a second electrical actuator that is in electrical communication with the cone filler control system, and that extends the second tamper head within said cone filled with smokable material in response to receiving the fourth control signal communicated from the cone filler control system; and wherein said gripper actuator is a third electrical actuator that is in electrical communication with the cone filler control system, and that moves the gripper arms towards each other in response to receiving the third control signal communicated from the cone filler control system.

18. The cone top sealing system of claim 16, wherein said at least one cone actuator, said second cone actuator, and said gripper actuator are pneumatic actuators.

19. The cone top sealing system of claim 18, wherein the cone filler control system communicates a fourth control signal to actuate the second cone actuator and extend the second tamper head downward into the cone filled with smokable material to pack said smokable material therein, and to further capture said cone filled with smokable material within said taper lock area of one of said plurality of cone inserts.

20. The cone top sealing system of claim 19, further comprising:

a first solenoid coupled to an air compressor source, wherein in response to receiving the first control signal communicated from the cone filler control system, the first solenoid is actuated to cause the air compressor to deliver pressurized air to a first air inlet of said at least one cone actuator to extend said first tamper head within said cone filled with smokable material;

a second solenoid coupled to said air compressor source, wherein in response to receiving the third control signal communicated from the cone filler control system, the second solenoid is actuated to cause the air compressor to deliver pressurized air to a second air inlet of said gripper actuator to move said gripper arms towards each other such that a distal end of said first seal plate enters said plate gap to close a cone top of said cone filled with smokable material; and a third solenoid coupled to an air compressor source, wherein in response to receiving the fourth control signal communicated from the cone filler control system, the third solenoid is actuated to cause the air compressor to deliver pressurized air to a third air inlet of said second cone actuator to extend said second tamper head within said cone filled with smokable material.

21. A method of closing and sealing a cone filled with a smokable material, said method comprising:

providing a cone filler control system;

providing a plurality of cone inserts each cone insert including a cylindrical body having an interior including an inner wall that progressively tapers inwards towards a lower end defining a taper lock area for readily holding or configured to hold a cone filled with smokable material, each of said plurality of cone inserts removably inserted to rotate and move freely within a corresponding cone receptacle residing in a cone carousel, said lower end of each of said plurality of cone inserts including a elastomeric ring;

communicating a first control signal from the cone filler control system to actuate at least one cone actuator and extend a first tamper head downward into a cone filled with smokable material packing said smokable material, and capturing said cone filled with smokable material within said taper lock area of one of said plurality of cone inserts;

communicating a second control signal from the cone filler control system to operate a motor including a shaft, and a drive wheel affixed to the distal end of said shaft, said motor operated to rotate the drive wheel a predetermined time period to impart a rotating force on an elastomeric ring of one of said plurality of cone inserts to rotate said cone filled with smokable material simultaneously with said one of said plurality of cone inserts; and communicating a third control signal from the cone filler control system to actuate a gripper actuator including a first gripper arm including a first seal plate, and a second gripper arm including another seal plate, said gripper actuator actuated to force said gripper arms to move towards each other for said seal plates to close said cone top of said cone filled with smokable material while said cone filled with smokable material is rotated, via, the drive wheel, twisting said cone top to form a wick seal at the end of said cone filled with smokable material.

22. The method of claim 21, wherein said another seal plate comprises a second seal plate, a third seal plate, and a spacer captured between said second seal plate and said third seal plate to form a seal gap for removably receiving said first seal plate therein.

23. The method of claim 22, wherein said at least one cone actuator, and said gripper actuator are pneumatic actuators.

24. The method of claim 23, comprising:

generating pressurized air delivered to a first air inlet of said at least one cone actuator to extend said first tamper head within said cone filled with smokable material in response to receiving a first control signal communicated from the cone filler control system; and generating pressurized air delivered to a second air inlet of said gripper actuator to move said gripper arms towards each other such that a distal end of said first seal plate enters said plate gap to close a cone top of said cone filled with smokable material in response to receiving a third control signal communicated from the cone filler controls system.

25. The method of claim 21, wherein said at least one cone actuator and said gripper actuator are electrical actuators.

26. The method of claim 25, comprising:

delivering a voltage to said at least one cone actuator to extend said first tamper head within a cone filled with smokable material retained within one of said plurality of cone inserts in response to a first control signal generated by said cone filler control system; and delivering a voltage to said gripper actuator to force said gripper arms to move towards each other such that a distal end of said first seal plate enters said plate gap to close a cone top of said cone filled with smokable material in response to receiving a third control signal communicated from the cone filler controls system.

27. The method of claim 21, wherein said at least one cone actuator includes a second cone actuator including a second tamper head.

28. The method of claim 27, comprising:

generating pressurized air delivered to a fourth air inlet of said second cone actuator to extend said second tamper head within said cone filled with smokable material in response to receiving another control signal communicated from the cone filler control system.

29. The method of claim 27, comprising:

delivering a voltage to said second cone actuator to extend said second tamper head within said cone filled with smokable material retained within one of said plurality of cone inserts in response to a fourth control signal generated by said cone filler control system.

30. The method of claim 21, wherein said at least one cone actuator further includes a cone seating actuator including a seating head extending within an empty cone dispensed within one of said plurality of cone inserts, said cone seat actuator setting a height of said cone top of said cone filled with smokable material residing in one of said plurality of cone inserts, said cone seat actuator comprising a pneumatic actuator, or an electrical actuator.

31. The method of claim 21, comprising forming a V-shape cutout at a distal end of each seal plate, and forming a cut-out notch at a proximate end of each seal plate, opposite said distal end.

* * * * *